US006332936B1

(12) United States Patent
Hajaligol et al.

(10) Patent No.: US 6,332,936 B1
(45) Date of Patent: Dec. 25, 2001

(54) THERMOMECHANICAL PROCESSING OF PLASMA SPRAYED INTERMETALLIC SHEETS

(75) Inventors: Mohammad R. Hajaligol, Midlothian, VA (US); Clive Scorey, Cheshire, CT (US); Vinod K. Sikka, Oak Ridge, TN (US); Seetharama C. Deevi; Grier Fleischhauer, both of Midlothian, VA (US); A. Clifton Lilly, Jr., Chesterfield, VA (US); Randall M. German, State College, PA (US)

(73) Assignee: Chrysalis Technologies Incorporated, Richmond, VA (US)

( * ) Notice: Subject to any disclaimer, the term of this patent is extended or adjusted under 35 U.S.C. 154(b) by 0 days.

(21) Appl. No.: 09/399,364

(22) Filed: Sep. 20, 1999

Related U.S. Application Data

(63) Continuation of application No. 08/985,246, filed on Dec. 4, 1997, now Pat. No. 6,030,472.

(51) Int. Cl.[7] ..... B22F 5/00

(52) U.S. Cl. ..... 148/514; 419/28; 419/29; 419/43; 419/50

(58) Field of Search ..... 148/657, 514; 419/28, 29, 43, 50

(56) References Cited

U.S. PATENT DOCUMENTS

| | | |
|---|---|---|
| 1,550,508 | 8/1925 | Cooper . |
| 1,990,650 | 2/1935 | Jaeger . |
| 2,582,993 | 1/1952 | Howatt . |

(List continued on next page.)

FOREIGN PATENT DOCUMENTS

| | | |
|---|---|---|
| 648140 | 9/1962 | (CA) . |
| 648141 | 9/1962 | (CA) . |
| 53-119721 | 10/1978 | (JP) . |

OTHER PUBLICATIONS

*Microstructure and Mechanical Properties of P/M $Fe_3Al$ Alloys*, J. R. Knibloe et al., 1990, Advances in Powder Metallurgy, pp. 219–231.

(List continued on next page.)

*Primary Examiner*—Deborah Yee
(74) *Attorney, Agent, or Firm*—Burns, Doane, Swecker & Mathis, LLP

(57) ABSTRACT

A powder metallurgical process of preparing a sheet from a powder having an intermetallic alloy composition such as an iron, nickel or titanium aluminide. The sheet can be manufactured into electrical resistance heating elements having improved room temperature ductility, electrical resistivity, cyclic fatigue resistance, high temperature oxidation resistance, low and high temperature strength, and/or resistance to high temperature sagging. The iron aluminide has an entirely ferritic microstructure which is free of austenite and can include, in weight %, 4 to 32% Al, and optional additions such as ≦1% Cr, ≧0.05% Zr ≦2% Ti, ≦2% Mo, ≦1% Ni, ≦0.75% C, ≦0.1% B, ≦1% submicron oxide particles and/or electrically insulating or electrically conductive covalent ceramic particles, ≦1% rare earth metal, and/or ≦3% Cu. The process includes forming a non-densified metal sheet by consolidating a powder having an intermetallic alloy composition such as by roll compaction, tape casting or plasma spraying, forming a cold rolled sheet by cold rolling the non-densified metal sheet so as to increase the density and reduce the thickness thereof and annealing the cold rolled sheet. The powder can be a water, polymer or gas atomized powder which is subjecting to sieving and/or blending with a binder prior to the consolidation step. After the consolidation step, the sheet can be partially sintered. The cold rolling and/or annealing steps can be repeated to achieve the desired sheet thickness and properties. The annealing can be carried out in a vacuum furnace with a vacuum or inert atmosphere. During final annealing, the cold rolled sheet recrystallizes to an average grain size of about 10 to 30 $\mu$m. Final stress relief annealing can be carried out in the B2 phase temperature range.

22 Claims, 67 Drawing Sheets

U.S. PATENT DOCUMENTS

| | | | |
|---|---|---|---|
| 2,768,915 | | 10/1956 | Nachman et al. . |
| 2,889,224 | | 6/1959 | Evans et al. . |
| 2,966,719 | | 1/1961 | Park . |
| 3,026,197 | | 3/1962 | Schramm . |
| 3,097,929 | | 7/1963 | Ragan . |
| 3,144,330 | | 8/1964 | Storchheim . |
| 3,676,109 | | 7/1972 | Cooper . |
| 3,951,642 | | 4/1976 | Chang et al. . |
| 4,018,569 | | 4/1977 | Chang . |
| 4,198,442 | | 4/1980 | Gupta et al. . |
| 4,334,923 | | 6/1982 | Sherman . |
| 4,385,929 | | 5/1983 | Ichidate et al. . |
| 4,391,634 | | 7/1983 | Kelly et al. . |
| 4,429,019 | | 1/1984 | Schrewelius, deceased . |
| 4,684,505 | | 8/1987 | Brinegar et al. . |
| 4,917,858 | | 4/1990 | Eylon et al. . |
| 4,961,903 | | 10/1990 | McKamey et al. . |
| 5,024,109 | | 6/1991 | Romero et al. . |
| 5,032,190 | | 7/1991 | Suarez et al. . |
| 5,141,571 | | 8/1992 | Dubois . |
| 5,158,744 | | 10/1992 | Nazmy . |
| 5,238,645 | | 8/1993 | Sikka et al. . |
| 5,249,586 | | 10/1993 | Morgan et al. . |
| 5,269,830 | | 12/1993 | Rabin et al. . |
| 5,320,802 | | 6/1994 | Liu et al. . |
| 5,346,562 | | 9/1994 | Batawi et al. . |
| 5,350,107 | | 9/1994 | Wright et al. . |
| 5,422,070 | | 6/1995 | Nazmy et al. . |
| 5,429,173 | | 7/1995 | Wang et al. . |
| 5,445,790 | | 8/1995 | Hu et al. . |
| 5,455,001 | | 10/1995 | Hu . |
| 5,484,568 | | 1/1996 | Sekhar et al. . |
| 5,489,411 | * | 2/1996 | Jha et al. ..... 419/28 |
| 5,545,373 | | 8/1996 | Maziasz et al. . |
| 5,620,651 | * | 4/1997 | Sikka et al. ..... 420/81 |
| 5,671,532 | | 9/1997 | Rao et al. . |
| 5,719,238 | | 2/1998 | Flood et al. . |
| 5,738,705 | | 4/1998 | Anderson et al. . |
| 5,749,938 | | 5/1998 | Coombs . |
| 5,756,112 | | 5/1998 | Mackey . |
| 6,059,853 | | 5/2000 | Coombs . |
| 6,085,714 | | 7/2000 | Wilson et al. . |
| 6,165,628 | | 12/2000 | Borom et al. . |

OTHER PUBLICATIONS

*Powder Processing of $Fe_3Al$–Based Iron–Aluminide Alloys*, V. K. Sikka, 1991, Mat. Res., Soc. Symp. Proc., vol. 213, pp. 901–906.

*Powder Production, Processing, and Properties of $Fe_3Al$*, V. K. Sikka, 1990, Powder Metallurgy Conference Exhibition, pp. 1–11.

*Mechanical Behavior of $FeAl_{40}$ Intermetallic Alloys*, A. LeFort et al., (Jun. 17–20, 1991), Proceedings of International Symposium on Intermetallic Compounds –Structure and Mechanical Properties (JMIS–6), pp. 579–583.

*Production and Properties of CSM FeAl Intermetallic Alloys, D. Pocci et al., Feb. 27–Mar. 3, 1994), Minerals, Metals andd Materials Society Conference, pp. 19–30.*

*Selected Properties of Iron Aluminides, J. H. Schneibel, 1994 TMS Conference, pp. 329–341.*

*Flow and Fracture of FeAl*, J. Baker, 1994 TMS Conference, pp. 101–115.

*Impact Behavior of FeAl Alloy FA–350*, D. J. Alexander, 1994 TMS Conference, pp. 193–202.

*The Effect of Ternary Additions on the Vacancy Hardening and Defect Structure of FeAl*, C. H. Kong, 1994 TMS Conference, pp. 231–239.

*Microstructure and Tensile Properties of Fe–40 At. Pct. Al Alloys with C, ZR, Hf and B Additions*, D. J. Gaydosh et al., Sep. 189, Met. Trans A, vol. 20 A, pp. 1701–1714.

*A Review of Recent Developments of $Fe_3Al$–based Alloys*, C. G. McKamey et al., Aug. 1991, J. of Mater. Res., vol. 6, No. 8, pp. 1779–1805.

*Ceramics and Glasses*, Richard E. Mistler, 1991, Engineered Materials Handbook, vol. 4.

*Tape Casting: The Basic Process for Meeting the Needs of the Electronics Industry*, Richard E. Mistler, 1990, Ceramic Bulletin, vol. 69, No. 6.

*Thermal Spraying as a Method of Producing Rapidly Solidified Materials*, K. Murakami et al., (May 20–25, 1990), Third National Spray Conference, pp. 351–355.

The Osprey Process: Principles and Applications, A. G. Leatham et al., 1993, International Journal of Powder Metallurgy, vol. 29, No. 4, pp. 321–351.

*Application of Neural Networks in Spray Forming Technology*, R. Payne et al., 1993, The International Journal of Powder Metallurgy, vol. 29, No. 4, pp. 345–351.

* cited by examiner

WATER OR POLYMER ATOMIZING PREALLOYED POWDER

↓

SIEVING POWDER

↓

MIXING POWDER WITH ORGANIC BINDER AND SOLVENT

↓

ROLL COMPACTING POWDER INTO 0.024 TO 0.030" THICK GREEN STRIP

↓

BURNING OUT BINDER 6 HOURS AT 900°F IN ATMOSPHERIC FURNACE

↓

PRIMARY SINTERING 1 HOUR AT 2300°F IN VACUUM FURNACE

↓

COLD ROLLING STRIP TO 0.013" IN 4 HIGH ROLLING MILL

↓

ANNEALING 1 HOUR AT 2012°F IN VACUUM FURNACE

↓

TRIMMING STRIP IN HALF

↓

COLD ROLLING STRIP TO 0.010" IN 4 HIGH ROLLING MILL

↓

ANNEALING 1 HOUR AT 2300°F IN VACUUM FURNACE

↓

TRIMMING 1/8" OFF CRACKED ENDS AND EDGES AS NEEDED

↓

COLD ROLLING STRIP TO 0.008" IN 4 HIGH ROLLING MILL

↓

ANNEALING 1 HOUR AT 2012°F IN VACUUM FURNACE

↓

FINAL TRIMMING TO DESIRED LENGTH AND WIDTH

↓

STRESS RELIEVING 2 HOURS AT 700°C IN FURNACE WITH VACUUM ATMOSPHERE

↓

FORMING TUBULAR HEATING ELEMENT

FIG.17

THERMOMECHANICAL PROCESSING OF PLASMA SPRAYED INTERMETALLIC SHEETS

This application is a continuation, of application Ser. No. 08/985,246, filed Dec. 4, 1997, now U.S. Pat. No. 6,030,472 issued Feb. 29, 2000.

STATEMENT OF GOVERNMENT RIGHTS

The United States government has rights in this invention pursuant to contract No. DE-AC05-840R21400 between the United States Department of Energy and Lockheed Martin Energy Research Corporation, Inc.

FIELD OF THE INVENTION

The invention relates generally to intermetallic alloy compositions such as aluminides in the form of sheets and a powder metallurgical technique for preparation of such materials.

BACKGROUND OF THE INVENTION

Iron base alloys containing aluminum can have ordered and disordered body centered crystal structures. For instance, iron aluminide alloys having intermetallic alloy compositions contain iron and aluminum in various atomic proportions such as $Fe_3Al$, FeAl, $FeAl_2$, $FeAl_3$, and $Fe_2Al_5$. $Fe_3Al$ intermetallic iron aluminides having a body centered cubic ordered crystal structure are disclosed in U.S. Pat. Nos. 5,320,802; 5,158,744; 5,024,109; and 4,961,903. Such ordered crystal structures generally contain 25 to 40 atomic % Al and alloying additions such as Zr, B, Mo, C, Cr, V, Nb, Si and Y.

An iron aluminide alloy having a disordered body centered crystal structure is disclosed in U.S. Pat. No. 5,238,645 wherein the alloy includes, in weight %, 8–9.5 Al, ≦7 Cr, ≦4 Mo, ≦0.05 C, ≦0.5 Zr and ≦0.1 Y, preferably 4.5–5.5 Cr, 1.8–2.2 Mo, 0.02–0.032 C and 0.15–0.25 Zr. Except for three binary alloys having 8.46, 12.04 and 15.90 wt % Al, respectively, all of the specific alloy compositions disclosed in the '645 patent include a minimum of 5 wt % Cr. Further, the '645 patent states that the alloying elements improve strength, room-temperature ductility, high temperature oxidation resistance, aqueous corrosion resistance and resistance to pitting. The '645 patent does not relate to electrical resistance heating elements and does not address properties such as thermal fatigue resistance, electrical resistivity or high temperature sag resistance.

Iron-base alloys containing 3–18 wt % Al, 0.05–0.5 wt % Zr, 0.01–0.1 wt % B and optional Cr, Ti and Mo are disclosed in U.S. Pat. No. 3,026,197 and Canadian Patent No. 648,140. The Zr and B are stated to provide grain refinement, the preferred Al content is 10–18 wt % and the alloys are disclosed as having oxidation resistance and workability. However, like the '645 patent, the '197 and Canadian patents do not relate to electrical resistance heating elements and do not address properties such as thermal fatigue resistance, electrical resistivity or high temperature sag resistance.

U.S. Pat. No. 3,676,109 discloses an iron-base alloy containing 3–10 wt % Al, 4–8 wt % Cr, about 0.5 wt % Cu, less than 0.05 wt % C, 0.5–2 wt % Ti and optional Mn and B. The '109 patent discloses that the Cu improves resistance to rust spotting, the Cr avoids embrittlement and the Ti provides precipitation hardening. The '109 patent states that the alloys are useful for chemical processing equipment. All of the specific examples disclosed in the '109 patent include 0.5 wt % Cu and at least 1 wt % Cr, with the preferred alloys having at least 9 wt % total Al and Cr, a minimum Cr or Al of at least 6 wt % and a difference between the Al and Cr contents of less than 6 wt %. However, like the '645 patent, the '109 patent does not relate to electrical resistance heating elements and does not address properties such as thermal fatigue resistance, electrical resistivity or high temperature sag resistance.

Iron-base aluminum containing alloys for use as electrical resistance heating elements are disclosed in U.S. Pat. Nos. 1,550,508; 1,990,650; and 2,768,915 and in Canadian Patent No. 648,141. The alloys disclosed in the '508 patent include 20 wt % Al, 10 wt % Mn; 12–15 wt % Al, 6–8 wt % Mn; or 12–16 wt % Al, 2–10 wt % Cr. All of the specific examples disclosed in the '508 patent include at least 6 wt % Cr and at least 10 wt % Al. The alloys disclosed in the '650 patent include 16–20 wt % Al, 5–10 wt % Cr, ≦0.05 wt % C, ≦0.25 wt % Si, 0.1–0.5 wt % Ti, ≦1.5 wt % Mo and 0.4–1.5 wt % Mn and the only specific example includes 17.5 wt % Al, 8.5 wt % Cr, 0.44 wt % Mn, 0.36 wt % Ti, 0.02 wt % C and 0.13 wt % Si. The alloys disclosed in the '915 patent include 10–18 wt % Al, 1–5 wt % Mo, Ti, Ta, V, Cb, Cr, Ni, B and W and the only specific example includes 16 wt % Al and 3 wt % Mo. The alloys disclosed in the Canadian patent include 6–11 wt % Al, 3–10 wt % Cr, ≦4 wt % Mn, ≦1 wt % Si, ≦0.4 wt % Ti, ≦0.5 wt % C, 0.2–0.5 wt % Zr and 0.05–0.1 wt % B and the only specific examples include at least 5 wt % Cr.

Resistance heaters of various materials are disclosed in U.S. Pat. No. 5,249,586 and in U.S. patent application Ser. Nos. 07/943,504, 08/118,665, 08/105,346 and 08/224,848.

U.S. Pat. No. 4,334,923 discloses a cold-rollable oxidation resistant iron-base alloy useful for catalytic converters containing ≦0.05% C, 0.1–2% Si, 2–8% Al, 0.02–1% Y, <0.009% P, <0.006% S and <0.009% O.

U.S. Pat. No. 4,684,505 discloses a heat resistant iron-base alloy containing 10–22% Al, 2–12% Ti, 2–12% Mo, 0.1–1.2% Hf, ≦1.5% Si, ≦0.3% C, ≦0.2% B, 1.0% Ta, ≦0.5% W, ≦0.5% V, ≦0.5% Mn, ≦0.3% Co, ≦0.3% Nb, and ≦0.2% La. The '505 patent discloses a specific alloy having 16% Al, 0.5% Hf, 4% Mo, 3% Si, 4% Ti and 0.2% C.

Japanese Laid-open Patent Application No. 53-119721 discloses a wear resistant, high magnetic permeability alloy having good workability and containing 1.5–17% Al, 0.2–15% Cr and 0.01–8% total of optional additions of <4% Si, <8% Mo, <8% W, <8% Ti, <8% Ge, <8% Cu, <8% V, <8% Mn, <8% Nb, ≦8% Ta, <8% Ni, <8% Co, <3% Sn, <3% Sb, <3% Be, <3% Hf, <3% Zr, <0.5% Pb, and <3% rare earth metal. Except for a 16% Al, balance Fe alloy, all of the specific examples in Japan '721 include at least 1% Cr and except for a 5% Al, 3% Cr, balance Fe alloy, the remaining examples in Japan '721 include ≧10% Al.

A 1990 publication in Advances in Powder Metallurgy, Vol. 2, by J. R. Knibloe et al., entitled "Microstructure And Mechanical Properties of P/M $Fe_3Al$ Alloys", pp. 219–231, discloses a powder metallurgical process for preparing $Fe_3Al$ containing 2 and 5% Cr by using an inert gas atomizer. This publication explains that $Fe_3Al$ alloys have a $DO_3$ structure at low temperatures and transform to a B2 structure above about 550° C. To make sheet, the powders were canned in mild steel, evacuated and hot extruded at 1000° C. to an area reduction ratio of 9:1. After removing from the steel can, the alloy extrusion was hot forged at 1000° C. to 0.340 inch thick, rolled at 800° C. to sheet approximately 0.10 inch thick and finish rolled at 650° C. to 0.030 inch. According to this publication, the atomized powders were generally spherical and provided dense extrusions and room temperature ductility approaching 20% was achieved by maximizing the amount of B2 structure.

A 1991 publication in Mat. Res. Soc. Symp. Proc., Vol. 213, by V. K. Sikka entitled "Powder Processing of $Fe_3Al$-Based Iron-Aluminide Alloys," pp. 901–906, discloses a process of preparing 2 and 5% Cr containing $Fe_3Al$-based iron-aluminide powders fabricated into sheet. This publication states that the powders were prepared by nitrogen-gas atomization and argon-gas atomization. The nitrogen-gas atomized powders had low levels of oxygen (130 ppm) and nitrogen (30 ppm). To make sheet, the powders were canned in mild steel and hot extruded at 1000° C. to an area reduction ratio of 9:1. The extruded nitrogen-gas atomized powder had a grain size of 30 μm. The steel can was removed and the bars were forged 50% at 1000° C., rolled 50% at 850° C. and finish rolled 50% at 650° C. to 0.76 mm sheet.

A paper by V. K. Sikka et al., entitled "Powder Production, Processing, and Properties of $Fe_3Al$", pp. 1–11, presented at the 1990 Powder Metallurgy Conference Exhibition in Pittsburgh, Pa., discloses a process of preparing $Fe_3Al$ powder by melting constituent metals under a protective atmosphere, passing the metal through a metering nozzle and disintegrating the melt by impingement of the melt stream with nitrogen atomizing gas. The powder had low oxygen (130 ppm) and nitrogen (30 ppm) and was spherical. An extruded bar was produced by filling a 76 mm mild steel can with the powder, evacuating the can, heating 1½ hour at 1000° C. and extruding the can through a 25 mm die for a 9:1 reduction. The grain size of the extruded bar was 20 μm. A sheet 0.76 mm thick was produced by removing the can, forging 50% at 1000° C., rolling 50% at 850° C. and finish rolling 50% at 650° C.

Oxide dispersion strengthened iron-base alloy powders are disclosed in U.S. Pat. Nos. 4,391,634 and 5,032,190. The '634 patent discloses Ti-free alloys containing 10–40% Cr, 1–10% Al and ≦10% oxide dispersoid. The '190 patent discloses a method of forming sheet from alloy MA 956 having 75% Fe, 20% Cr, 4.5% Al, 0.5% Ti and 0.5% $Y_2O_3$.

A publication by A. LeFort et al., entitled "Mechanical Behavior of $FeAl_{40}$ Intermetallic Alloys" presented at the Proceedings of International Symposium on Intermetallic Compounds—Structure and Mechanical Properties (JIMIS-6), pp. 579–583, held in Sendai, Japan on Jun. 17–20, 1991, discloses various properties of FeAl alloys (25 wt % Al) with additions of boron, zirconium, chromium and cerium. The alloys were prepared by vacuum casting and extruding at 1100° C. or formed by compression at 1000° C. and 1100° C. This article explains that the excellent resistance of FeAl compounds in oxidizing and sulfidizing conditions is due to the high Al content and the stability of the B2 ordered structure.

A publication by D. Pocci et al., entitled "Production and Properties of CSM FeAl Intermetallic Alloys" presented at the Minerals, Metals and Materials Society Conference (1994 TMS Conference) on "Processing, Properties and Applications of Iron Aluminides", pp. 19–30, held in San Francisco, Calif. on Feb. 27–Mar. 3, 1994, discloses various properties of $Fe_{40}Al$ intermetallic compounds processed by different techniques such as casting and extrusion, gas atomization of powder and extrusion and mechanical alloying of powder and extrusion and that mechanical alloying has been employed to reinforce the material with a fine oxide dispersion. The article states that FeAl alloys were prepared having a B2 ordered crystal structure, an Al content ranging from 23 to 25 wt % (about 40 at %) and alloying additions of Zr, Cr, Ce, C, B and $Y_2O_3$. The article states that the materials are candidates as structural materials in corrosive environments at high temperatures and will find use in thermal engines, compressor stages of jet engines, coal gasification plants and the petrochemical industry.

A publication by J. H. Schneibel entitled "Selected Properties of Iron Aluminides", pp. 329–341, presented at the 1994 TMS Conference discloses properties of iron aluminides. This article reports properties such as melting temperatures, electrical resistivity, thermal conductivity, thermal expansion and mechanical properties of various FeAl compositions.

A publication by J. Baker entitled "Flow and Fracture of FeAl", pp. 101–115, presented at the 1994 TMS Conference discloses an overview of the flow and fracture of the B2 compound FeAl. This article states that prior heat treatments strongly affect the mechanical properties of FeAl and that higher cooling rates after elevated temperature annealing provide higher room temperature yield strength and hardness but lower ductility due to excess vacancies. With respect to such vacancies, the articles indicates that the presence of solute atoms tends to mitigate the retained vacancy effect and long term annealing can be used to remove excess vacancies.

A publication by D. J. Alexander entitled "Impact Behavior of FeAl Alloy FA-350", pp. 193–202, presented at the 1994 TMS Conference discloses impact and tensile properties of iron aluminide alloy FA-350. The FA-350 alloy includes, in atomic %, 35.8% Al, 0.2% Mo, 0.05% Zr and 0.13% C.

A publication by C. H. Kong entitled "The Effect of Ternary Additions on the Vacancy Hardening and Defect Structure of FeAl", pp. 231–239, presented at the 1994 TMS Conference discloses the effect of ternary alloying additions on FeAl alloys. This article states that the B2 structured compound FeAl exhibits low room temperature ductility and unacceptably low high temperature strength above 500° C. The article states that room temperature brittleness is caused by retention of a high concentration of vacancies following high temperature heat treatments. The article discusses the effects of various ternary alloying additions such as Cu, Ni, Co, Mn, Cr, V and Ti as well as high temperature annealing and subsequent low temperature vacancy-relieving heat treatment.

A publication by D. J. Gaydosh et al., entitled "Microstructure and Tensile Properties of Fe-40 At. Pct. Al Alloys with C, Zr, Hf and B Additions" in the September 1989 Met. Trans A, Vol. 20A, pp. 1701–1714, discloses hot extrusion of gas-atomized powder wherein the powder either includes C, Zr and Hf as prealloyed additions or B is added to a previously prepared iron-aluminum powder.

A publication by C. G. McKamey et al., entitled "A review of recent developments in $Fe_3Al$-based Alloys" in the August 1991 J. of Mater. Res., Vol. 6, No. 8, pp. 1779–1805, discloses techniques for obtaining iron-aluminide powders by inert gas atomization and preparing ternary alloy powders based on $Fe_3Al$ by mixing alloy powders to produce the desired alloy composition and consolidating by hot extrusion, i.e., preparation of $Fe_3Al$-based powders by nitrogen- or argon-gas atomization and consolidation to full density by extruding at 1000° C. to an area reduction of ≦9:1.

U.S. Pat. Nos. 4,917,858; 5,269,830; and 5,455,001 disclose powder metallurgical techniques for preparation of intermetallic compositions by (1) rolling blended powder into green foil, sintering and pressing the foil to full density, (2) reactive sintering of Fe and Al powders to form iron aluminide or by preparing Ni—B—Al and Ni—B—Ni composite powders by electroless plating, canning the powder in a tube, heat treating the canned powder, cold rolling the tube-canned powder and heat treating the cold rolled powder to obtain an intermetallic compound. U.S. Pat. No. 5,484,568 discloses a powder metallurgical technique for preparing heating elements by micropyretic synthesis wherein a combustion wave converts reactants to a desired product. In this process, a filler material, a reactive system and a plasticizer are formed into a slurry and shaped by plastic extrusion, slip casting or coating followed by combusting the shape by ignition. U.S. Pat. No. 5,489,411 discloses a powder metallurgical technique for preparing titanium aluminide foil by plasma spraying a coilable strip, heat treating the strip to relieve residual stresses, placing the rough sides of two such strips together and squeezing the strips together between pressure bonding rolls, followed by solution annealing, cold rolling and intermediate anneals.

U.S. Pat. No. 4,385,929 discloses a method for making irregularly shaped steel powder with low oxygen content by an atomizing technique wherein a molten stream of metal is contacted with a non-polar solvent such as mineral oil, animal or vegetable oil.

U.S. Pat. No. 3,144,330 discloses a powder metallurgical technique for making electrical resistance iron-aluminum alloys by hot rolling and cold rolling elemental powder, prealloyed powders or mixtures thereof into strip. U.S. Pat. No. 2,889,224 discloses a technique for preparing sheet from carbonyl nickel powder or carbonyl iron powder by cold rolling and annealing the powder.

Based on the foregoing, there is a need in the art for an economical technique for preparing intermetallic compositions such as iron aluminides. There is also a need in the art for an economical technique for preparing resistance heating elements from intermetallic alloy compositions such as iron aluminides which exhibit a desirable resistivity at an aluminum concentration which heretofore has required hot working steps such as extrusion of canned FeAl powder/cast metal or hot rolling of clad FeAl powder/cast metal. For instance, conventional powder metallurgical techniques of preparing iron-aluminides include melting iron and aluminum and inert gas atomizing the melt to form an iron-aluminide powder, canning the powder and working the canned material at elevated temperatures. It would be desirable if iron-aluminide could be prepared by a powder metallurgical technique wherein it is not necessary to can the powder and wherein it is not necessary to subject the iron and aluminum to any hot working steps in order to form an iron-aluminide sheet product.

SUMMARY OF THE INVENTION

The invention provides a method of manufacturing a metal sheet having an intermetallic alloy composition by a powder metallurgical technique. The method includes forming a non-densified metal sheet by consolidating a prealloyed powder having an intermetallic alloy composition; forming a cold rolled sheet by cold rolling the non-densified metal sheet so as to densify and reduce the thickness thereof; and heat treating the cold rolled sheet.

According to a preferred embodiment, the intermetallic alloy is an iron aluminide alloy. The iron aluminide can include, in weight %, 4.0 to 32.0% Al and have a ferritic microstructure which is austenite-free. The intermetallic alloy can comprise $Fe_3Al$, $Fe_2Al_5$, $FeAl_3$, FeAl, FeAlC, $Fe_3AlC$ or mixtures thereof. The iron aluminide can comprise, in weight %, ≦2% Mo, ≦1% Zr, ≦2% Si, ≦30% Ni, ≦10% Cr, ≦0.5% C, ≦0.5% Y, ≦0.1% B, ≦1% Nb and ≦1% Ta. For instance, the iron aluminide can consist essentially of, in weight %, 20–32% Al, 0.3–0.5% Mo, 0.05–0.3% Zr, 0.01–0.5% C, ≦1% $Al_2O_3$ particles, ≦1% $Y_2O_3$ particles, balance Fe.

The method can include various optional steps and/or features. For instance, the consolidation step can comprise tape casting a mixture of the powder and a binder, roll compacting a mixture of the powder and a binder or plasma spraying the powder onto a substrate. In the case of tape casting or roll compaction, the method can include heating the non-densified metal sheet at a temperature sufficient to remove volatile components from the non-densified metal sheet. For instance, the article can be heated to a temperature below 500° C. during the step of removing the volatile components.

According to a preferred embodiment, the method includes forming the cold rolled sheet into an electrical resistance heating element subsequent to the heat treating step, the electrical resistance heating element being capable of heating to 900° C. in less than 1 second when a voltage up to 10 volts and up to 6 amps is passed through the heating element.

According to one embodiment, the non-densified metal sheet is initially or fully sintered prior to the cold rolling step and the cold rolling step can be repeated with intermediate annealing of the cold rolled sheet. The final cold rolling step can be followed by a stress relieving heat treatment. The powder can comprise gas or water or polymer atomized powder and the method can further comprise sieving the powder and in the case of roll compaction or tape casting, coating the powder with a binder prior to the consolidation step. The heat treating step can be carried out at a temperature of 1000 to 1200° C. in a vacuum or inert atmosphere. In the final cold rolling step the sheet can be reduced to a thickness of less than 0.010 inch. The powder can have a particle size distribution of 10 to 200 μm, preferably 30 to 60 μm. For example, the powder used for tape casting preferably passes 325 mesh and the powder used for roll compaction preferably comprises a mixture of 43 to 150 μm powder with a small amount (e.g. 5%) of ≦43 μm powder.

Due to the hardness of the intermetallic alloy it is advantageous if cold rolling is carried out with rollers having carbide rolling surfaces in direct contact with the sheet. The sheet is preferably produced without hot working the intermetallic alloy.

BRIEF DESCRIPTION OF THE DRAWINGS

FIGS. 12*a–e* show creep data for alloys 35, 46, 48 and 56, wherein FIG. 12*a* shows creep data for alloy 35 after annealing at 1050° C. for two hours in vacuum, FIG. 12*b* shows creep data for alloy 46 after annealing at 700° C. for one hour and air cooling, FIG. 12*c* shows creep data for alloy 48 after annealing at 1100° C. for one hour in vacuum and wherein the test is carried out at 1 ksi at 800° C., FIG. 12*d* shows the sample of FIG. 12*c* tested at 3 ksi and 800° C. and FIG. 12*e* shows alloy 56 after annealing at 100° C. for one hour in vacuum and tested at 3 ksi and 800° C.;

FIGS. 13*a–c* show graphs of hardness (Rockwell C) values for alloys 48, 49, 51, 52, 53, 54 and 56 wherein FIG. 13*a* shows hardness versus annealing for 1 hour at temperatures of 750–1300° C. for alloy 48; FIG. 13*b* shows hardness versus annealing at 400° C. for times of 0–140 hours for alloys 49, 51 and 56; and FIG. 13*c* shows hardness versus annealing at 400° C. for times of 0–80 hours for alloys 52, 53 and 54;

FIGS. 14*a–e* show graphs of creep strain data versus time for alloys 48, 51 and 56, wherein FIG. 14*a* shows a comparison of creep strain at 800° C. for alloys 48 and 56, FIG. 14*b* shows creep strain at 800° C. for alloy 48, FIG. 14*c* shows creep strain at 800° C., 825° C. and 850° C. for alloy 48 after annealing at 1100° C. for one hour, FIG. 14*d* shows creep strain at 800° C., 825° C. and 850° C. for alloy 48 after annealing at 750° C. for one hour, and FIG. 14*e* shows creep strain at 850° C. for alloy 51 after annealing at 400° C. for 139 hours;

FIGS. 15*a–b* show graphs of creep strain data versus time for alloy 62 wherein FIG. 15*a* shows a comparison of creep strain at 850° C. and 875° C. for alloy 62 in the form of sheet and FIG. 15*b* shows creep strain at 800° C., 850° C. and 875° C. for alloy 62 in the form of bar; and FIGS. 16*a–b* show graphs of electrical resistivity versus temperature for alloys 46 and 43 wherein FIG. 16*a* shows electrical resistivity of alloys 46 and 43 and FIG. 16*b* shows effects of a heating cycle on electrical resistivity of alloy 43.

FIG. 17 shows a flow chart of processing steps incorporating a roll compaction step in accordance with the invention;

DETAILED DESCRIPTION OF THE PREFERRED EMBODIMENT

Figure 1A:
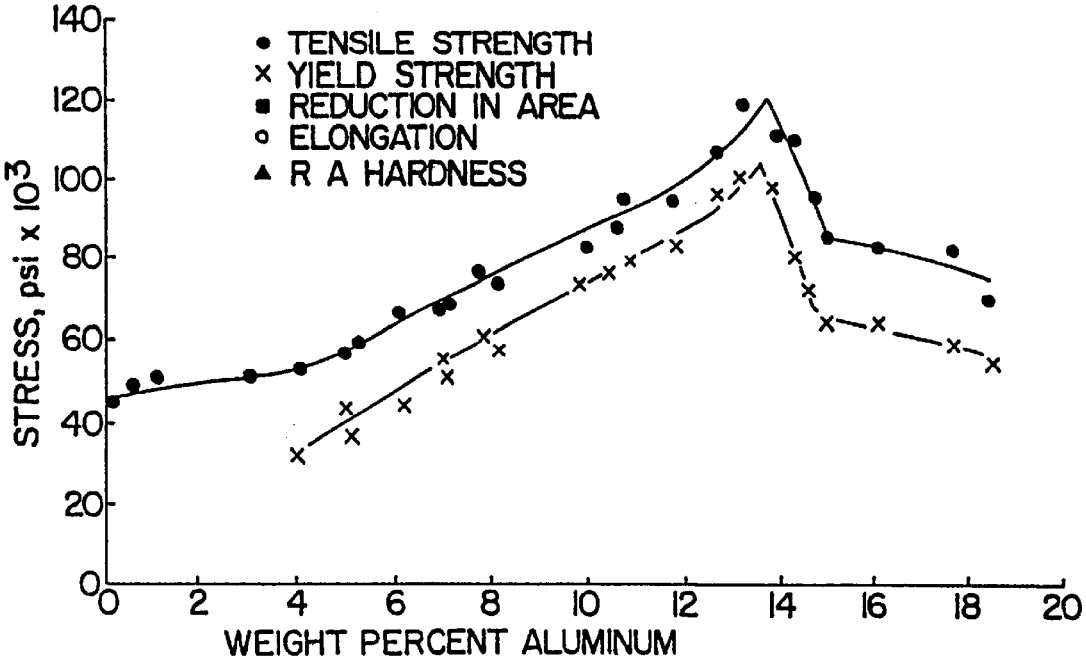
FIG. 1 shows the effect of changes in Al content on room-temperature properties of an aluminum containing iron-base alloy.
Figure 1B:
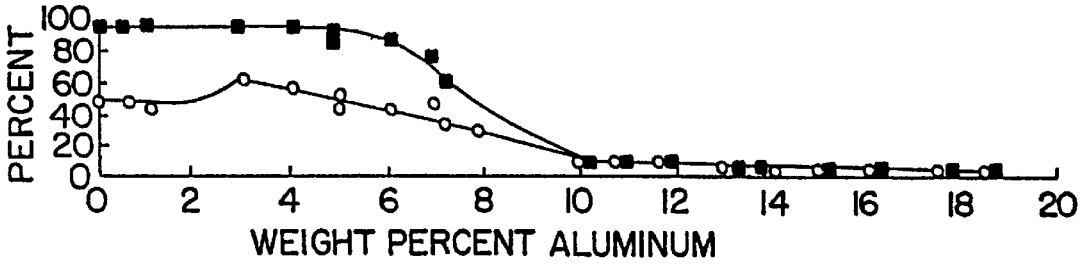
Figure 1C:
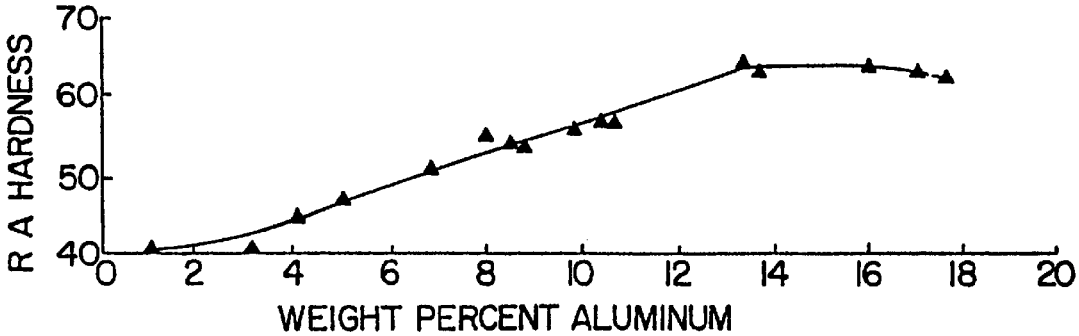
Figure 1D:
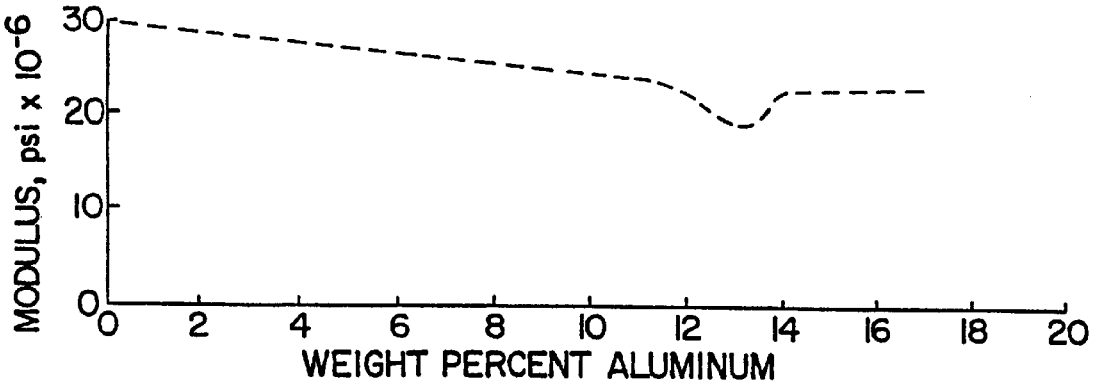

The invention provides various powder metallurgical techniques for forming intermetallic alloy compositions. The powder can be elemental powders reacted via reaction synthesis to form the intermetallic compound or prealloyed powder having an intermetallic alloy composition can be used according to the following embodiments.

REACTION SYNTHESIS

According to a first embodiment, the invention provides a simple and economical powder metallurgical process for preparing iron-aluminide in desirable shapes such as sheet, bar, wire, or other desired shape of the material. In the process, a mixture of iron and aluminum powder is prepared, the mixture is shaped into an article and the article is heated in order to react the iron and aluminum powders and form iron-aluminide, and sintered to reach full density. The shaping can be carried out at low temperature by cold rolling the powder without encasing the powder in a protective shell such as a metal can. The aluminum powder is preferably an unalloyed aluminum powder but the iron powder can be pure iron powder or an iron alloy powder. Moreover, additional alloying components can be mixed with the iron and aluminum powders when the mixture is formed.

Prior to shaping the article, a binder such as paraffin and/or a sintering aid is preferably added to the powder mixture. After the shaping step, it is desirable to remove volatile components in the article by heating the article to a suitable temperature to remove the volatile components. For instance, the article can be heated to a temperature in the range of 500 to 700° C., preferably 550 to 650° C. for a suitable time such as ½ to 2 hours in order to remove volatile components such as oxygen, carbon, hydrogen and nitrogen. The article can be heated in a vacuum or inert gas atmosphere such as an argon atmosphere and the heating is preferably at a rate of no more than 200° C./min. During this preliminary heating stage, some of the aluminum may react with the iron to form compounds such as $Fe_3Al$ or $Fe_2Al_5$ or $FeAl_3$ and a minor amount of aluminum may react with the iron to form FeAl. However, during the sintering step iron and aluminum react to form the desired iron-aluminide such as FeAl.

The synthesis step can be carried out at a temperature above the melting point of aluminum in order to react the iron and aluminum to form the desired iron aluminide. The sintering is preferably carried out at a temperature of 1250 to 1300° C. for ½ to 2 hours in a vacuum or inert gas (e.g., Ar) atmosphere. During the sintering step, free aluminum melts and reacts with iron to form iron-aluminide.

The sintering step can produce substantial porosity in the sintered article, e.g., 2540 vol % porosity. In order to reduce such porosity, the sintered article can be hot or cold rolled to reduce the thickness thereof and thereby increase the density and remove porosity in the article. If hot rolling is carried out, the hot rolling is preferably carried in an inert atmosphere or the article can be protected by a protective coating such as a metal or glass coating during the hot rolling step. If the article is subjected to cold rolling, it is not necessary to roll the article in a protective environment. Subsequent to the hot or cold rolling, the article can be annealed at a temperature of 1000–1200° C. in a vacuum or inert gas atmosphere for ½ to 2 hours. Then, the article can be further worked and/or annealed, as desired.

According to an example of the process according to the invention, a sheet of iron-aluminide containing 22–32 wt % Al (3846 at % Al) is prepared as follows. First, a mixture of aluminum powder and iron powder along with optional alloying constituents is prepared, binder is added to the powder mixture and a compact is prepared for rolling or the mixture is fed directly to a rolling apparatus. The powder mixture is subjected to cold rolling to produce a sheet having a thickness of 0.022–0.030 inch. The rolled sheet is then heated at a rate of ≦200° C./min to 600° C. and held at this temperature in a vacuum or Ar atmosphere for ½ to 2 hours in order to drive off volatile components of the binders in the powder mixture. Subsequently, the temperature of the article is increased to 1250 to 1300° C. in the vacuum or argon atmosphere and the article is sintered for ½ to 2 hours. During the heating at 600° C., part of the aluminum reacts with iron to form $Fe_3Al$, $Fe_2Al_5$ and/or $FeAl_3$ with only a minor amount of FeAl being formed. During the sintering step at 1250 to 1300° C., remaining free aluminum melts and forms additional FeAl and the $Fe_3Al$, $Fe_2Al_5$ and $FeAl_3$ compounds are converted to FeAl. The sintering results in a porosity of 25 to 40%. In order to remove the porosity, the sintered article is hot or cold rolled to a thickness of 0.008 inch. For instance, the sintered sheet can be cold rolled to about 0.012 inch, annealed at 1000 to 1200° C. for ½ to 2 hours in a vacuum or argon atmosphere, cold rolled to about 0.010 inch in one or more steps with intermediate annealing at 1000 to 1200° C. for ½ to 2 hours, cold rolled to about 0.008 inch and again annealed at 1100 to 1200° C. for ½ to 2 hours in a vacuum argon atmosphere. The finished sheet can then be processed further into electrical resistance heating elements.

The powder composition can be formed into a tape or sheet by a tape casting process. For instance, a layer of the powder composition can be deposited from a reservoir on a sheet of material (such as a cellulose acetate sheet) as the sheet is unwound from a roll. The thickness of the powder layer on the sheet can be controlled by one or more doctor blades which contact an upper surface of the powder layer as it travels on the sheet past the doctor blade(s). The powder composition preferably includes a binder which forms a tough but flexible film, volatilizes without leaving a residue in the powder, is not affected by ambient conditions during storage, is relatively inexpensive and/or is soluble in inexpensive yet volatile and non-flammable organic solvents. Selection of the binder may depend on tape thickness, casting surface and/or solvent desired.

For tape casting a thick layer of at least 0.01 inch thick, the binder can comprise 3 parts polyvinyl butyryl (e.g., Butvar Type 13–76 sold by Monsanto Co.), the solvent can comprise 35 parts toluene and the plasticizer can comprise 5.6 parts polyethylene glycol per 100 parts by weight powder. For tape casting a thin layer of less than 0.01 inch thick, the binder can comprise 15 parts vinyl chloride-acetate (e.g., VYNS, 90-10 vinyl chloride-vinyl acetate copolymer sold by Union Carbide Corp.), the solvent can comprise 85 parts MEK and the plasticizer can comprise 1 part butyl benzyl phthalate. If desired, the powder tape casting mixture can also include other ingredients such as deflocculants and/or wetting agents. Suitable binder, solvent, plastizer, deflocculant and/or wetting agent compositions for tape casting in accordance with the invention will be apparent to the skilled artisan.

The method according to the invention can be used to prepare various iron aluminide alloys containing at least 4% by weight (wt %) of aluminum and having various structures depending on the Al content, e.g., a $Fe_3Al$ phase with a $DO_3$ structure or an FeAl phase with a B2 structure. The alloys preferably are ferritic with an austenite-free microstructure and may contain one or more alloy elements selected from molybdenum, titanium, carbon, rare earth metal such as yttrium or cerium, boron, chromium, oxide such as $Al_2O$or $Y_2O_3$, and a carbide former (such as zirconium, niobium and/or tantalum) which is useable in conjunction with the carbon for forming carbide phases within the solid solution matrix for the purpose of controlling grain size and/or precipitation strengthening.

The aluminum concentration in the FeAl phase alloys can range from 14 to 32% by weight (nominal) and the Fe—Al alloys when wrought or powder metallurgically processed can be tailored to provide selected room temperature ductilities at a desirable level by annealing the alloys in a suitable atmosphere at a selected temperature greater than about 700° C. (e.g., 700–1100° C.) and then furnace cooling, air cooling or oil quenching the alloys while retaining yield and ultimate tensile strengths, resistance to oxidation and aqueous corrosion properties.

The concentration of the alloying constituents used in forming the Fe—Al alloys is expressed herein in nominal weight percent. However, the nominal weight of the aluminum in these alloys essentially corresponds to at least about 97% of the actual weight of the aluminum in the alloys. For example, a nominal 18.46 wt % may provide an actual 18.27 wt % of aluminum, which is about 99% of the nominal concentration.

The Fe—Al alloys can be processed or alloyed with one or more selected alloying elements for improving properties such as strength, room-temperature ductility, oxidation resistance, aqueous corrosion resistance, pitting resistance, thermal fatigue resistance, electrical resistivity, high temperature sag or creep resistance and resistance to weight gain. Effects of various alloying additions and processing are shown in the drawings, Tables 1–6 and following discussion.

The aluminum containing iron based alloys can be manufactured into electrical resistance heating elements. However, the alloy compositions disclosed herein can be used for other purposes such as in thermal spray applications wherein the alloys could be used as coatings having oxidation and corrosion resistance. Also, the alloys could be used as oxidation and corrosion resistant electrodes, furnace components, chemical reactors, sulfidization resistant materials, corrosion resistant materials for use in the chemical industry, pipe for conveying coal slurry or coal tar, substrate materials for catalytic converters, exhaust pipes for automotive engines, porous filters, etc.

According to one aspect of the invention, the geometry of the alloy can be varied to optimize heater resistance according to the formula: $R=\rho\ (L/W\times T)$ wherein R=resistance of the heater, $\rho$=resistivity of the heater material, L=length of heater, W=width of heater and T=thickness of heater. The resistivity of the heater material can be varied by adjusting the aluminum content of the alloy, processing of the alloy or incorporating alloying additions in the alloy. For instance, the resistivity can be significantly increased by incorporating particles of alumina in the heater material. The alloy can optionally include other ceramic particles to enhance creep resistance and/or thermal conductivity. For instance, the heater material can include particles or fibers of electrically conductive material such as nitrides of transition metals (Zr, Ti, Hf), carbides of transition metals, borides of transition metals and $MoSi_2$ for purposes of providing good high temperature creep resistance up to 1200° C. and also excellent oxidation resistance. The heater material may also incorporate particles of electrically insulating material such as $Al_2O_3$, $Y_2O_3$, $Si_3N_4$, $ZrO_2$ for purposes of making the heater material creep resistant at high temperature and also improving thermal conductivity and/or reducing the thermal coefficient of expansion of the heater material. The electrically insulating/conductive particles/fibers can be added to a powder mixture of Fe, Al or iron aluminide or such particles/fibers can be formed by reaction synthesis of elemental powders which react exothermically during manufacture of the heater element.

The heater material can be made in various ways. For instance, the heater material can be made from a prealloyed powder, by mechanically alloying the alloy constituents or by reacting powders of iron and aluminum after a powder mixture thereof has been shaped into an article such as a sheet of cold rolled powder. The creep resistance of the material can be improved in various ways. For instance, a prealloyed powder can be mixed with $Y_2O_3$ and mechanically alloyed so as to be sandwiched in the prealloyed powder. The mechanically alloyed powder can be processed by conventional powder metallurgical techniques such as by canning and extruding, slip casting, centrifugal casting, hot pressing and hot isostatic pressing. Another technique is to use pure elemental powders of Fe, Al and optional alloying elements with or without ceramic particles such as $Y_2O_3$ and cerium oxide and mechanically alloying such ingredients. In addition to the above, the above mentioned electrically insulating and/or electrically conductive particles can be incorporated in the powder mixture to tailor physical properties and high temperature creep resistance of the heater material.

The heater material can be made by conventional casting or powder metallurgy techniques. For instance, the heater material can be produced from a mixture of powder having different fractions but a preferred powder mixture comprises particles having a size smaller than 100 mesh. According to one aspect of the invention, the powder can be produced by gas atomization in which case the powder may have a spherical morphology. According to another aspect of the invention, the powder can be made by water or polymer atomization in which case the powder may have an irregular morphology. Polymer atomized powder has higher carbon content and lower surface oxide than water atomized powder. The powder produced by water atomization can include an aluminum oxide coating on the powder particles and such aluminum oxide can be broken up and incorporated in the heater material during thermomechanical processing of the powder to form shapes such as sheet, bar, etc. The alumina particles, depending on size, distribution and amount thereof, can be effective in increasing resistivity of the iron aluminum alloy. Moreover, the alumina particles can be used to increase strength and creep resistance with or without reduction in ductility.

When molybdenum is used as one of the alloying constituents it can be added in an effective range from more than incidental impurities up to about 5.0% with the effective amount being sufficient to promote solid solution hardening of the alloy and resistance to creep of the alloy when exposed to high temperatures. The concentration of the molybdenum can range from 0.25 to 4.25% and in one preferred embodiment is in the range of about 0.3 to 0.5%. Molybdenum additions greater than about 2.0% detract from the room-temperature ductility due to the relatively large extent of solid solution hardening caused by the presence of molybdenum in such concentrations.

Titanium can be added in an amount effective to improve creep strength of the alloy and can be present in amounts up to 3%. When present, the concentration of titanium is preferably in the range of ≦2.0%.

When carbon and the carbide former are used in the alloy, the carbon is present in an effective amount ranging from more than incidental impurities up to about 0.75% and the carbide former is present in an effective amount ranging from more than incidental impurities up to about 1.0% or more. The carbon concentration is preferably in the range of about 0.03% to about 0.3%. The effective amount of the carbon and the carbide former are each sufficient to together provide for the formation of sufficient carbides to control grain growth in the alloy during exposure thereof to increasing temperatures. The carbides may also provide some precipitation strengthening in the alloys. The concentration of the carbon and the carbide former in the alloy can be such that the carbide addition provides a stoichiometric or near stoichiometric ratio of carbon to carbide former so that essentially no excess carbon will remain in the finished alloy. Zirconium can be incorporated in the alloy to improve high temperature oxidation resistance. If carbon is present in the alloy, an excess of a carbide former such as zirconium in the alloy is beneficial in as much as it will help form a spallation-resistant oxide during high temperature thermal cycling in air. Zirconium is more effective than Hf since Zr forms oxide stringers perpendicular to the exposed surface of the alloy which pins the surface oxide whereas Hf forms oxide stringers which are parallel to the surface.

The carbide formers include such carbide-forming elements as zirconium, niobium, tantalum and hafnium and combinations thereof. The carbide former is preferably zirconium in a concentration sufficient for forming carbides with the carbon present within the alloy with this amount being in the range of about 0.02% to 0.6%. The concentrations for niobium, tantalum and hafnium when used as carbide formers essentially correspond to those of the zirconium.

In addition to the aforementioned alloy elements the use of an effective amount of a rare earth element such as about 0.05–0.25% cerium or yttrium in the alloy composition is beneficial since it has been found that such elements improve oxidation resistance of the alloy.

Improvement in properties can also be obtained by adding up to 30 wt % of oxide dispersoid particles such as $Y_2O_3$, $Al_2O_3$ or the like. The oxide dispersoid particles can be added to a melt or powder mixture of Fe, Al and other alloying elements. Alternatively, the oxide can be created in situ by water atomizing a melt of an aluminum-containing iron-based alloy whereby a coating of alumina or yttria on iron-aluminum powder is obtained. During processing of the powder, the oxides break up and are dispersed in the final product. Incorporation of the oxide particles in the iron-aluminum alloy is effective in increasing the resistivity of the alloy. For instance, by incorporating a sufficient amount of oxide particles in the alloy, it may be possible to raise the resistivity from around 100 $\mu\Omega\cdot$cm to about 160 $\mu\Omega\cdot$cm.

In order to improve thermal conductivity and/or resistivity of the alloy, particles of electrically conductive and/or electrically insulating metal compounds can be incorporated in the alloy. Such metal compounds include oxides, nitrides, silicides, borides and carbides of elements selected from groups IVb, Vb and VIb of the periodic table. The carbides can include carbides of Zr, Ta, Ti, Si, B, etc., the borides can include borides of Zr, Ta, Ti, Mo, etc., the silicides can include silicides of Mg, Ca, Ti, V, Cr, Mn, Zr, Nb, Mo, Ta, W, etc., the nitrides can include nitrides of Al, Si, Ti, Zr, etc., and the oxides can include oxides of Y, Al, Si, Ti, Zr, etc. In the case where the FeAl alloy is oxide dispersion strengthened, the oxides can be added to the powder mixture or formed in situ by adding pure metal such as Y to a molten metal bath whereby the Y can be oxidized in the molten bath, during atomization of the molten metal into powder and/or by subsequent treatment of the powder. For instance, the heater material can include particles of electrically conductive material such as nitrides of transition metals (Zr, Ti, Hf), carbides of transition metals, borides of transition of metals and $MoSi_2$ for purposes of providing good high temperature creep resistance up to 1200° C. and also excellent oxidation resistance. The heater material may also incorporate particles of electrically insulating material such as $Al_2O_3$, $Y_2O_3$, $Si_3N_4$, $ZrO_2$ for purposes of making the heater material creep resistant at high temperature and also enhancing thermal conductivity and/or reducing the thermal coefficient of expansion of the heater material.

Additional elements which can be added to the alloys according to the invention include Si, Ni and B. For instance, small amounts of Si up to 2.0% can improve low and high temperature strength but room temperature and high temperature ductility of the alloy are adversely affected with additions of Si above 0.25 wt %. The addition of up to 30 wt % Ni can improve strength of the alloy via second phase strengthening but Ni adds to the cost of the alloy and can reduce room and high temperature ductility thus leading to fabrication difficulties particularly at high temperatures. Small amounts of B can improve ductility of the alloy and B can be used in combination with Ti and/or Zr to provide titanium and/or zirconium boride precipitates for grain refinement. The effects to Al, Si and Ti are shown in FIGS. 1–7.

FIG. 1 shows the effect of changes in Al content on room temperature properties of an aluminum containing iron-base alloy. In particular, FIG. 1 shows tensile strength, yield strength, reduction in area, elongation and Rockwell A hardness values for iron-base alloys containing up to 20 wt % Al.

Figure 2A:
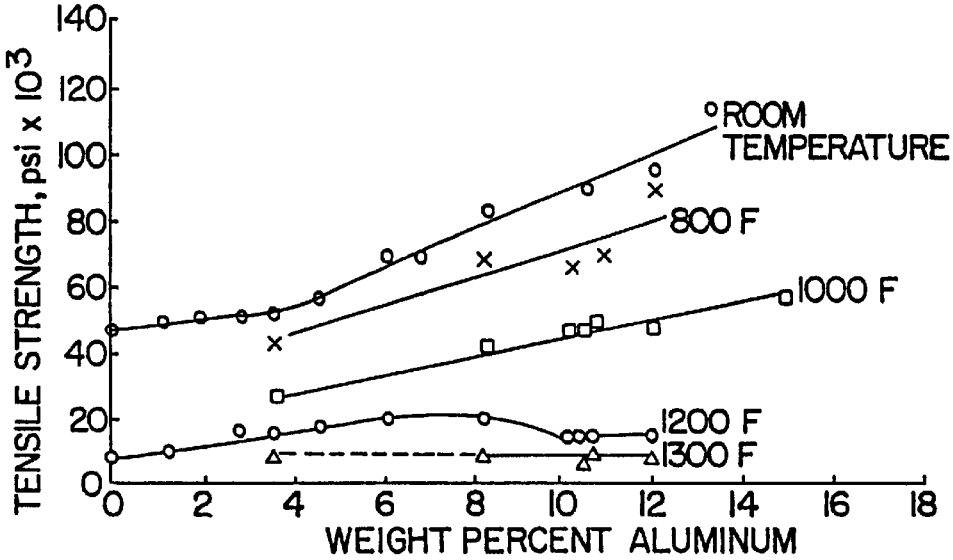
FIG. 2 shows the effect of changes in Al content on room temperature and high-temperature properties of an aluminum containing iron-base alloy.
Figure 2B:
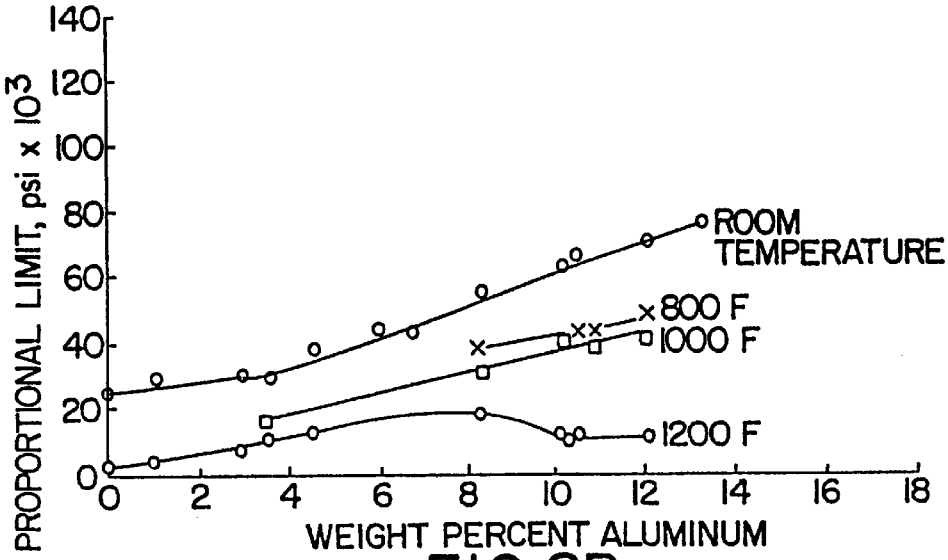

FIG. 2 shows the effect of changes in Al content on high-temperature properties of an aluminum containing iron-base alloy. In particular, FIG. 2 shows tensile strength and proportional limit values at room temperature, 800° F., 1000° F., 1200° F. and 1350° F. for iron-base alloys containing up to 18 wt % Al.

Figure 3A:
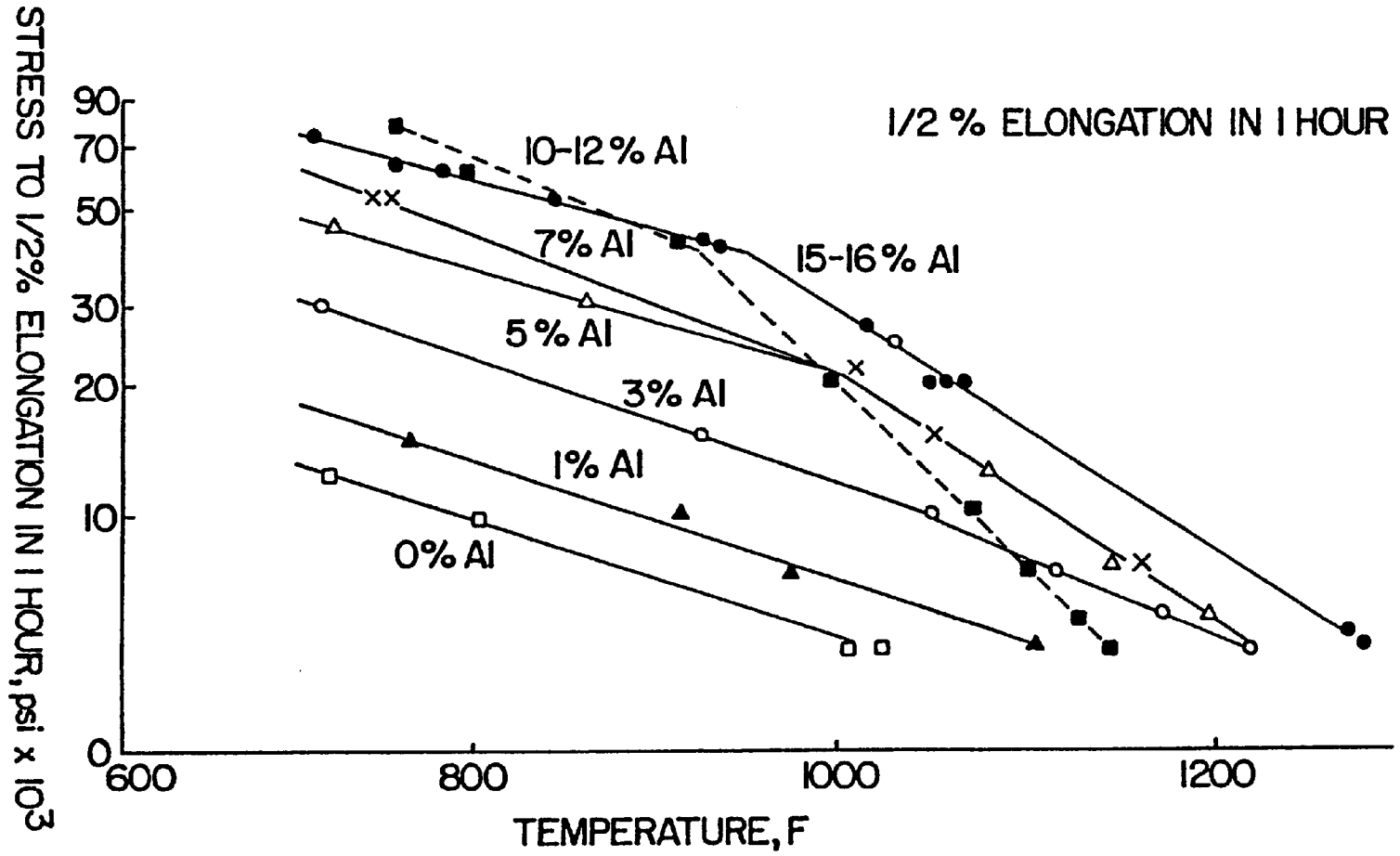
FIG. 3 shows the effect of changes in Al content on high temperature stress to elongation of an aluminum containing iron-base alloy.
Figure 3B:
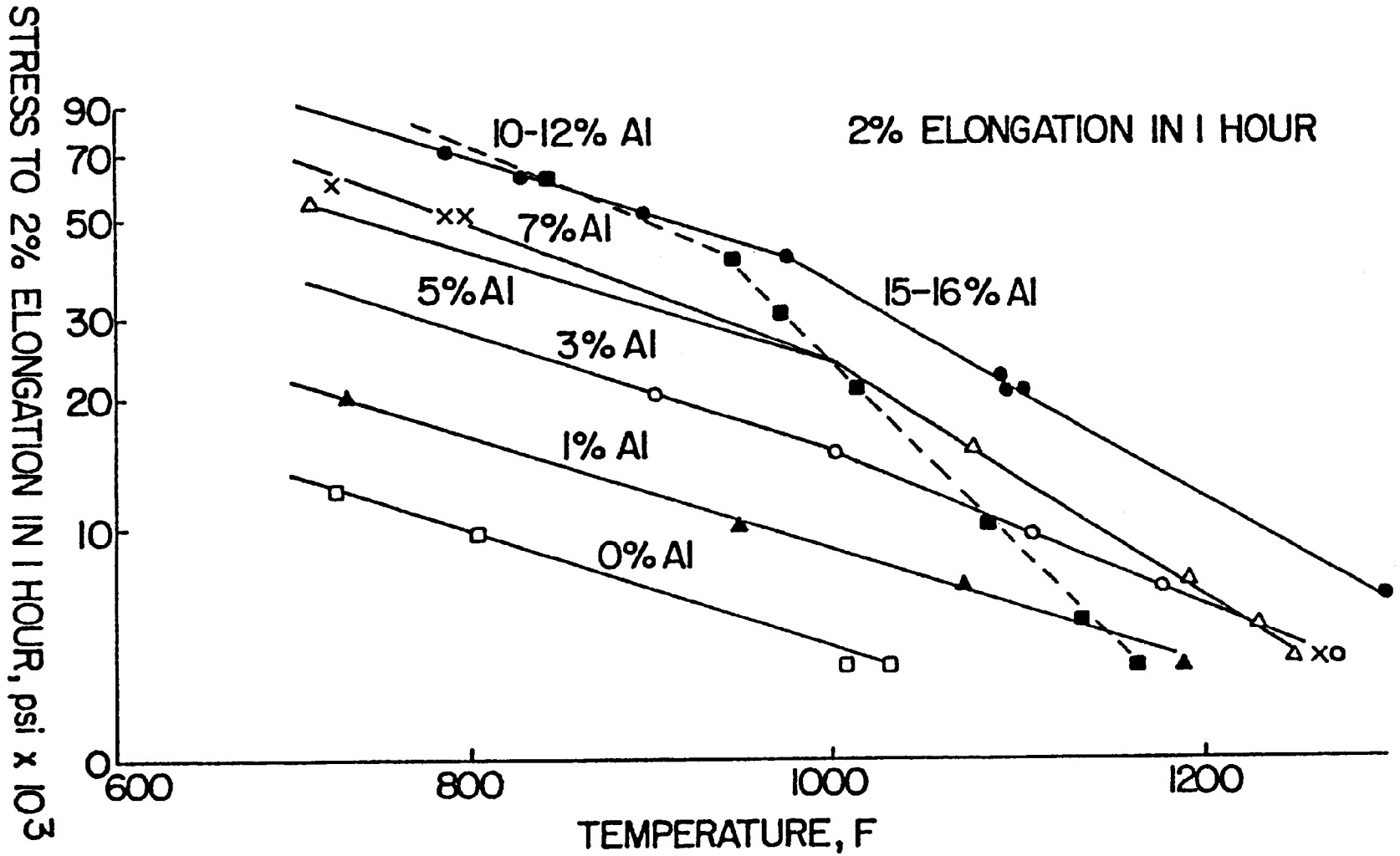

FIG. 3 shows the effect of changes in Al content on high temperature stress to elongation of an aluminum containing iron-base alloy. In particular, FIG. 3 shows stress to ½% elongation and stress to 2% elongation in 1 hour for iron-base alloys containing up to 15–16 wt % Al.

Figure 4A:
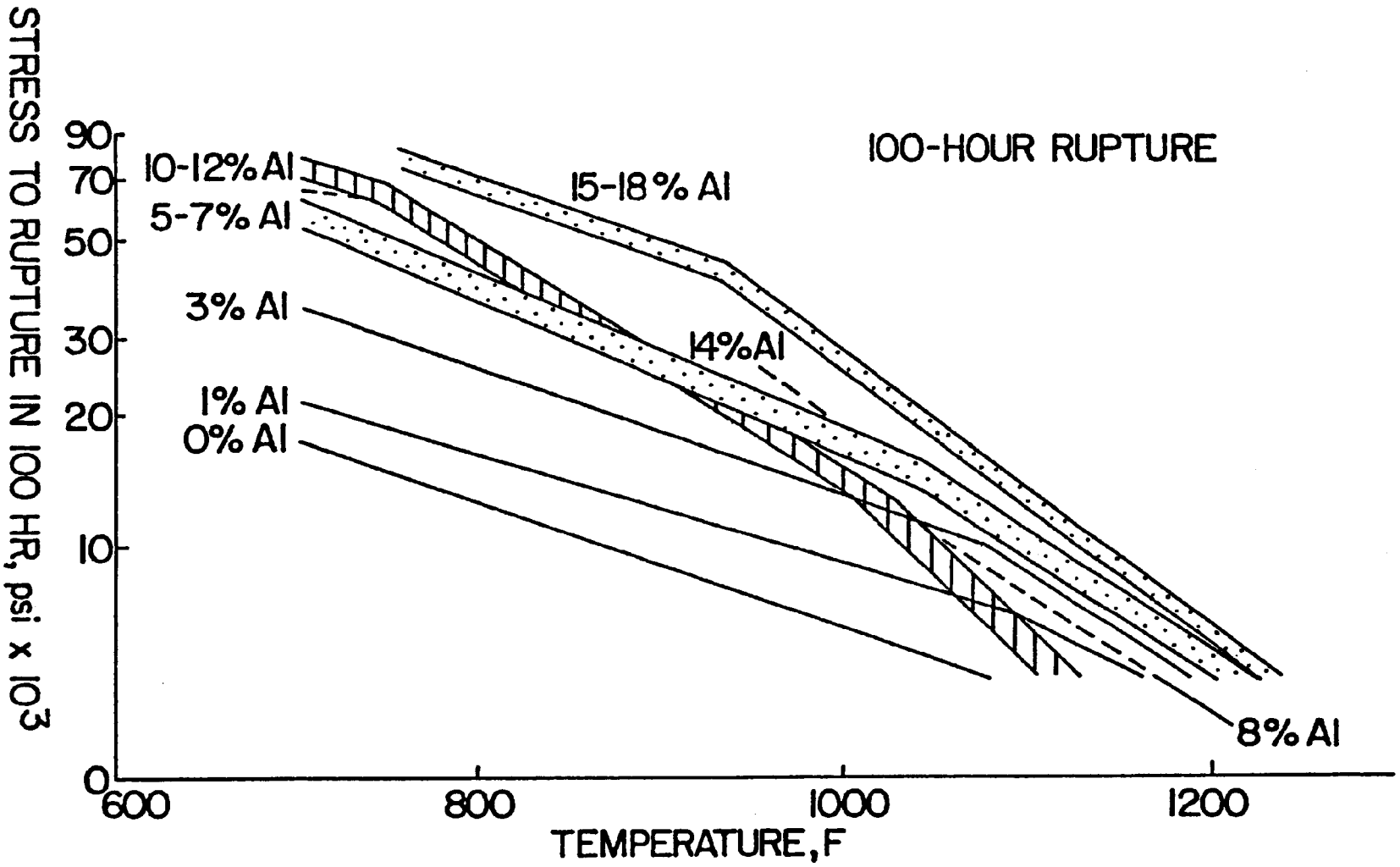
FIG. 4 shows the effect of changes in Al content on stress to rupture (creep) properties of an aluminum containing iron-base alloy.
Figure 4B:
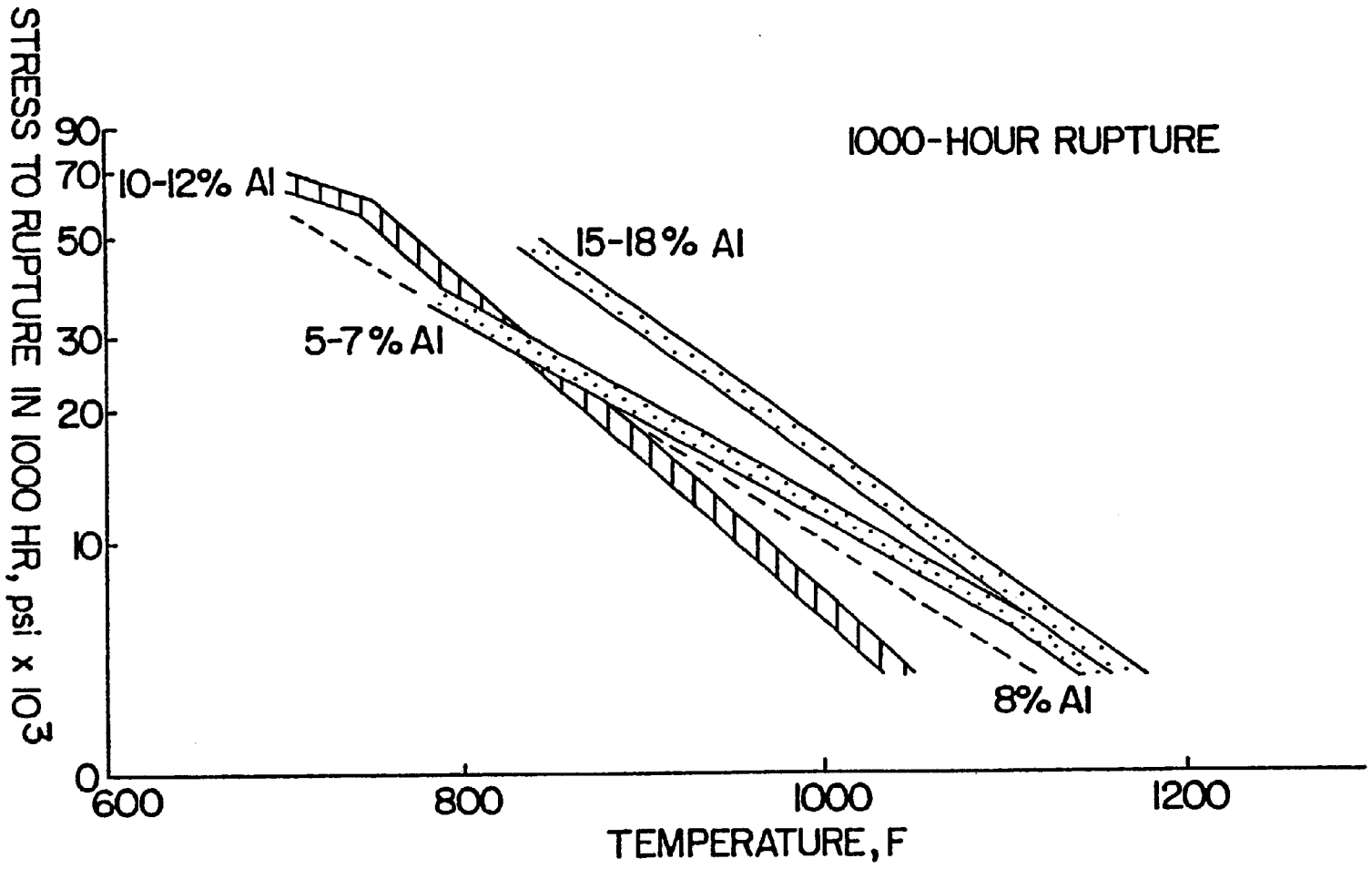

FIG. 4 shows the effect of changes in Al content on creep properties of an aluminum containing iron-base alloy. In particular, FIG. 4 shows stress to rupture in 100 hour and 1000 hour for iron-base alloys containing up to 15–18 wt % Al.

Figure 5A:
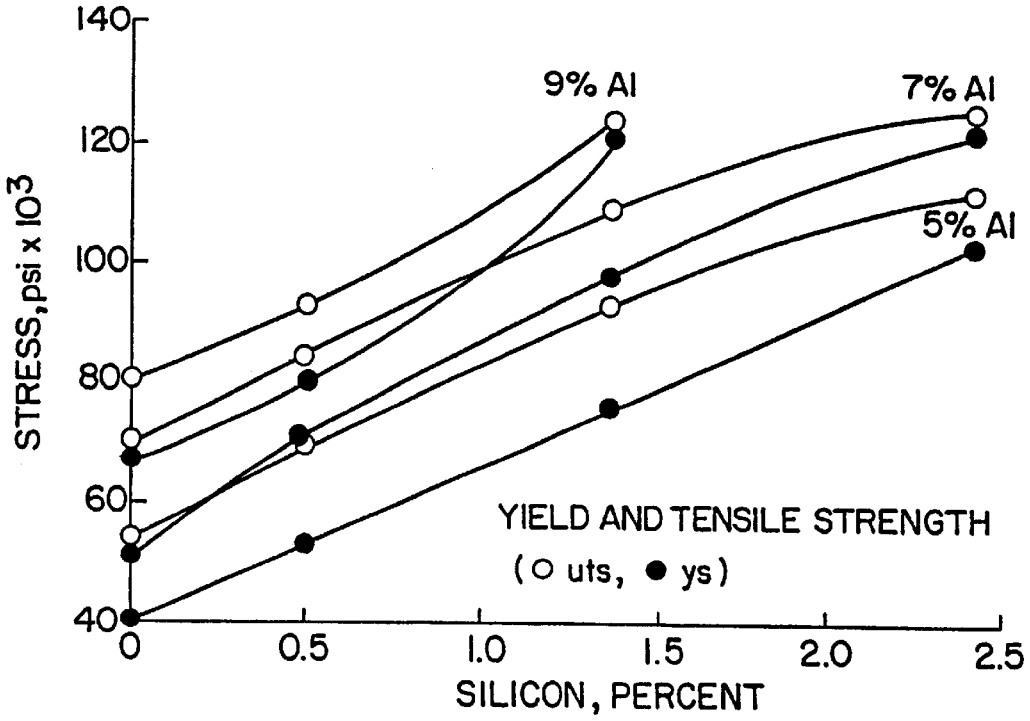
FIG. 5 shows the effect of changes in Si content on room-temperature tensile properties of an Al and Si containing iron-base alloy.
Figure 5B:
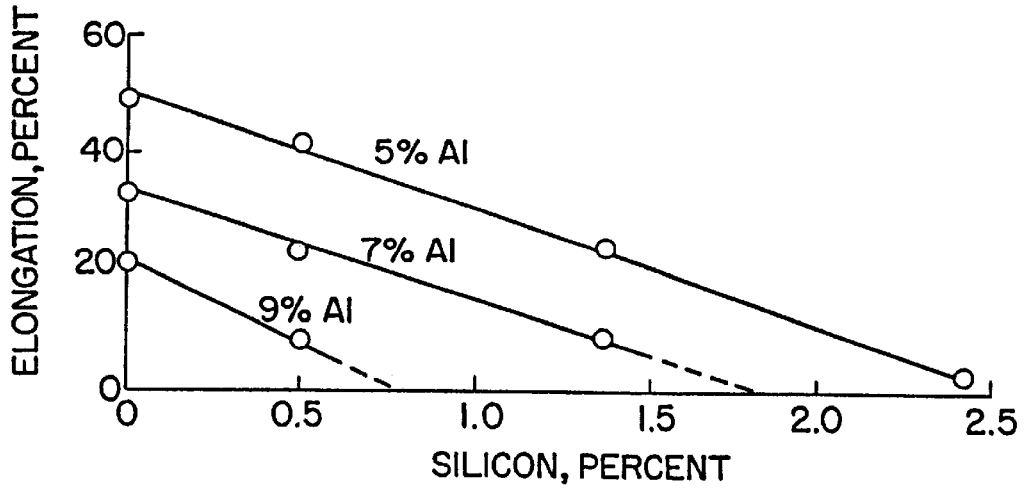

FIG. 5 shows the effect of changes in Si content on room temperature tensile properties of an Al and Si containing iron-base alloy. In particular, FIG. 5 shows yield strength, tensile strength and elongation values for iron-base alloys containing 5.7 or 9 wt % Al and up to 2.5 wt % Si.

Figure 6A:
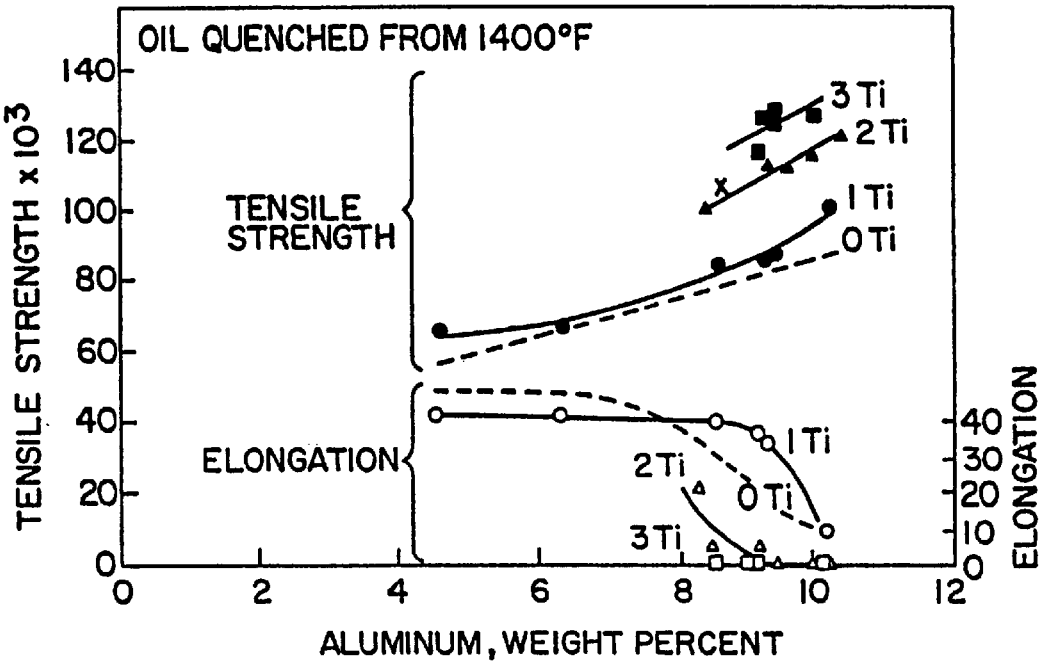
FIG. 6 shows the effect of changes in Ti content on room-temperature properties of an Al and Ti containing iron-base alloy.
Figure 6B:
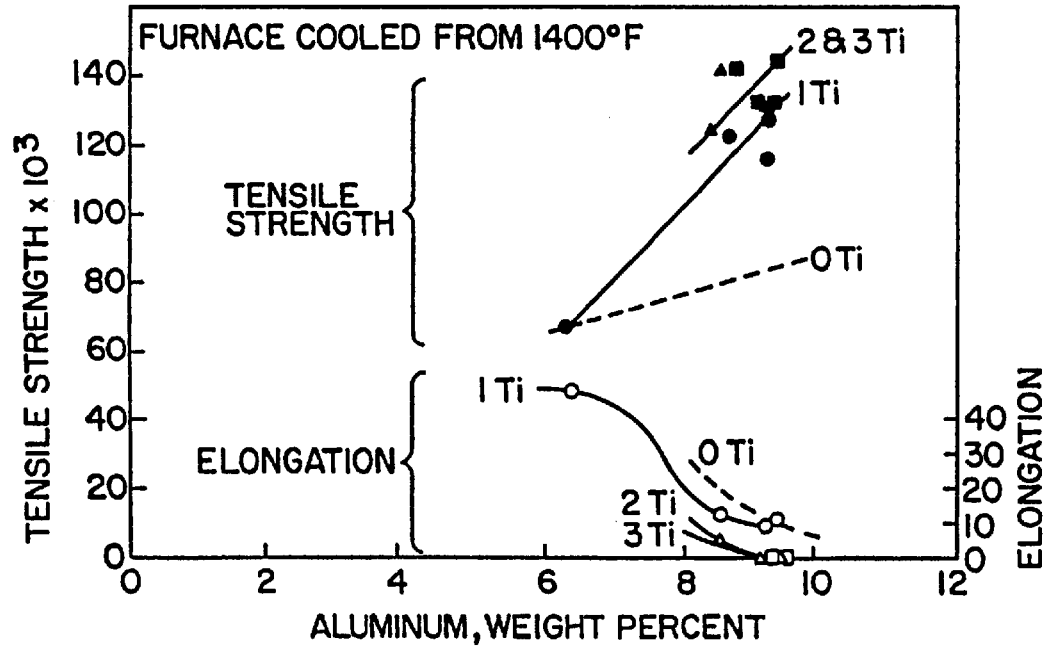

FIG. 6 shows the effect of changes in Ti content on room temperature properties of an Al and Ti containing iron-base alloy. In particular, FIG. 6 shows tensile strength and elongation values for iron-base alloys containing up to 12 wt % Al and up to 3 wt % Ti.

Figure 7:
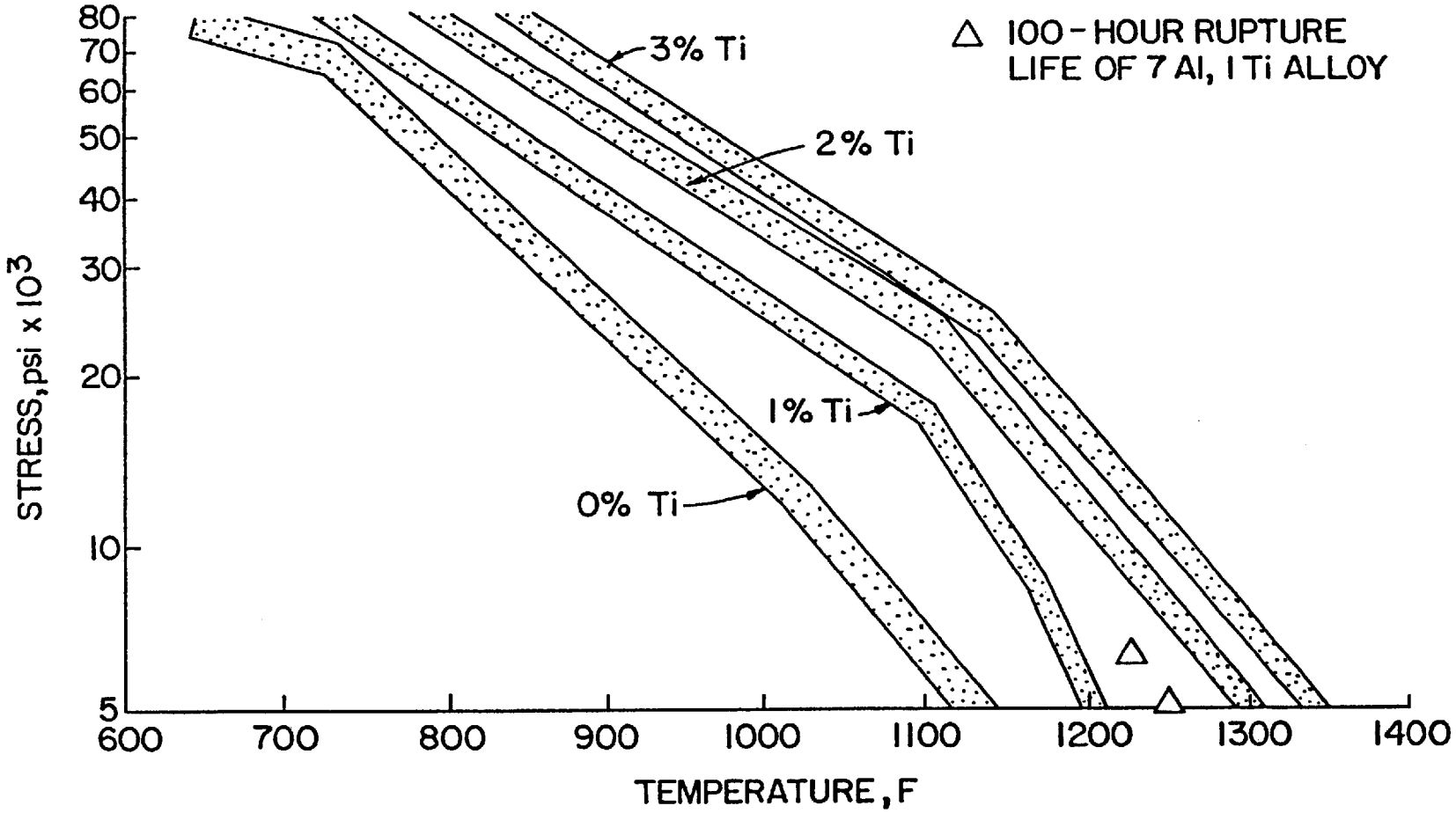
FIG. 7 shows the effect of changes in Ti content on creep rupture properties of a Ti containing iron-base alloy.
Figure 8A:
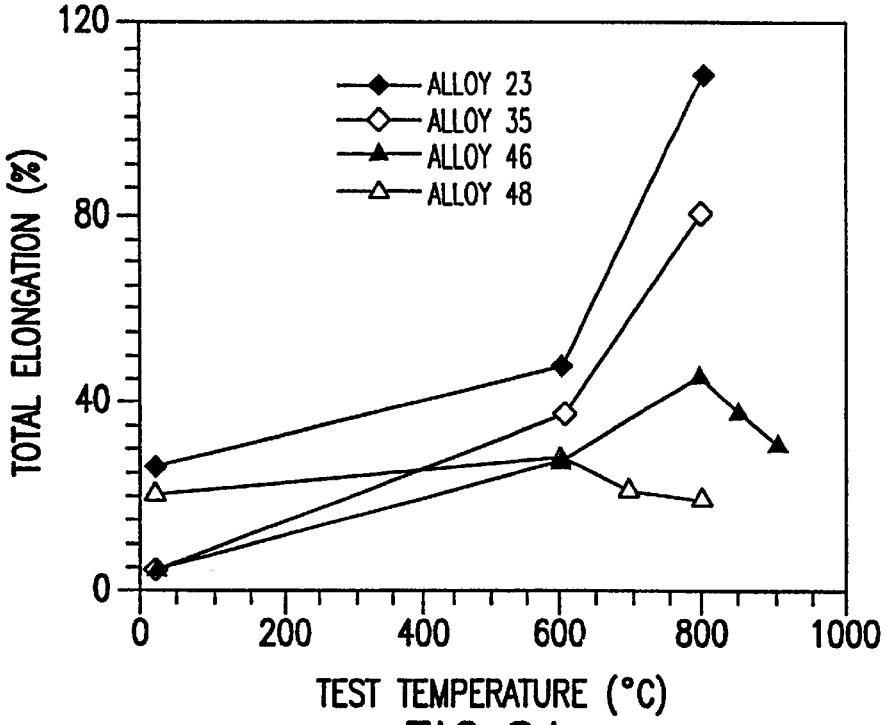
FIGS. 8*a–c* show yield strength, ultimate tensile strength and total elongation for alloy numbers 23, 35, 46 and 48.
Figure 8B:
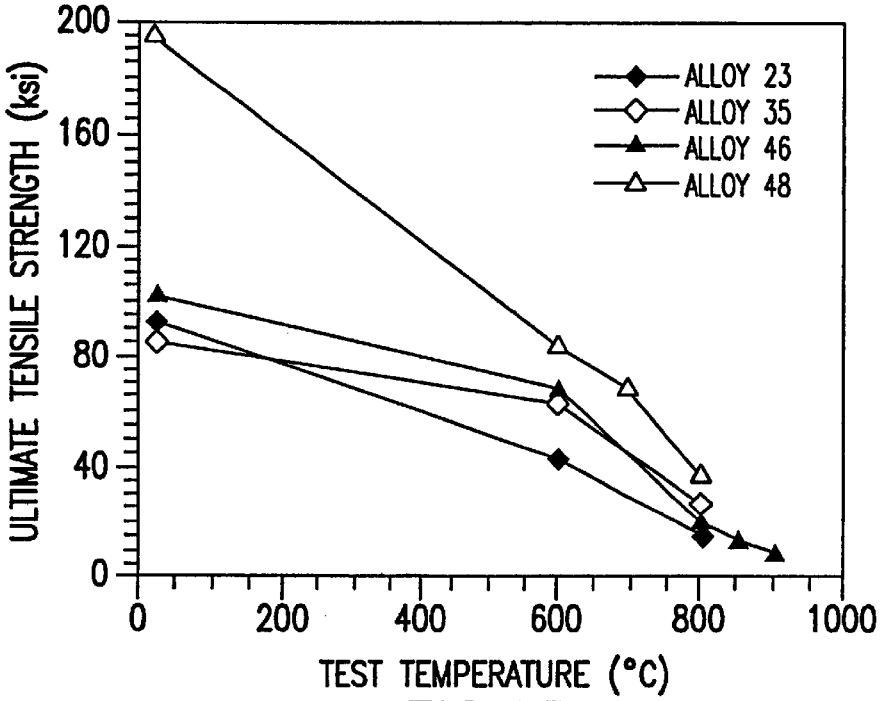
Figure 8C:
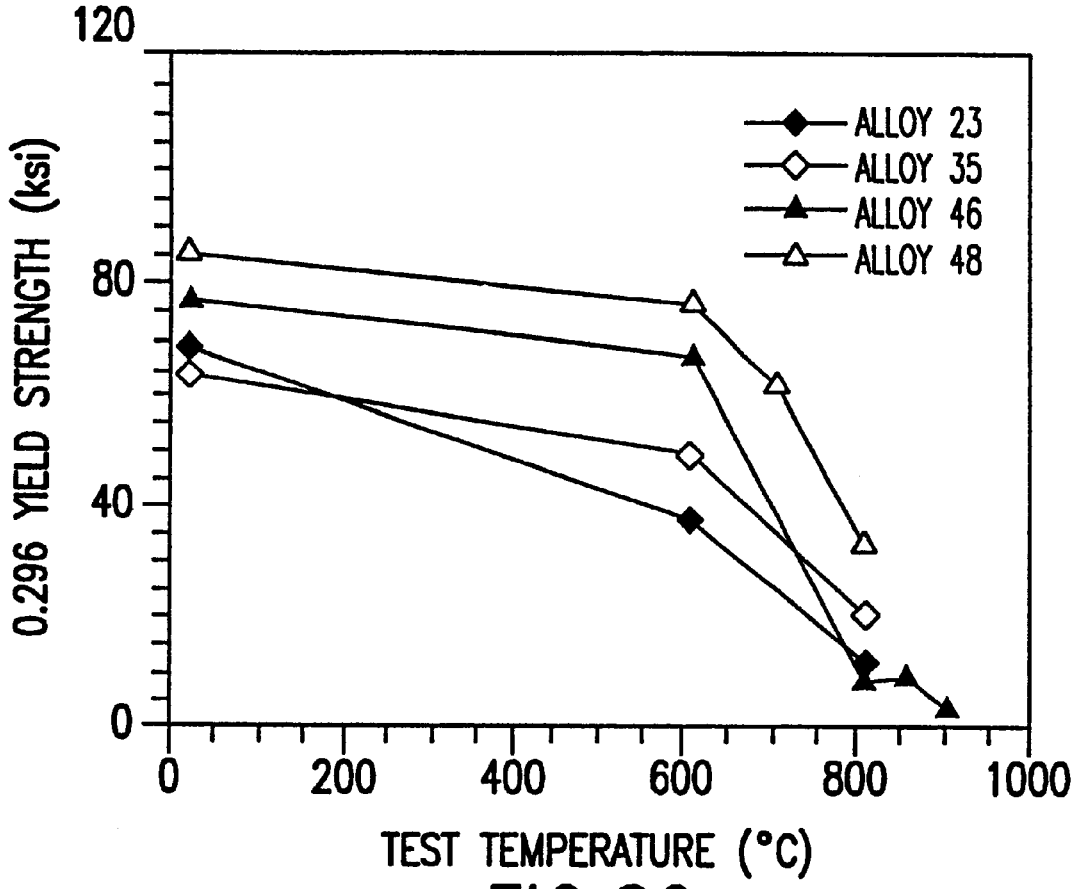
Figure 9A:
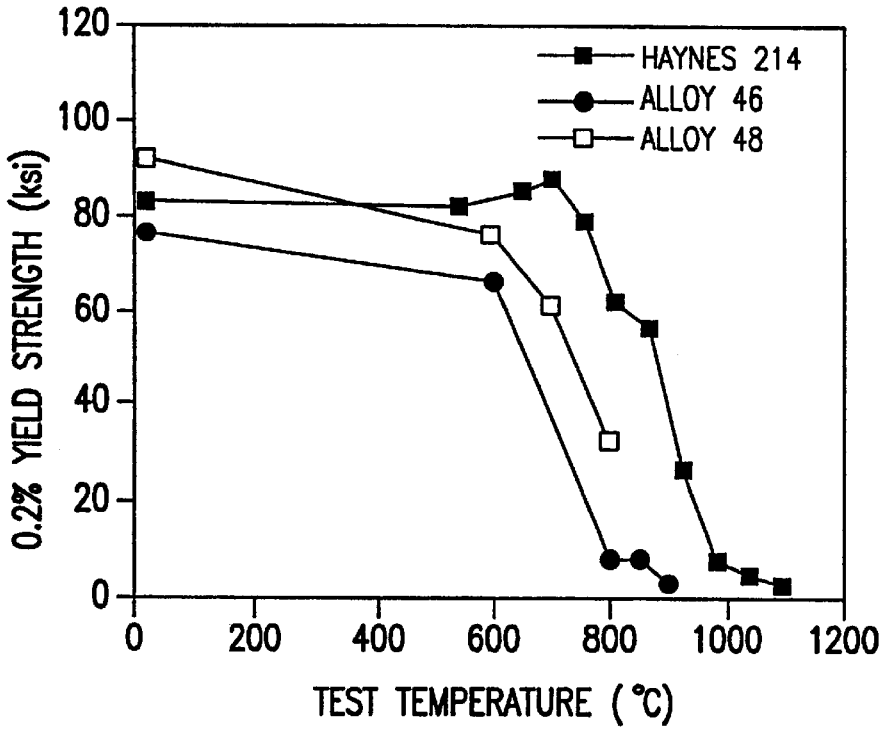
FIGS. 9*a–c* show yield strength, ultimate tensile strength and total elongation for commercial alloy Haynes 214 and alloys 46 and 48.
Figure 9B:
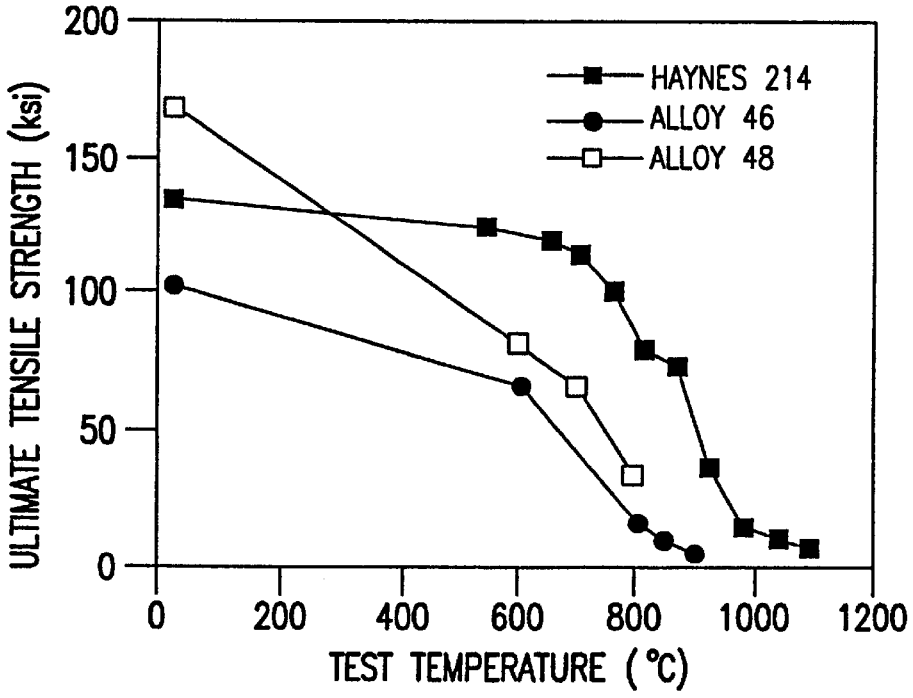
Figure 9C:
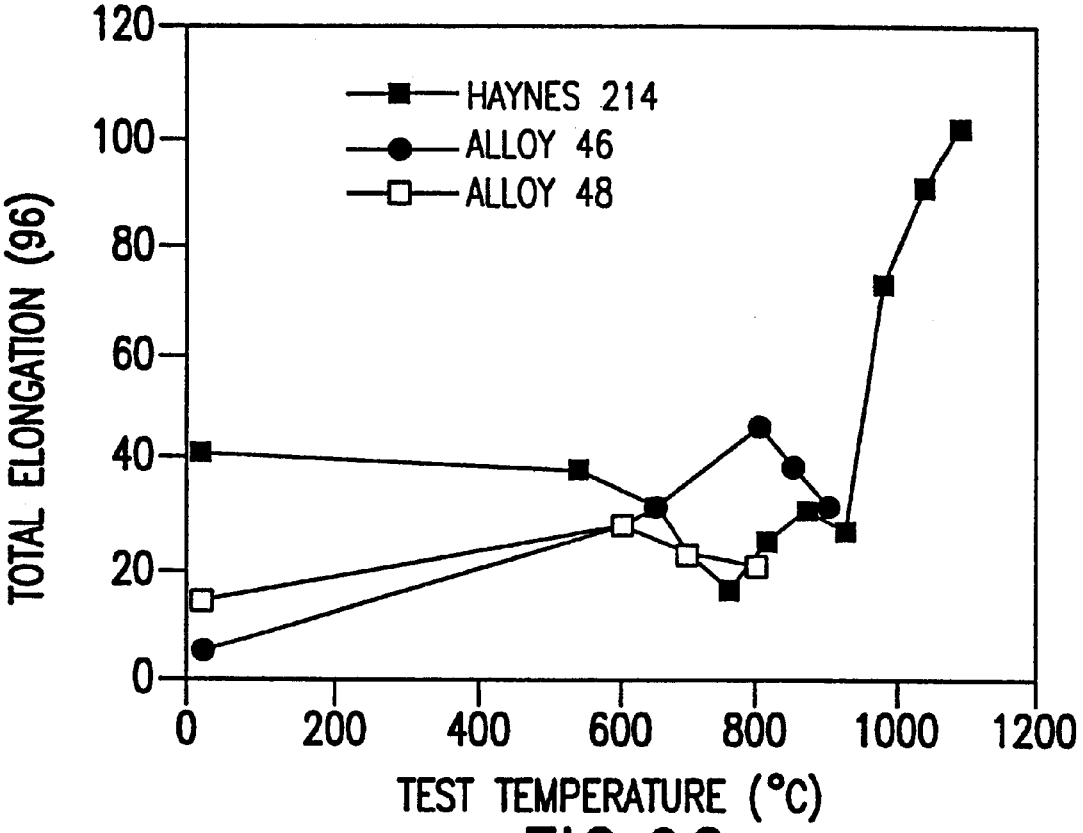
Figure 10A:
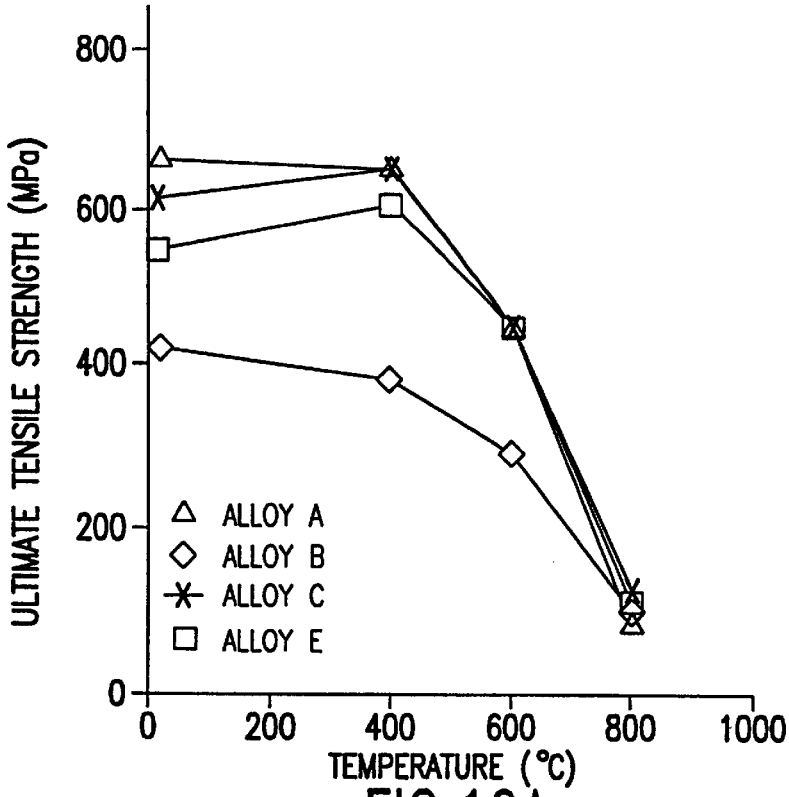
FIGS. 10*a–b* show ultimate tensile strength at tensile strain rates of $3\times10^{-4}$/s and $3\times10^{-2}$/s, respectively.
Figure 10B:
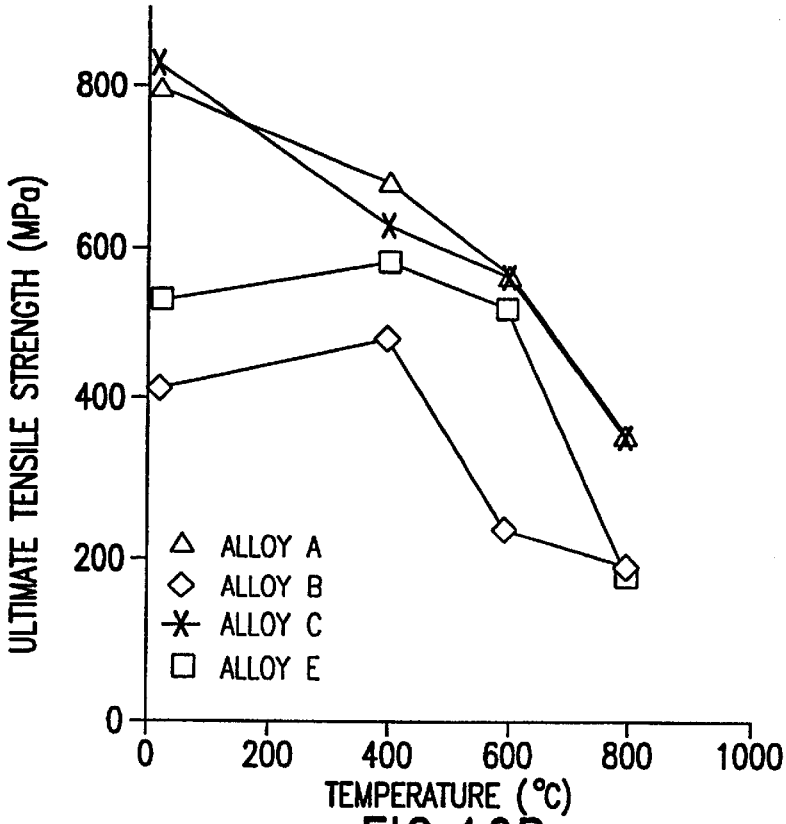
Figure 10C:
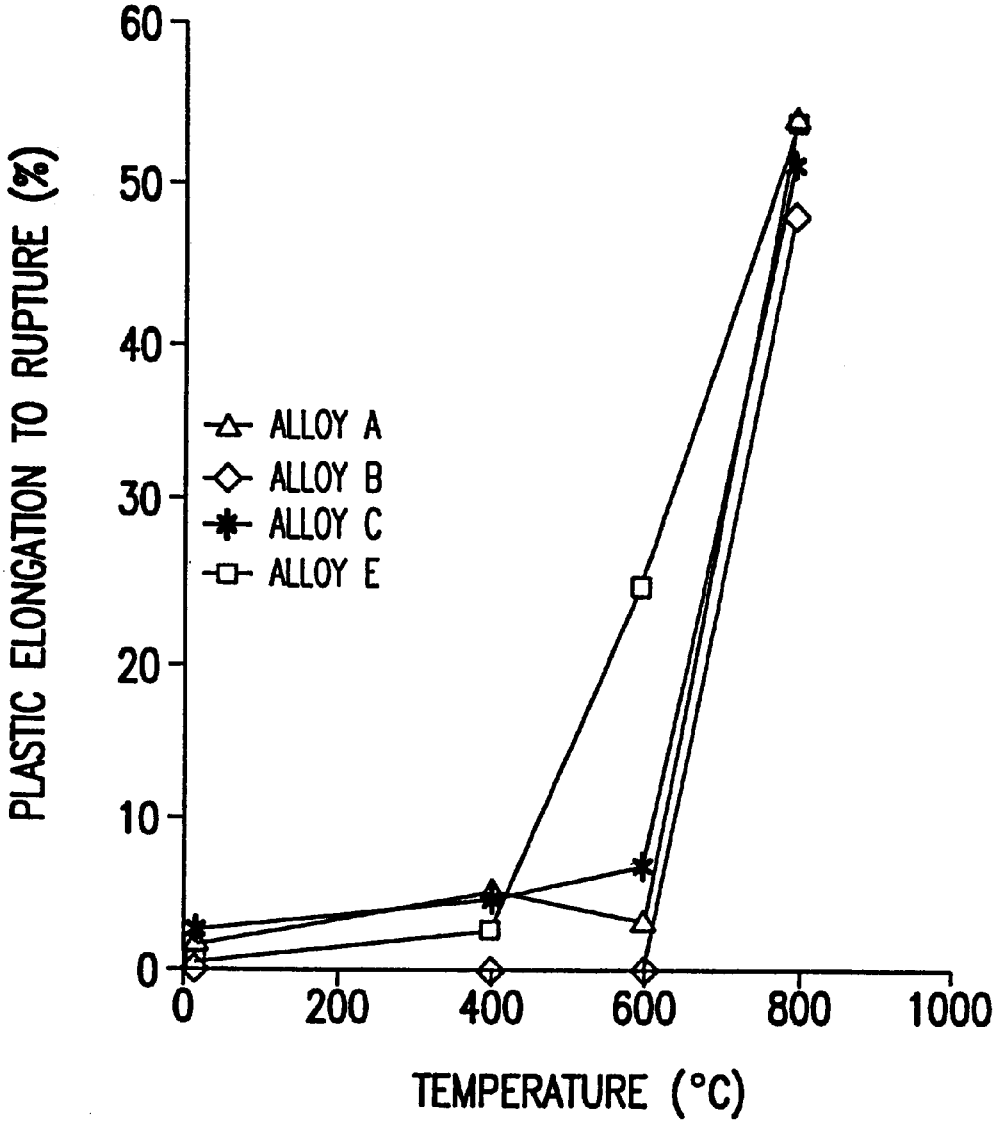
FIGS. 10*c–d* show plastic elongation to rupture at strain rates of $3\times10^{-4}$/s and $3\times10^{-2}$/s, respectively, for alloys 57, 58, 60 and 61.
Figure 10D:
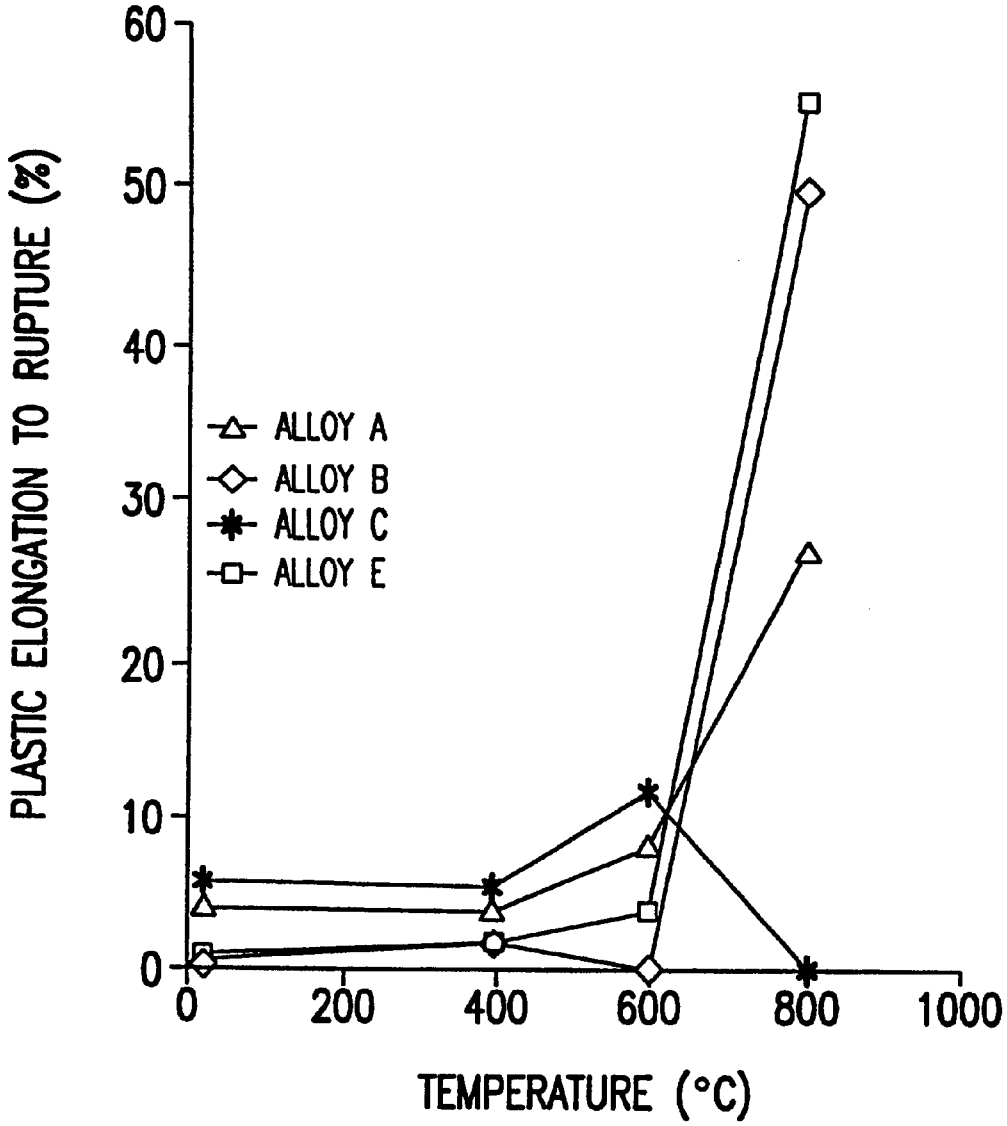
Figure 11A:
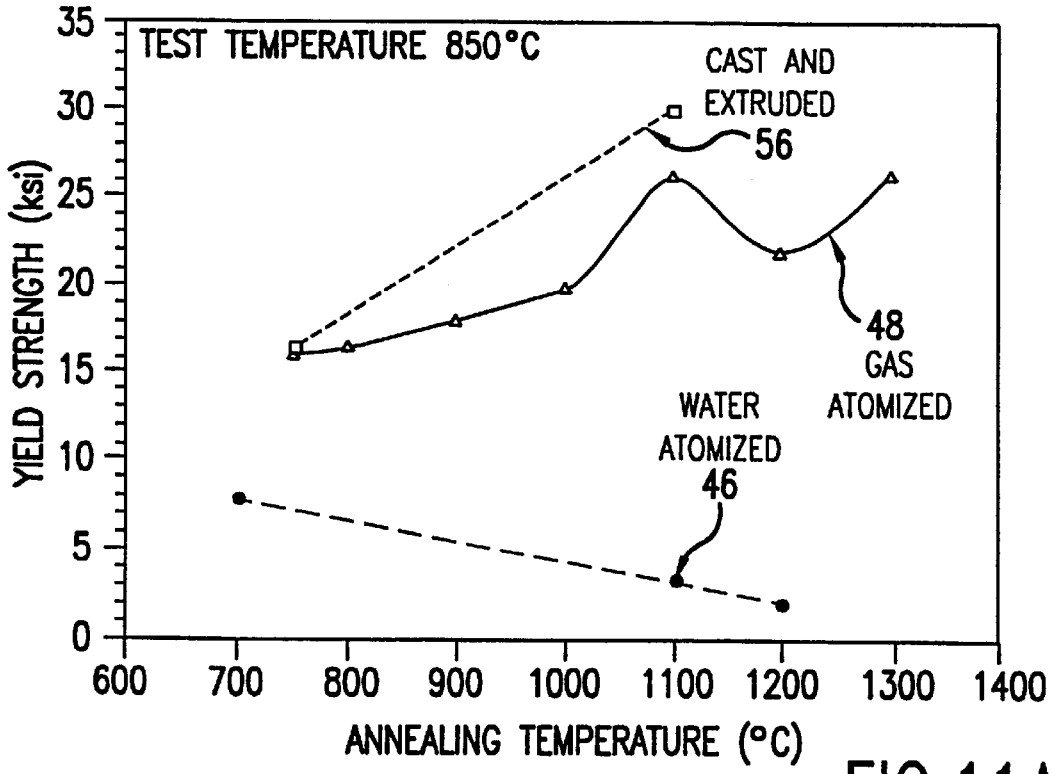
FIGS. 11*a–b* show yield strength and ultimate tensile strength, respectively, at 850° C. for alloys 46, 48 and 56, as a function of annealing temperatures.
Figure 11B:
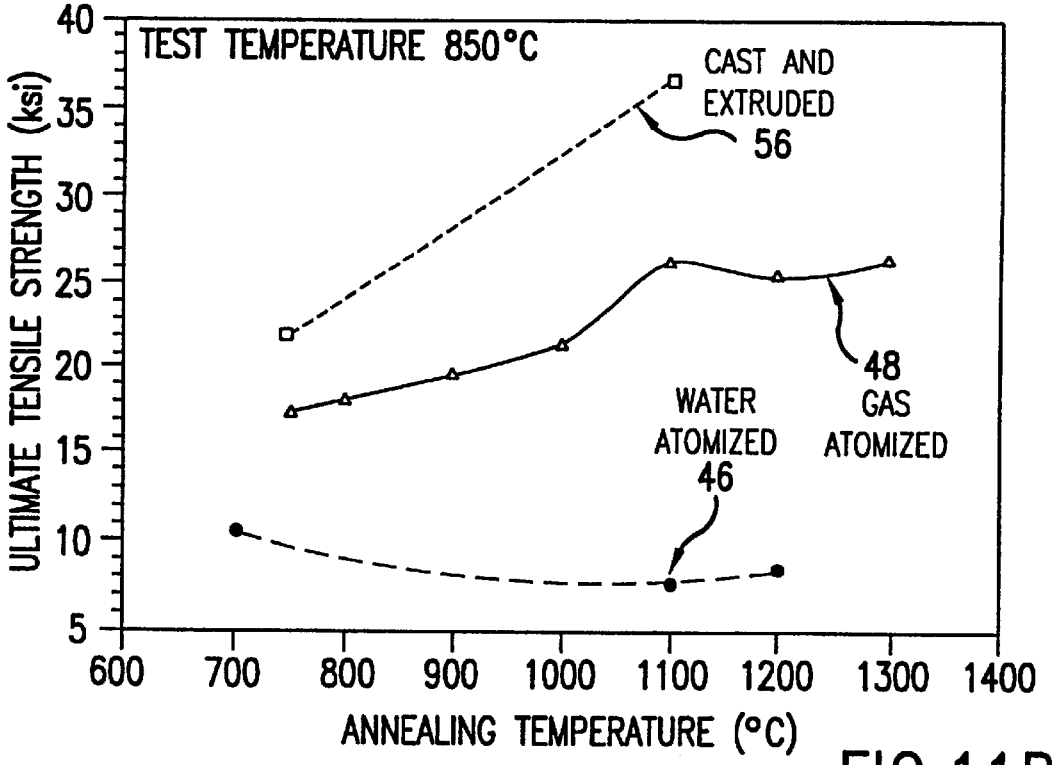
Figure 12A:
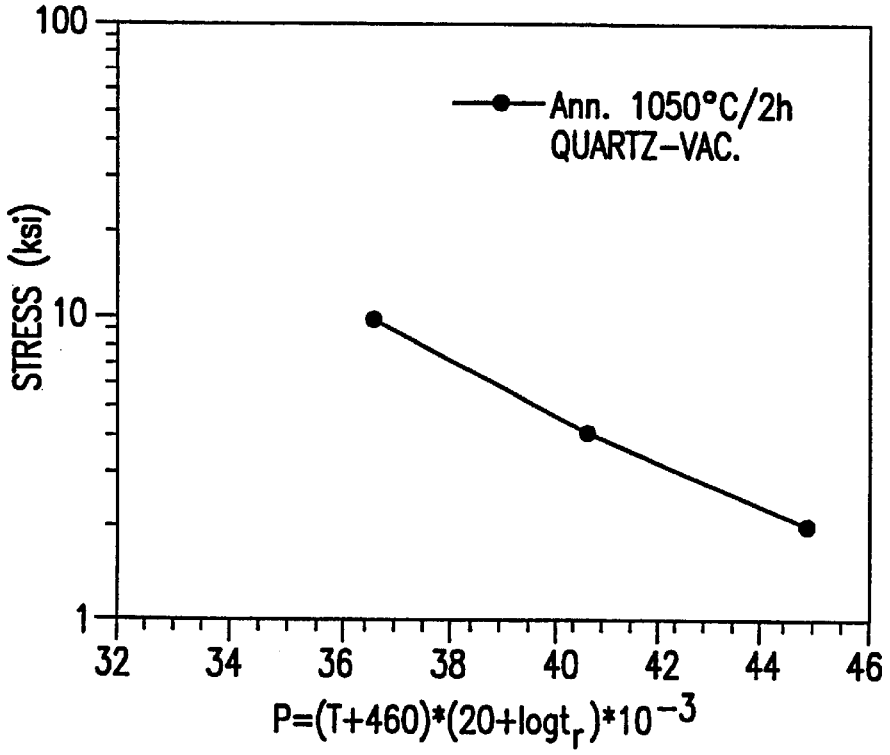
Figure 12B:
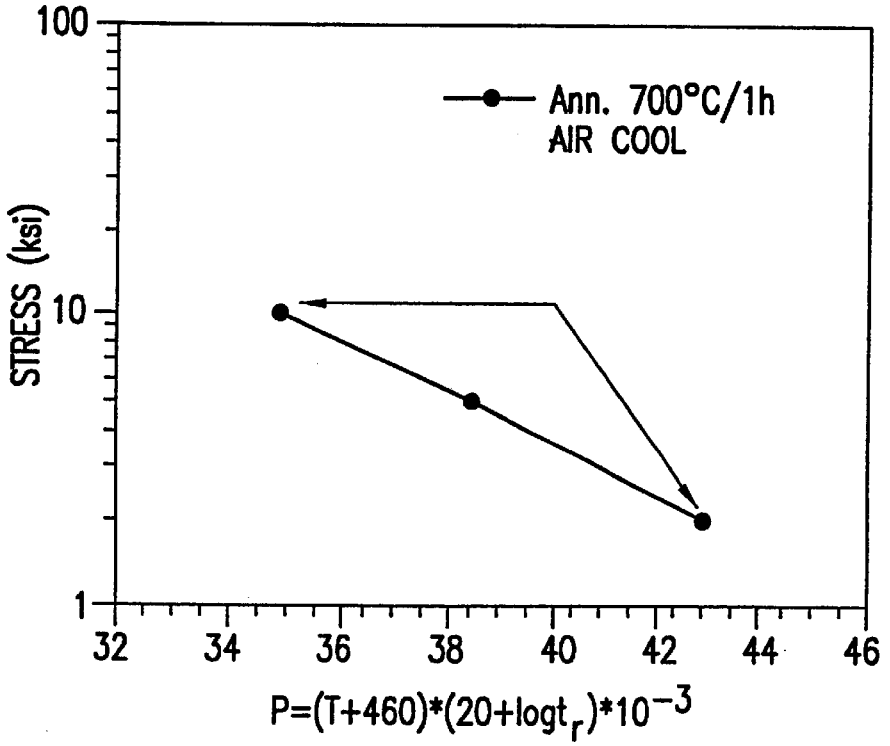
Figure 12C:
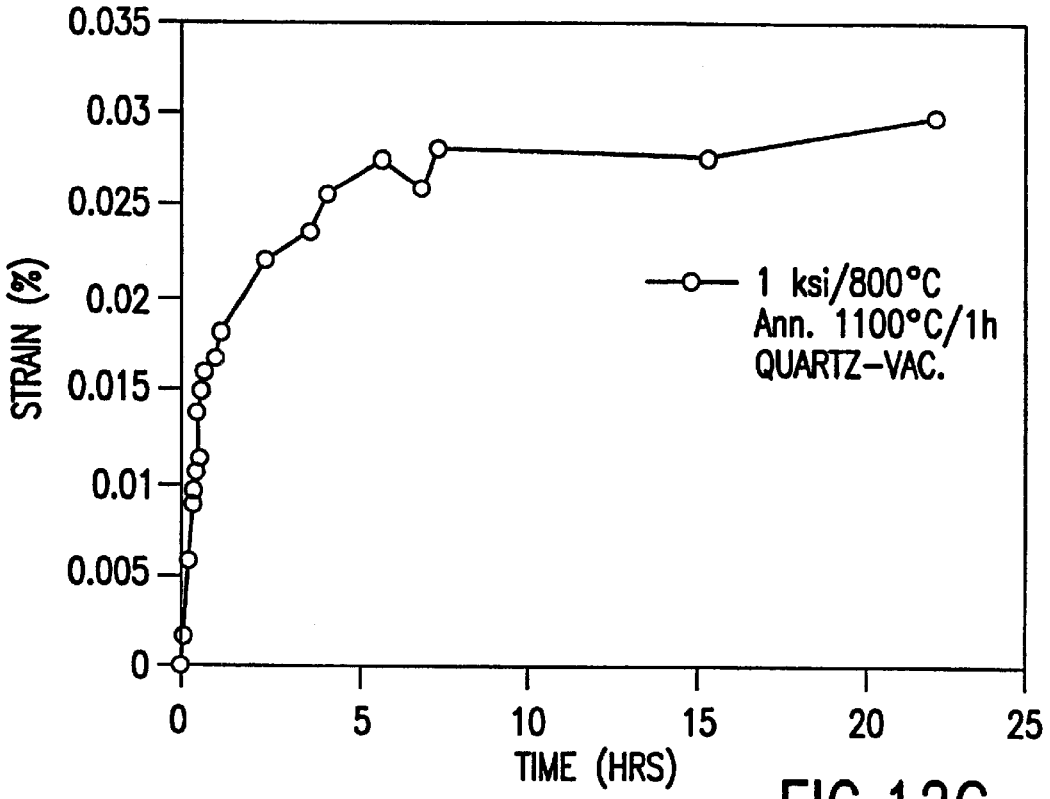
Figure 12D:
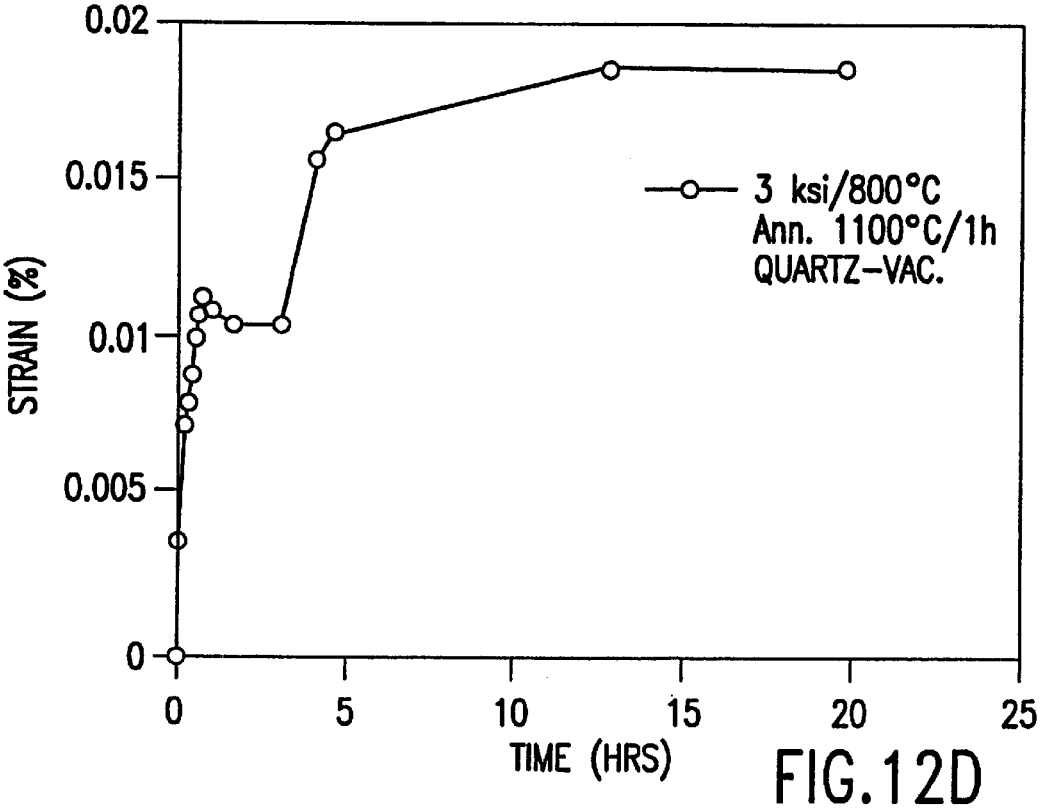
Figure 12E:
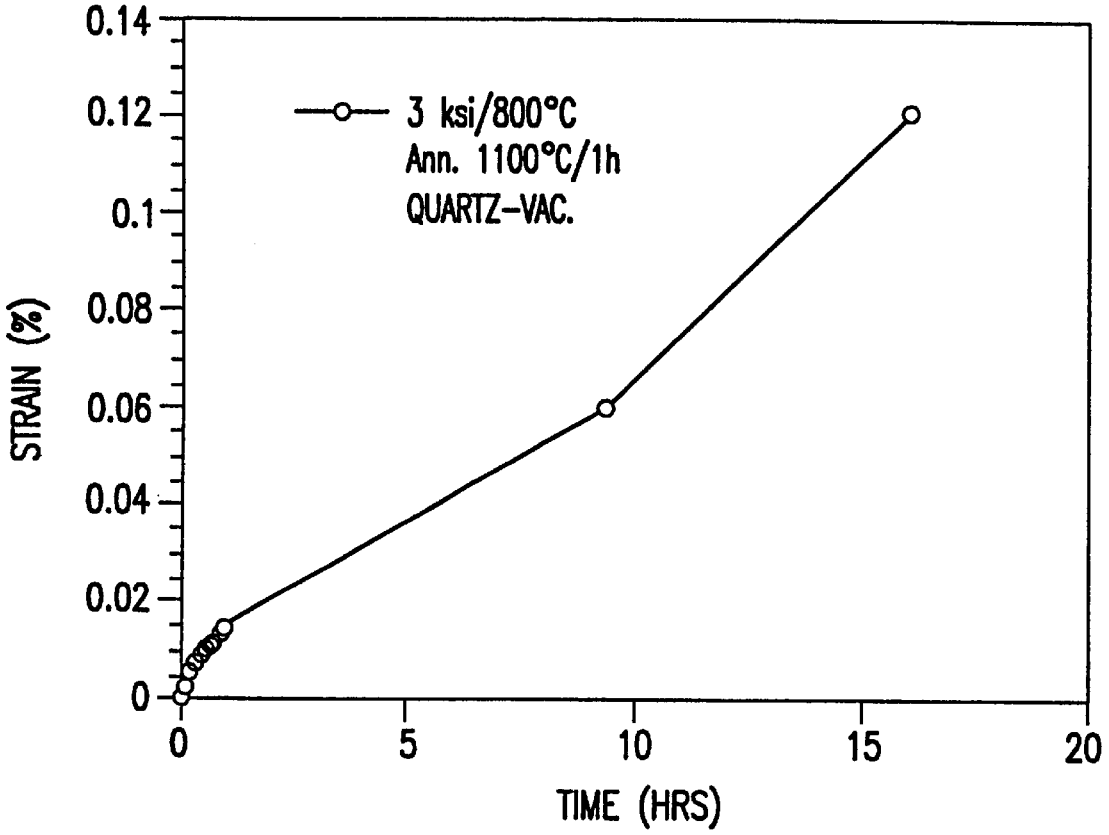

FIG. 7 shows the effect of changes in Ti content on creep rupture properties of a Ti containing iron-base alloy. In particular, FIG. 7 shows stress to rupture values for iron-base alloys containing up to 3 wt % Ti at temperatures of 700 to 1350° F.

FIGS. 8–16 shows graphs of properties of alloys in Tables 1a and 1b. FIGS. 8*a–c* show yield strength, ultimate tensile strength and total elongation for alloy numbers 23, 35, 46 and 48. FIGS. 9*a–c* show yield strength, ultimate tensile strength and total elongation for alloys 46 and 48 compared to commercial alloy Haynes 214. FIGS. 10*a–b* show ultimate tensile strength at tensile strain rates of $3\times10^{-4}$/s and $3\times10^{-2}$/s, respectively; and FIGS. 10*c–d* show plastic elongation to rupture at strain rates of $3\times10^{-4}$/s and $3\times10^{-2}$/s, respectively, for alloys 57, 58, 60 and 61. FIGS. 11*a–b* show yield strength and ultimate tensile strength, respectively, at 850° C. for alloys 46, 48 and 56, as a function of annealing temperatures. FIGS. 12*a–e* show creep data for alloys 35, 46, 48 and 56. FIG. 12*a* shows creep data for alloy 35 after annealing at 1050° C. for two hours in vacuum. FIG. 12*b* shows creep data for alloy 46 after annealing at 700° C. for one hour and air cooling. FIG. 12*c* shows creep data for alloy 48 after annealing at 1100° C. for one hour in vacuum and wherein the test is carried out at 1 ksi at 800° C. FIG. 12*d* shows the sample of FIG. 12*c* tested at 3 ksi and 800° C. and FIG. 12*e* shows alloy 56 after annealing at 1100° C. for one hour in vacuum and tested at 3 ksi and 800° C.

Figure 13A:
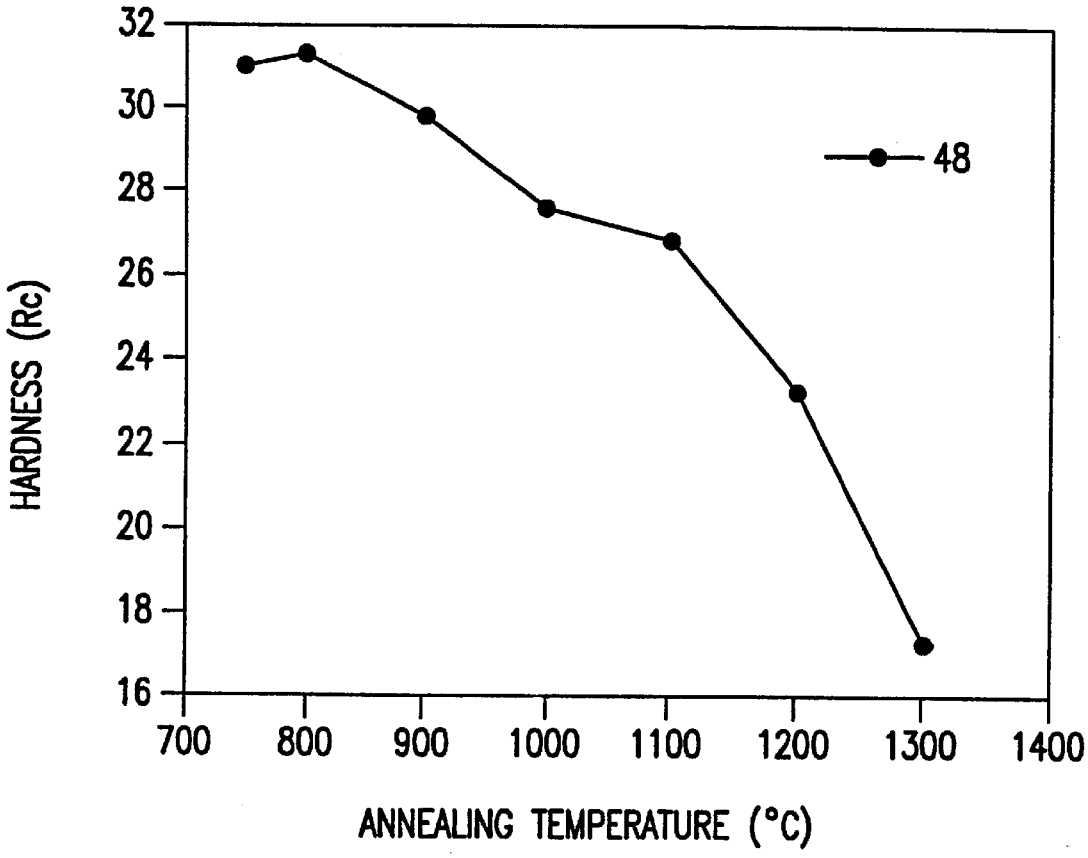
Figure 13B:
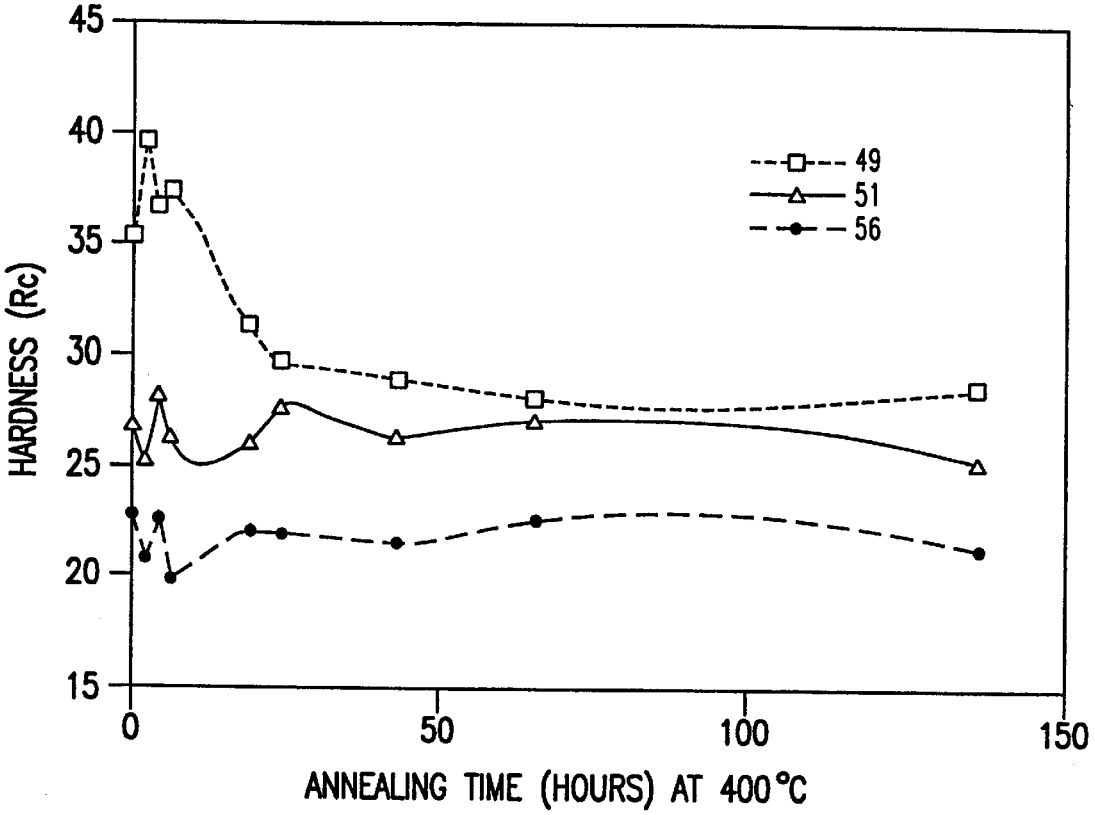
Figure 13C:
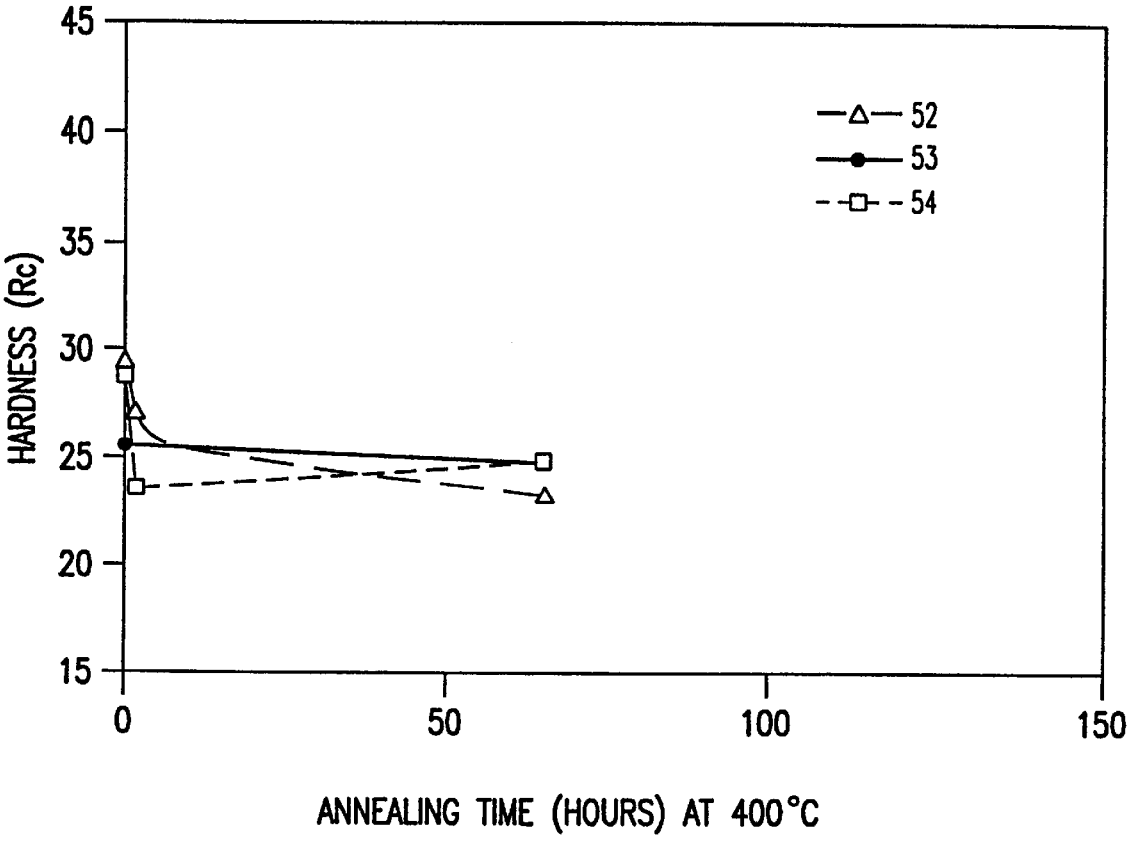

FIGS. 13*a–c* show graphs of hardness (Rockwell C) values for alloys 48, 49, 51, 52, 53, 54 and 56 wherein FIG. 13*a* shows hardness versus annealing for 1 hour at temperatures of 750–1300° C. for alloy 48; FIG. 13*b* shows hardness versus annealing at 400° C. for times of 0–140 hours for alloys 49, 51 and 56; and FIG. 13*c* shows hardness versus annealing at 400° C. for times of 0–80 hours for alloys 52, 53 and 54.

Figure 14A:
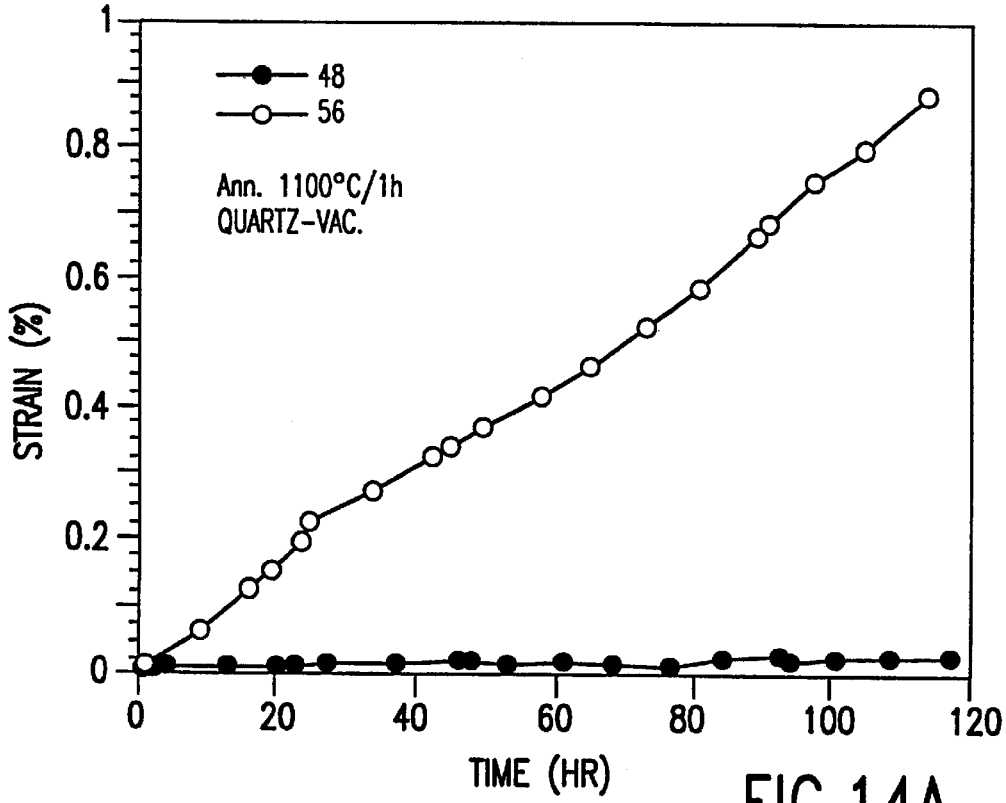
Figure 14B:
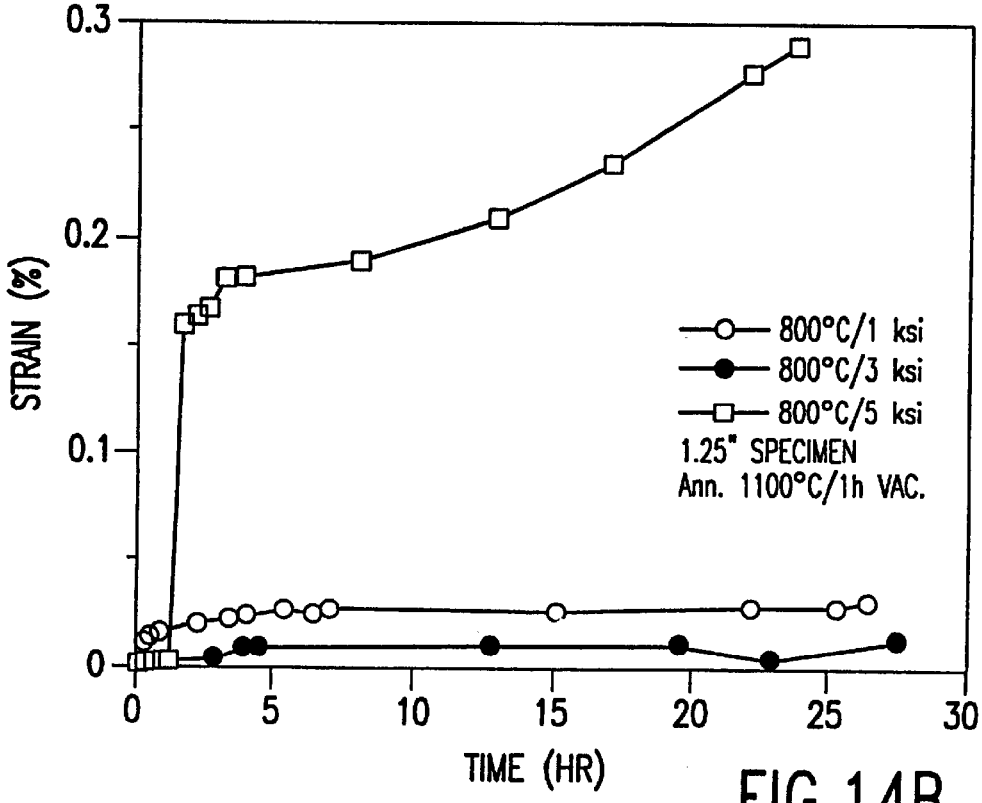
Figure 14C:
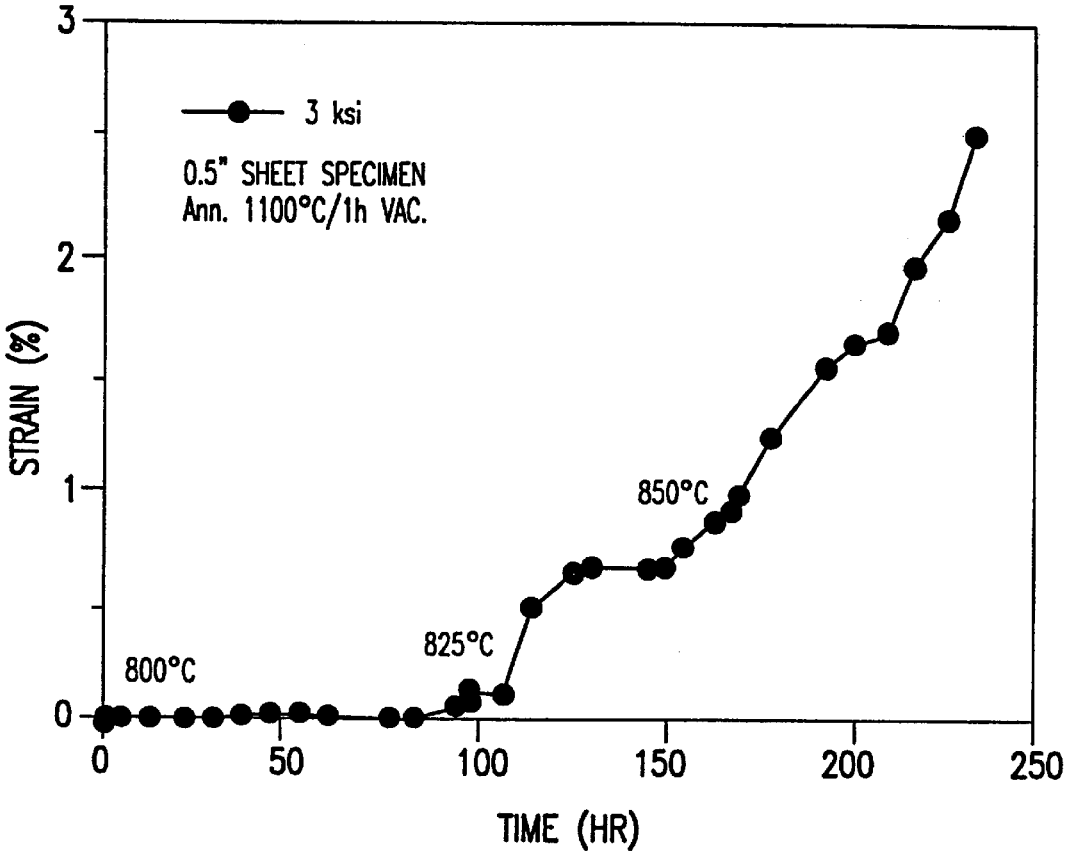
Figure 14D:
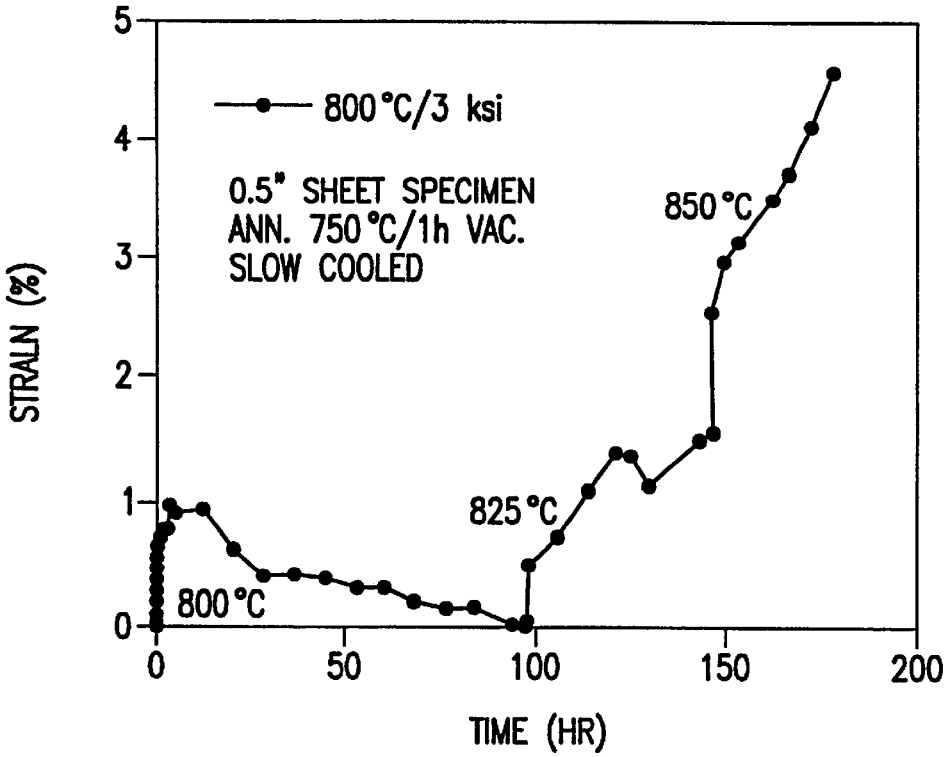
Figure 14E:
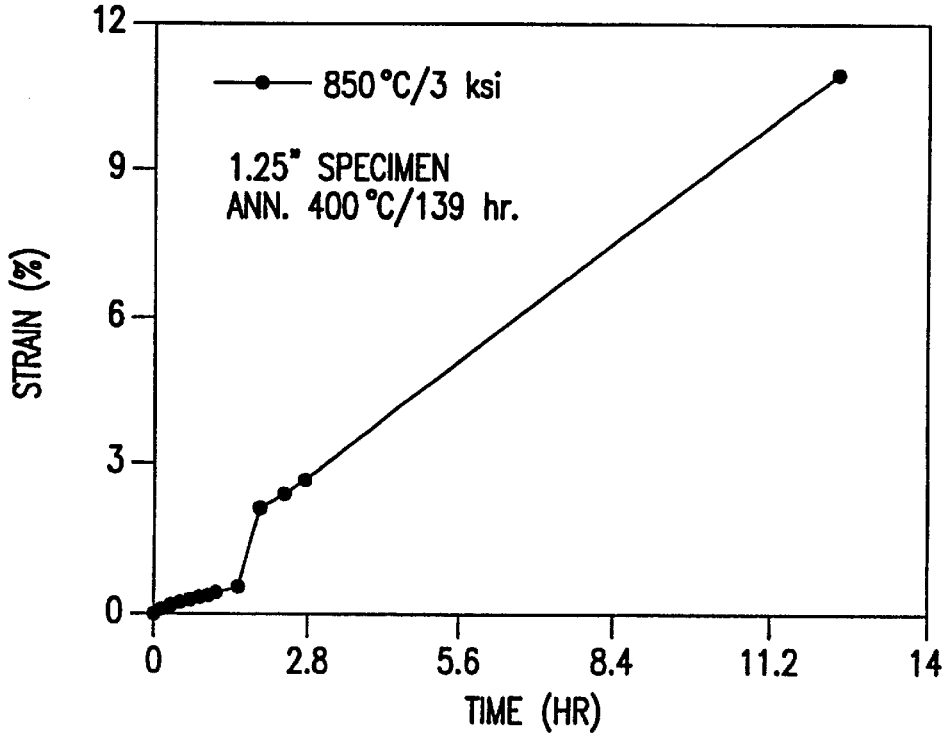
Figure 15A:
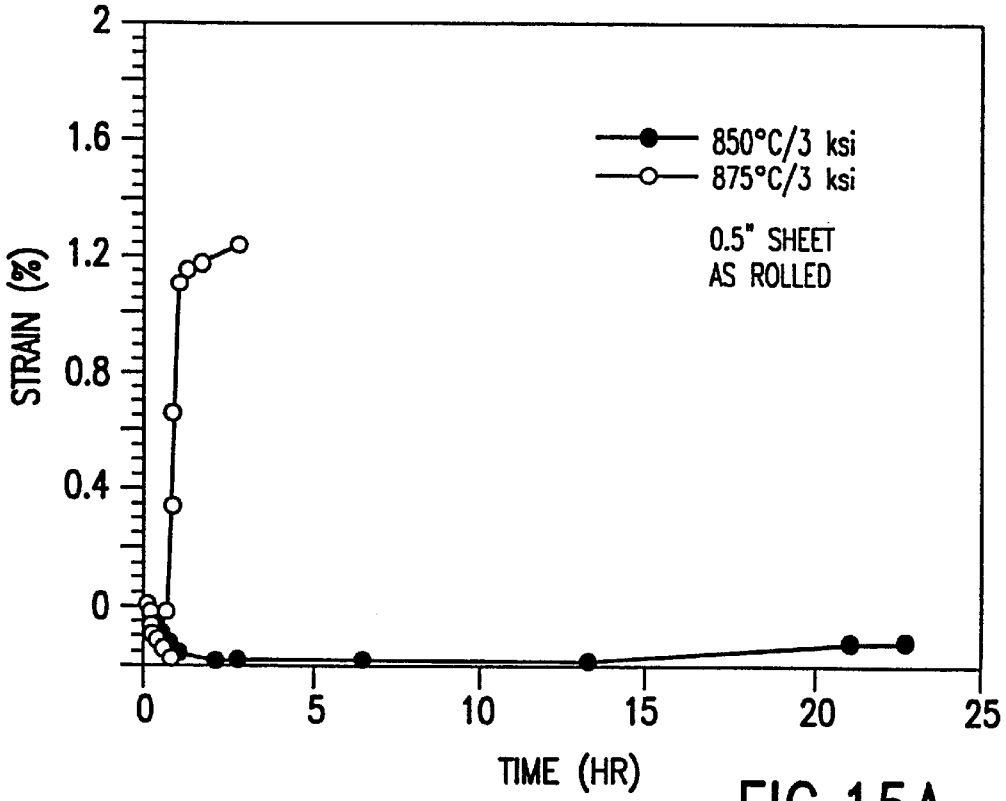
Figure 15B:
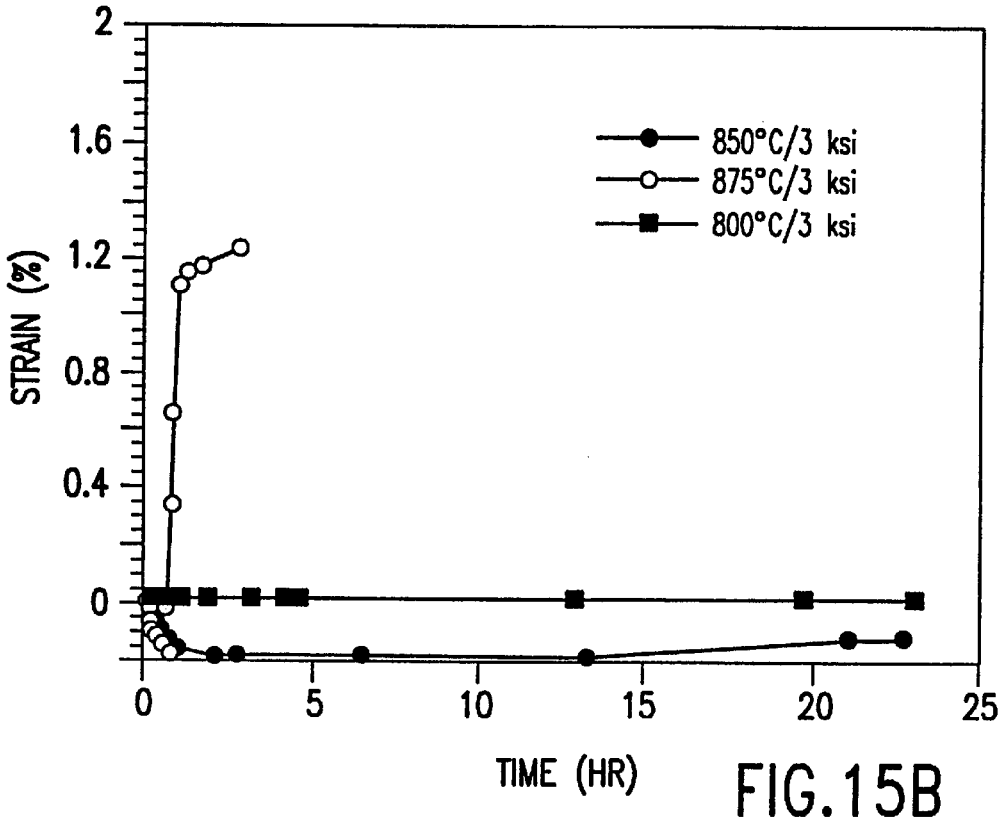

FIGS. 14*a–e* show graphs of creep strain data versus time for alloys 48, 51 and 56, wherein FIG. 14*a* shows a comparison of creep strain at 800° C. for alloys 48 and 56, FIG. 14*b* shows creep strain at 800° C. for alloy 48, FIG. 14*c* shows creep strain at 800° C., 825° C. and 850° C. for alloy 48 after annealing at 1100° C. for one hour, FIG. 14*d* shows creep strain at 800° C., 825° C. and 850° C. for alloy 48 after annealing at 750° C. for one hour, and FIG. 14*e* shows creep strain at 850° C. for alloy 51 after annealing at 400° C. for 139 hours. FIGS. 15*a–b* show graphs of creep strain data versus time for alloy 62 wherein FIG. 15*a* shows a comparison of creep strain at 850° C. and 875° C. for alloy 62 in the form of sheet and FIG. 15*b* shows creep strain at 800° C., 850° C. and 875° C. for alloy 62 in the form of bar.

Figure 16A:
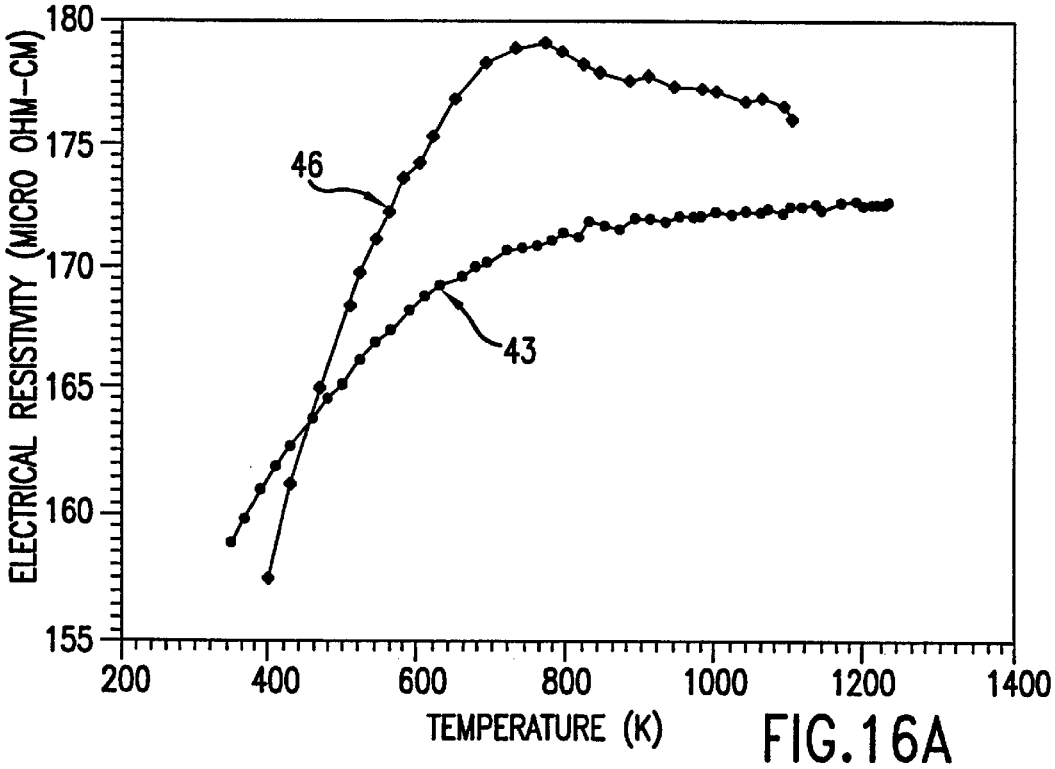
Figure 16B:
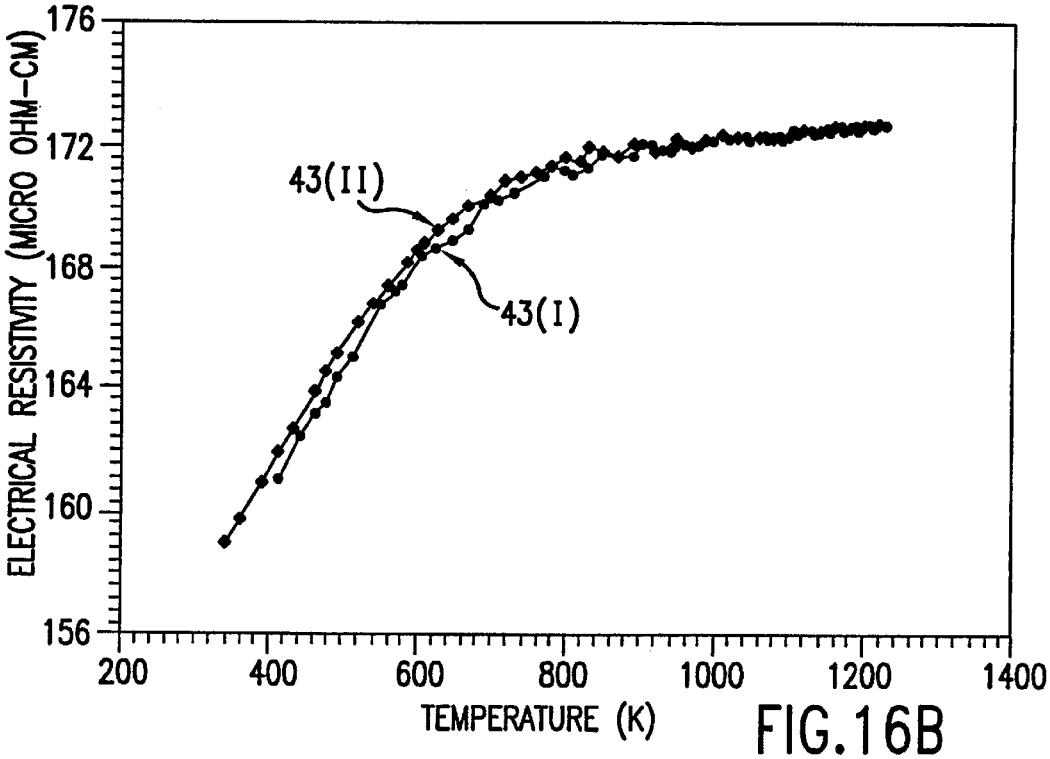

FIGS. 16*a–b* show graphs of electrical resistivity versus temperature for alloys 46 and 43 wherein FIG. 16*a* shows electrical resistivity of alloys 46 and 43 and FIG. 16*b* shows effects of a heating cycle on electrical resistivity of alloy 43.

The Fe—Al alloys can be formed by powder metallurgical techniques or by the arc melting, air induction melting, or vacuum induction melting of powdered and/or solid pieces of the selected alloy constituents at a temperature of about 1600° C. in a suitable crucible formed of $ZrO_2$ or the like. The molten alloy is preferably cast into a mold of graphite or the like in the configuration of a desired product or for forming a heat of the alloy used for the formation of an alloy article by working the alloy.

The melt of the alloy to be worked is cut, if needed, into an appropriate size and then reduced in thickness by forging at a temperature in the range of about 900 to 1100° C., hot rolling at a temperature in the range of about 750 to 100° C., warm rolling at a temperature in the range of about 600 to 700° C., and/or cold rolling at room temperature. Each pass through the cold rolls can provide a 20 to 30% reduction in thickness and is followed by heat treating the alloy in air, inert gas or vacuum at a temperature in the range of about 700 to 1,050° C., preferably about 800° C. for one hour.

Wrought alloy specimens set forth in the following tables were prepared by arc melting the alloy constituents to form heats of the various alloys. These heats were cut into 0.5 inch thick pieces which were forged at 1000° C. to reduce the thickness of the alloy specimens to 0.25 inch (50% reduction), then hot rolled at 800° C. to further reduce the thickness of the alloy specimens to 0.1 inch (60% reduction), and then warm rolled at 650° C. to provide a final thickness of 0.030 inch (70% reduction) for the alloy specimens described and tested herein. For tensile tests, the specimens were punched from 0.030 inch sheet with a ½ inch gauge length of the specimen aligned with the rolling direction of the sheet.

Specimens prepared by powder metallurgical techniques are also set forth in the following tables. In general, powders were obtained by gas atomization or water atomization techniques. Depending on which technique is used, powder morphology ranging from spherical (gas atomized powder) to irregular (water atomized powder) can be obtained. The water atomized powder includes an aluminum oxide coating which is broken up into stringers of oxide particles during thermomechanical processing of the powder into useful shapes such as sheet, strip, bar, etc. The oxide particles modify the electrical resistivity of the alloy by acting as discrete insulators in a conductive Fe—Al matrix.

In order to compare compositions of alloys, alloy compositions are set forth in Tables 1a–b. Table 2 sets forth strength and ductility properties at low and high temperatures for selected alloy compositions in Tables 1a–b.

Sag resistance data for various alloys is set forth in Table 3. The sag tests were carried out using strips of the various alloys supported at one end or supported at both ends. The amount of sag was measured after heating the strips in an air atmosphere at 900° C. for the times indicated.

Creep data for various alloys is set forth in Table 4. The creep tests were carried out using a tensile test to determine stress at which samples ruptured at test temperature in 10 h, 100 h and 1000 h.

Electrical resistivity at room temperature and crystal structure for selected alloys are set forth in Table 5. As shown therein, the electrical resistivity is affected by composition and processing of the alloy.

Table 6 sets forth hardness data of oxide dispersion strengthened alloys in accordance with the invention. In particular, Table 6 shows the hardness (Rockwell C) of alloys 62, 63 and 64. As shown therein, even with up to 20% $Al_2O_3$ (alloy 64), the hardness of the material can be maintained below Rc45. In order to provide workability, however, it is preferred that the hardness of the material be maintained below about Rc35. Thus, when it is desired to utilize oxide dispersion strengthened material as the resistance heater material, workability of the material can be improved by carrying out a suitable heat treatment to lower the hardness of the material.

Table 7 shows heats of formation of selected intermetallics which can be formed by reaction synthesis. While only aluminides and silicides are shown in Table 7, reaction synthesis can also be used to form carbides, nitrides, oxides and borides. For is instance, a matrix of iron aluminide and/or electrically insulating or electrically conductive covalent ceramics in the form of particles or fibers can be formed by mixing elemental powders which react exothermically during heating of such powders. Thus, such reaction synthesis can be carried out while extruding or sintering powder used to form the heater element according to the invention.

TABLE 1a

| | Composition In Weight % | | | | | | | | | | | | | | | |
|---|---|---|---|---|---|---|---|---|---|---|---|---|---|---|---|---|
| Alloy No | Fe | Al | Si | Ti | Mo | Zr | C | Ni | Y | B | Nb | Ta | Cr | Ce | Cu | O |
| 1 | 91.5 | 8.5 | | | | | | | | | | | | | | |
| 2 | 91.5 | 6.5 | 2.0 | | | | | | | | | | | | | |
| 3 | 90.5 | 8.5 | | 1.0 | | | | | | | | | | | | |
| 4 | 90.27 | 8.5 | | 1.0 | | 0.2 | 0.03 | | | | | | | | | |
| 5 | 90.17 | 8.5 | 0.1 | 1.0 | | 0.2 | 0.03 | | | | | | | | | |
| 6 | 89.27 | 8.5 | | 1.0 | 1.0 | 0.2 | 0.03 | | | | | | | | | |
| 7 | 89.17 | 8.5 | 0.1 | 1.0 | 1.0 | 0.2 | 0.03 | | | | | | | | | |
| 8 | 93 | 6.5 | 0.5 | | | | | | | | | | | | | |
| 9 | 94.5 | 5.0 | 0.5 | | | | | | | | | | | | | |
| 10 | 92.5 | 6.5 | 1.0 | | | | | | | | | | | | | |
| 11 | 75.0 | 5.0 | | | | | | 20.0 | | | | | | | | |
| 12 | 71.5 | 8.5 | | | | | | 20.0 | | | | | | | | |
| 13 | 72.25 | 5.0 | 0.5 | 1.0 | 1.0 | 0.2 | 0.03 | 20.0 | 0.02 | | | | | | | |
| 14 | 76.19 | 6.0 | 0.5 | 1.0 | 1.0 | 0.2 | 0.03 | 15.0 | 0.08 | | | | | | | |
| 15 | 81.19 | 6.0 | 0.5 | 1.0 | 1.0 | 0.2 | 0.03 | 10.0 | 0.08 | | | | | | | |
| 16 | 86.23 | 8.5 | | 1.0 | 4.0 | 0.2 | 0.03 | | 0.04 | | | | | | | |
| 17 | 88.77 | 8.5 | | 1.0 | 1.0 | 0.6 | 0.09 | | 0.04 | | | | | | | |
| 18 | 85.77 | 8.5 | | 1.0 | 1.0 | 0.6 | 0.09 | 3.0 | 0.04 | | | | | | | |
| 19 | 83.77 | 8.5 | | 1.0 | 1.0 | 0.6 | 0.09 | 5.0 | 0.04 | | | | | | | |
| 20 | 88.13 | 8.5 | | 1.0 | 1.0 | 0.2 | 0.03 | | 0.04 | | 0.5 | 0.5 | | | | |
| 21 | 61.48 | 8.5 | | | | | | 30.0 | | 0.02 | | | | | | |
| 22 | 88.90 | 8.5 | 0.1 | 1.0 | 1.0 | 0.2 | 0.3 | | | | | | | | | |
| 23 | 87.60 | 8.5 | 0.1 | 2.0 | 1.0 | 0.2 | 0.6 | | | | | | | | | |
| 24 | bal | 8.19 | | | | | | | | | | | 2.13 | | | |
| 25 | bal | 8.30 | | | | | | | | | | | 4.60 | | | |
| 26 | bal | 8.28 | | | | | | | | | | | 6.93 | | | |
| 27 | bal | 8.22 | | | | | | | | | | | 9.57 | | | |
| 28 | bal | 7.64 | | | | | | | | | | | 7.46 | | | |
| 29 | bal | 7.47 | 0.32 | | | | | | | | | | 7.53 | | | |
| 30 | 84.75 | 8.0 | | | 6.0 | 0.8 | 0.1 | | | | 0.25 | | | 0.1 | | |
| 31 | 85.10 | 8.0 | | | 6.0 | 0.8 | 0.1 | | | | | | | | | |
| 32 | 86.00 | 8.0 | | | 6.0 | | | | | | | | | | | |

TABLE 1b

| | Composition In Weight % | | | | | | | | | | | | |
|---|---|---|---|---|---|---|---|---|---|---|---|---|---|
| Alloy No | Fe | Al | Ti | Mo | Zr | C | Y | B | Dr | Ce | Cu | O | Ceramic |
| 33 | 78.19 | 21.23 | — | 0.42 | 0.10 | — | — | 0.060 | | | | | |
| 34 | 79.92 | 19.50 | — | 0.42 | 0.10 | — | — | 0.060 | — | | | | |
| 35 | 81.42 | 18.00 | — | 0.42 | 0.10 | — | — | 0.060 | — | | | | |
| 36 | 82.31 | 15.00 | 1.0 | 1.0 | 0.60 | 0.09 | — | — | — | | | | |
| 37 | 78.25 | 21.20 | — | 0.42 | 0.10 | 0.03 | — | 0.005 | — | | | | |
| 38 | 78.24 | 21.20 | — | 0.42 | 0.10 | 0.03 | — | 0.010 | — | | | | |
| 39 | 84.18 | 15.82 | — | — | — | — | — | — | — | | | | |
| 40 | 81.98 | 15.84 | — | — | — | — | — | — | 2.18 | | | | |
| 41 | 78.66 | 15.88 | — | — | — | — | — | — | 5.46 | | | | |
| 42 | 74.20 | 15.93 | — | — | — | — | — | — | 9.87 | | | | |
| 43 | 78.35 | 21.10 | — | 0.42 | 0.10 | 0.03 | — | — | — | | | | |
| 44 | 78.35 | 21.10 | — | 0.42 | 0.10 | 0.03 | — | 0.0025 | — | | | | |
| 45 | 78.58 | 21.26 | — | — | 0.10 | — | — | 0.060 | — | | | | |
| 46 | 82.37 | 17.12 | | | | | | 0.010 | | | | 0.50 | |
| 47 | 81.19 | 16.25 | | | | | | 0.015 | 2.22 | | | 0.33 | |
| 48 | 76.450 | 23.0 | — | 0.42 | 0.10 | 0.03 | — | — | — | | — | — | |
| 49 | 76.445 | 23.0 | — | 0.42 | 0.10 | 0.03 | — | 0.005 | — | | — | — | |
| 50 | 76.243 | 23.0 | — | 0.42 | 0.10 | 0.03 | 0.2 | 0.005 | — | | — | — | |
| 51 | 75.445 | 23.0 | 1.0 | 0.42 | 0.10 | 0.03 | — | 0.005 | — | | — | — | |
| 52 | 74.8755 | 25.0 | — | — | 0.10 | 0.023 | — | 0.0015 | — | | — | — | |

TABLE 1b-continued

| Alloy No | Composition In Weight % | | | | | | | | | | | | |
|---|---|---|---|---|---|---|---|---|---|---|---|---|---|
| | Fe | Al | Ti | Mo | Zr | C | Y | B | Dr | Ce | Cu | O | Ceramic |
| 53 | 72.8755 | 25.0 | — | — | 0.10 | 0.023 | — | 0.0015 | — | | 2.0 | — | |
| 54 | 73.8755 | 25.0 | 1.0 | — | 0.10 | 0.023 | — | 0.0015 | — | | — | — | |
| 55 | 73.445 | 26.0 | — | 0.42 | 0.10 | 0.03 | — | 0.0015 | — | | — | — | |
| 56 | 69.315 | 30.0 | — | 0.42 | 0.20 | 0.06 | — | 0.005 | | | | | |
| 57 | bal. | 25 | | | 0.10 | 0.023 | | 0.0015 | — | — | | | |
| 58 | bal. | 24 | | | — | 0.010 | | 0.0030 | 2 | — | | | |
| 59 | bal. | 24 | | | — | 0.015 | | 0.0030 | <0.1 | — | | | |
| 60 | bal. | 24 | | | — | 0.015 | | 0.0025 | 5 | 0.5 | | | |
| 61 | bal. | 25 | | | — | | | 0.0030 | 2 | 0.1 | | | |
| 62 | bal. | 23 | | 0.42 | 0.10 | 0.03 | | | | | | | 0.20 $Y_2O_3$ |
| 63 | bal. | 23 | | 0.42 | 0.10 | 0.03 | | | | | | | 10 $Al_2O_3$ |
| 64 | bal. | 23 | | 0.42 | 0.10 | 0.03 | | | | | | | 20 $Al_2O_3$ |
| 65 | bal. | 24 | | 0.42 | 0.10 | 0.03 | | | | | | | 2 $Al_2O_3$ |
| 66 | bal. | 24 | | 0.42 | 0.10 | 0.03 | | | | | | | 4 $Al_2O_3$ |
| 67 | bal. | 24 | | 0.42 | 0.10 | 0.03 | | | | | | | 2 TiC |
| 68 | bal. | 24 | | 0.42 | 0.10 | 0.03 | | | | | | | 2 $ZrO_2$ |

TABLE 2

| Alloy No. | Heat Treat-ment | Test Temp. (° C.) | Yield Strength (ksi) | Tensile Strength (ksi) | Elongation (%) | Reduction in Area (%) |
|---|---|---|---|---|---|---|
| 1 | A | 23 | 60.60 | 73.79 | 25.50 | 41.46 |
| 1 | B | 23 | 55.19 | 68.53 | 23.56 | 31.39 |
| 1 | A | 800 | 3.19 | 3.99 | 108.76 | 72.44 |
| 1 | B | 800 | 1.94 | 1.94 | 122.20 | 57.98 |
| 2 | A | 23 | 94.16 | 94.16 | 0.90 | 1.55 |
| 2 | A | 800 | 6.40 | 7.33 | 107.56 | 71.87 |
| 3 | A | 23 | 69.63 | 86.70 | 22.64 | 28.02 |
| 3 | A | 800 | 7.19 | 7.25 | 94.00 | 74.89 |
| 4 | A | 23 | 70.15 | 89.85 | 29.88 | 41.97 |
| 4 | B | 23 | 65.21 | 85.01 | 30.94 | 35.68 |
| 4 | A | 800 | 5.22 | 7.49 | 144.70 | 81.05 |
| 4 | B | 800 | 5.35 | 5.40 | 105.96 | 75.42 |
| 5 | A | 23 | 73.62 | 92.68 | 27.32 | 40.83 |
| 5 | B | 800 | 9.20 | 9.86 | 198.96 | 89.19 |
| 6 | A | 23 | 74.50 | 93.80 | 30.36 | 40.81 |
| 6 | A | 800 | 9.97 | 11.54 | 153.00 | 85.56 |
| 7 | A | 23 | 79.29 | 99.11 | 19.60 | 21.07 |
| 7 | B | 23 | 75.10 | 97.09 | 13.20 | 16.00 |
| 7 | A | 800 | 10.36 | 10.36 | 193.30 | 84.46 |
| 7 | B | 800 | 7.60 | 9.28 | 167.00 | 82.53 |
| 8 | A | 23 | 51.10 | 66.53 | 35.80 | 27.96 |
| 8 | A | 800 | 4.61 | 5.14 | 155.80 | 55.47 |
| 9 | A | 23 | 37.77 | 59.67 | 34.20 | 18.88 |
| 9 | A | 800 | 5.56 | 6.09 | 113.50 | 48.82 |
| 10 | A | 23 | 64.51 | 74.46 | 14.90 | 1.45 |
| 10 | A | 800 | 5.99 | 6.24 | 107.86 | 71.00 |
| 13 | A | 23 | 151.90 | 185.88 | 10.08 | 15.98 |
| 13 | C | 23 | 163.27 | 183.96 | 7.14 | 21.54 |
| 13 | A | 800 | 9.49 | 17.55 | 210.90 | 89.01 |
| 13 | C | 800 | 25.61 | 29.90 | 62.00 | 57.66 |
| 16 | A | 23 | 86.48 | 107.44 | 6.46 | 7.09 |
| 16 | A | 800 | 14.5O | 14.89 | 94.64 | 76.94 |
| 17 | A | 23 | 76.66 | 96.44 | 27.40 | 45.67 |
| 17 | B | 23 | 69.68 | 91.10 | 29.04 | 39.71 |
| 17 | A | 800 | 9.37 | 11.68 | 111.10 | 85.69 |
| 17 | B | 800 | 12.05 | 14.17 | 108.64 | 75.67 |
| 20 | A | 23 | 88.63 | 107.02 | 17.94 | 28.60 |
| 20 | B | 23 | 77.79 | 99.70 | 24.06 | 37.20 |
| 20 | A | 800 | 7.22 | 11.10 | 127.32 | 80.37 |
| 20 | B | 800 | 13.58 | 14.14 | 183.40 | 88.76 |
| 21 | D | 23 | 207.29 | 229.76 | 4.70 | 14.25 |
| 21 | C | 23 | 85.61 | 159.98 | 38.00 | 32.65 |
| 21 | D | 800 | 45.03 | 55.56 | 37.40 | 35.08 |
| 21 | C | 800 | 48.58 | 57.81 | 8.40 | 8.34 |
| 22 | C | 23 | 67.80 | 91.13 | 26.00 | 42.30 |
| 22 | C | 800 | 10.93 | 11.38 | 108.96 | 79.98 |
| 24 | E | 23 | 71.30 | 84.30 | 23 | 33 |

TABLE 2-continued

| Alloy No. | Heat Treat-ment | Test Temp. (° C.) | Yield Strength (ksi) | Tensile Strength (ksi) | Elongation (%) | Reduction in Area (%) |
|---|---|---|---|---|---|---|
| 24 | F | 23 | 69.30 | 84.60 | 22 | 40 |
| 25 | E | 23 | 73.30 | 85.20 | 34 | 68 |
| 25 | F | 23 | 71.80 | 86.90 | 27 | 60 |
| 26 | E | 23 | 61.20 | 83.25 | 15 | 15 |
| 26 | F | 23 | 61.20 | 84.20 | 21 | 27 |
| 27 | E | 23 | 59.60 | 86.90 | 13 | 15 |
| 27 | F | 23 | — | 88.80 | 18 | 19 |
| 28 | E | 23 | 60.40 | 77.70 | 35 | 74 |
| 28 | E | 23 | 59.60 | 79.80 | 26 | 58 |
| 29 | F | 23 | 62.20 | 76.60 | 17 | 17 |
| 29 | F | 23 | 61.70 | 86.80 | 12 | 12 |
| 30 | | 23 | 97.60 | 116.60 | 4 | 5 |
| 30 | | 650 | 26.90 | 28.00 | 38 | 86 |
| 31 | | 23 | 79.40 | 104.30 | 7 | 7 |
| 31 | | 650 | 38.50 | 47.00 | 27 | 80 |
| 32 | | 23 | 76.80 | 94.80 | 7 | 5 |
| 32 | | 650 | 29.90 | 32.70 | 35 | 86 |
| 35 | C | 23 | 63.17 | 84.95 | 5.12 | 7.81 |
| 35 | C | 600 | 49.54 | 62.40 | 36.60 | 46.25 |
| 35 | C | 800 | 18.80 | 23.01 | 80.10 | 69.11 |
| 46 | G | 23 | 77.20 | 102.20 | 5.70 | 4.24 |
| 46 | G | 600 | 66.61 | 66.61 | 26.34 | 31.86 |
| 46 | G | 800 | 7.93 | 16.55 | 46.10 | 32.87 |
| 46 | G | 850 | 7.77 | 10.54 | 38.30 | 32.91 |
| 46 | G | 900 | 2.65 | 5.44 | 30.94 | 31.96 |
| 46 | G | 23 | 62.41 | 94.82 | 5.46 | 6.54 |
| 46 | G | 800 | 10.49 | 13.41 | 27.10 | 30.14 |
| 46 | G | 850 | 3.37 | 7.77 | 33.90 | 26.70 |
| 46 | G | 23 | 63.39 | 90.34 | 4.60 | 3.98 |
| 46 | G | 800 | 11.49 | 14.72 | 17.70 | 21.65 |
| 46 | G | 850 | 14.72 | 8.30 | 26.90 | 23.07 |
| 43 | H | 23 | 75.2 | 136.2 | 9.2 | |
| 43 | H | 600 | 71.7 | 76.0 | 24.4 | |
| 43 | H | 700 | 58.8 | 60.2 | 16.5 | |
| 43 | H | 800 | 29.4 | 31.8 | 14.8 | |
| 43 | I | 23 | 92.2 | 167.5 | 14.8 | |
| 43 | I | 600 | 76.8 | 82.2 | 27.6 | |
| 43 | I | 700 | 61.8 | 66.7 | 21.6 | |
| 43 | I | 800 | 32.5 | 34.5 | 20.0 | |
| 43 | J | 23 | 97.1 | 156.1 | 12.4 | |
| 43 | J | 600 | 75.4 | 80.4 | 25.4 | |
| 43 | J | 700 | 58.7 | 62.1 | 22.0 | |
| 43 | J | 800 | 22.4 | 27.8 | 21.7 | |
| 43 | N | 23 | 79.03 | 95.51 | 3.01 | 4.56 |
| 43 | K | 850 | 16.01 | 17.35 | 51.73 | 34.08 |
| 43 | L | 850 | 16.40 | 18.04 | 51.66 | 32.92 |
| 43 | M | 850 | 18.07 | 19.42 | 56.04 | 31.37 |

TABLE 2-continued

| Alloy No. | Heat Treat-ment | Test Temp. (° C.) | Yield Strength (ksi) | Tensile Strength (ksi) | Elongation (%) | Reduction in Area (%) |
|---|---|---|---|---|---|---|
| 43 | N | 850 | 19.70 | 21.37 | 47.27 | 38.85 |
| 43 | O (bar) | 850 | 26.15 | 26.46 | 61.13 | 48.22 |
| 43 | K (sheet) | 850 | 12.01 | 15.43 | 35.96 | 28.43 |
| 43 | O (sheet) | 850 | 13.79 | 18.00 | 14.66 | 19.16 |
| 43 | P | 850 | 22.26 | 25.44 | 26.84 | 19.21 |
| 43 | Q | 850 | 26.39 | 26.59 | 28.52 | 20.96 |
| 43 | O | 900 | 12.41 | 12.72 | 43.94 | 42.24 |
| 43 | S | 23 | 21.19 | 129.17 | 7.73 | 7.87 |
| 49 | S | 850 | 23.43 | 27.20 | 102.98 | 94.49 |
| 51 | S | 850 | 19.15 | 19.64 | 183.32 | 97.50 |
| 53 | S | 850 | 18.05 | 18.23 | 118.66 | 97.69 |
| 56 | R | 850 | 16.33 | 21.91 | 74.96 | 95.18 |
| 56 | S | 23 | 61.69 | 99.99 | 5.31 | 4.31 |
| 56 | K | 850 | 16.33 | 21.91 | 74.96 | 95.18 |
| 62 | D | 850 | 17.34 | 19.70 | 14.70 | 11.91 |
| 63 | D | 850 | 18.77 | 21.52 | 13.84 | 9.77 |
| 64 | D | 850 | 12.73 | 16.61 | 2.60 | 26.88 |
| 65 | T | 23 | 96.09 | 121.20 | 2.50 | 2.02 |
| | | 800 | 27.96 | 32.54 | 29.86 | 26.52 |
| 66 | T | 23 | 96.15 | 124.85 | 3.70 | 5.90 |
| | | 800 | 27.52 | 35.13 | 29.20 | 22.65 |
| 67 | T | 23 | 92.53 | 106.86 | 2.26 | 6.81 |
| | | 800 | 31.80 | 36.10 | 14.30 | 25.54 |
| 68 | T | 23 | 69.74 | 83.14 | 2.54 | 5.93 |
| | | 800 | 20.61 | 24.98 | 33.24 | 49.19 |

Heat Treatments of Samples
A = 800° C./1 hr./Air Cool
B = 1050° C./2 hr./AirCool
C = 1050° C./2 hr. in Vacuum
D = As rolled
E = 815° C./1 hr./oil Quench
F = 815° C./1 hr./furnace cool
G = 700° C./1 hr./Air Cool
H = Extruded at 1100° C.
I = Extruded at 1000° C.
J = Extruded at 950° C.
K = 750° C/1 hr. in vacuum
L = 800° C./1 hr. in vacuum
M = 900° C./1 hr. in vacuum
N = 1000° C./1 hr. in vacuum
O = 1100° C./1 hr. in vacuum
P = 1200° C./1 hr. in vacuum
Q = 1300° C./1 hr. in vacuum
R = 750° C./1 hr. slow cool
S = 400° C./139 hr.
T = 700° C./1 hr. oil quench
Alloys 1–22, 35, 43, 46, 56, 65–68 tested with 0.2 inch/min. strain rate
Alloys 49, 51, 53 tested with 0.16 inch/min. strain rate

TABLE 3

| Ends of Sample Supported | Sample Thickness (mil) | Length of Heating (h) | Amount of Sag (inch) Alloy 17 | Alloy 20 | Alloy 22 | Alloy 45 | Alloy 47 |
|---|---|---|---|---|---|---|---|
| One[a] | 30 | 16 | 1/8 | — | — | 1/8 | — |
| One[b] | 30 | 21 | — | 3/8 | 1/8 | 1/4 | — |
| Both | 30 | 185 | — | 0 | 0 | 1/16 | 0 |
| Both | 10 | 68 | — | — | 1/8 | 0 | 0 |

AdditionalConditions
[a] = wire weight hung on free end to make samples have same weight
[b] = foils of same length and width placed on samples to make samples have same weight

TABLE 4

| Sample | Test Temperature ° F. | ° C. | Creep Rupture Strength (ksi) 10 h | 100 h | 1000 h |
|---|---|---|---|---|---|
| 1 | 1400 | 760 | 2.90 | 2.05 | 1.40 |
| | 1500 | 816 | 1.95 | 1.35 | 0.95 |
| | 1600 | 871 | 1.20 | 0.90 | — |
| | 1700 | 925 | 0.90 | — | — |
| 4 | 1400 | 760 | 3.50 | 2.50 | 1.80 |
| | 1500 | 816 | 2.40 | 1.80 | 1.20 |
| | 1600 | 871 | 1.65 | 1.15 | — |
| | 1700 | 925 | 1.15 | — | — |
| 5 | 1400 | 760 | 3.60 | 2.50 | 1.85 |
| | 1500 | 816 | 2.40 | 1.80 | 1.20 |
| | 1600 | 871 | 1.65 | 1.15 | — |
| | 1700 | 925 | 1.15 | — | — |
| 6 | 1400 | 760 | 3.50 | 2.60 | 1.95 |
| | 1500 | 816 | 2.50 | 1.90 | 1.40 |
| | 1600 | 871 | 1.80 | 1.30 | — |
| | 1700 | 925 | 1.30 | — | — |
| 7 | 1400 | 760 | 3.90 | 2.90 | 2.15 |
| | 1500 | 816 | 2.80 | 2.00 | 1.65 |
| | 1600 | 871 | 2.00 | 1.50 | — |
| | 1700 | 925 | 1.50 | — | — |
| 17 | 1400 | 760 | 3.95 | 3.0 | 2.3 |
| | 1500 | 816 | 2.95 | 2.20 | 1.75 |
| | 1600 | 871 | 2.05 | 1.65 | 1.25 |
| | 1700 | 925 | 1.65 | 1.20 | — |
| 20 | 1400 | 760 | 4.90 | 3.25 | 2.05 |
| | 1500 | 816 | 3.20 | 2.20 | 1.65 |
| | 1600 | 871 | 2.10 | 1.55 | 1.0 |
| | 1700 | 925 | 1.56 | 0.95 | — |
| 22 | 1400 | 760 | 4.70 | 3.60 | 2.65 |
| | 1500 | 816 | 3.55 | 2.60 | 1.35 |
| | 1600 | 871 | 2.50 | 1.80 | 1.25 |
| | 1700 | 925 | 1.80 | 1.20 | 1.0 |

TABLE 5

| Alloy | Condition | Electrical Resistivity Room-temp $\mu\Omega \cdot$ cm. | Crystal Structure |
|---|---|---|---|
| 35 | | 184 | $DO_3$ |
| 46 | A | 167 | $DO_3$ |
| 46 | A + D | 169 | $DO_3$ |
| 46 | A + E | 181 | $B_2$ |
| 39 | | 149 | $DO_3$ |
| 40 | | 164 | $DO_3$ |
| 40 | B | 178 | $DO_3$ |
| 41 | C | 190 | $DO_3$ |
| 43 | C | 185 | $B_2$ |
| 44 | C | 178 | $B_2$ |
| 45 | C | 184 | $B_2$ |
| 62 | F | 197 | |
| 63 | F | 251 | |
| 64 | F | 337 | |
| 65 | F | 170 | |
| 66 | F | 180 | |
| 67 | F | 158 | |
| 68 | F | 155 | |

ConditionofSamples
A = water atomized powder
B = gas atomized powder
C = cast and processed
D = ½ hr. anneal at 700° C. + oil quench
E = ½ hr. anneal at 750° C. + oil quench
F = reaction synthesis to form covalent ceramic addition

TABLE 6

HARDNESS DATA

| CONDITION | MATERIAL Alloy 62 | Alloy 63 | Alloy 64 |
|---|---|---|---|
| As extruded | 39 | 37 | 44 |
| Annealed 750° C. for 1 h followed by slow cooling | 35 | 34 | 44 |

Alloy 62: Extruded in carbon steel at 1100° C. to a reduction ratio of 16:1 (2- to 1/2-in. die);
Alloy 63 and Alloy 64: Extruded in stainless steel at 1250° C. to a reduction ratio of 16:1 (2 to 1/2-in. die).

TABLE 7

| Intermetallic | ΔH°298 (K cal/mole) | Intermetallic | ΔH°298 (K cal/mole) | Intermetallic | ΔH°298 (K cal/mole) |
|---|---|---|---|---|---|
| $NiAl_3$ | −36.0 | $Ni_2Si$ | −34.1 | $Ta_2Si$ | −30.0 |
| NiAl | −28.3 | $Ni_3Si$ | −55.5 | $Ta_5Si_3$ | −80.0 |
| $Ni_2Al_3$ | −67.5 | NiSi | −21.4 | TaSi | −28.5 |
| $Ni_3Al$ | −36.6 | $NiSi_2$ | −22.5 | — | — |
| — | — | — | — | $Ti_5Si_3$ | −138.5 |
| $FeAl_3$ | −18.9 | $Mo_3Si$ | −27.8 | TiSi | −31.0 |
| FeAl | −12.0 | $Mo_5Si_3$ | −74.1 | $TiSi_2$ | −32.1 |
| — | — | $MoSi_2$ | −31.5 | — | — |
| CoAl | −26.4 | — | — | $WSi_2$ | −22.2 |
| $CoAl_4$ | −38.5 | $Cr_3Si$ | −22.0 | $W_5Si_3$ | −32.3 |
| $Co_2Al_5$ | −70.0 | $Cr_5Si_3$ | −50.5 | — | — |
| — | — | CrSi | −12.7 | $Zr_2Si$ | −81.0 |
| $Ti_3Al$ | −23.5 | $CrSi_2$ | −19.1 | $Zr_5Si_3$ | −146.7 |
| TiAl | −17.4 | — | — | ZrSi | −35.3 |
| $TiAl_3$ | −34.0 | $Co_2Si$ | −28.0 | — | — |
| $Ti_2Al_3$ | −27.9 | CoSi | −22.7 | — | — |
| — | — | $CoSi_2$ | −23.6 | — | — |
| $NbAl_3$ | −28.4 | — | — | — | — |
| — | — | FeSi | −18.3 | — | — |
| TaAl | −19.2 | — | — | — | — |
| $TaAl_3$ | −26.1 | $NbSi_2$ | −33.0 | — | — |

PREALLOYED POWDER

According to a second embodiment of the invention, an intermetallic alloy composition is formed into sheet by consolidating prealloyed powder, cold working and heat treating the cold rolled sheet. The invention overcomes problems associated with hot working intermetallic alloys such as by extrusion or hot rolling. For instance, because the surface of hot rolled material tends to be cooler than the center, the surface doesn't elongate as much as the center and results in surface cracking. Further, surface oxidation can result when exposing intermetallic alloys to such high temperatures. The invention eliminates the need for high temperature working steps by consolidating a prealloyed powder into a sheet which can be cold worked (i.e., worked without applying external heat) to a desired final thickness.

According to this embodiment, a sheet having an intermetallic alloy composition is prepared by a powder metallurgical technique wherein a non-densified metal sheet is formed by consolidating a prealloyed powder having an intermetallic alloy composition, a cold rolled sheet is formed by cold rolling the non-densified metal sheet so as to densify and reduce the thickness thereof, and the cold rolled sheet is heat treated to sinter, anneal, stress relieve and/or degas the cold rolled sheet. The consolidating step can be carried out in various ways such as by roll compaction, tape casting or plasma spraying. In the consolidating step, a sheet or narrow sheet in the form of a strip can be formed having any suitable thickness such as less than 0.1 inch. This strip is then cold rolled in one or more passes to a final desired thickness with at least one heat treating step such as a sintering, annealing or stress relief heat treatment.

The foregoing process provides a simple and economic manufacturing technique for preparing intermetallic alloy materials such as iron aluminides which are known to have poor ductility and high work hardening potential at room temperature.

Roll Compaction

In the roll compaction process according to the invention, a prealloyed powder is processed according to the exemplary flow chart set forth in FIG. 17. As shown in FIG. 17, in a first step pure elements and trace alloys are preferably water atomized or polymer atomized to form a prealloyed irregular shaped powder of an intermetallic composition such as an aluminide (e.g. iron aluminide, nickel aluminide, or titanium aluminide) or other intermetallic composition. Water or polymer atomized powder is preferred over gas atomized powder for subsequent roll compaction since the irregularly shaped surfaces of the water atomized powder provide better mechanical interlocking than the spherical powder obtained from gas atomization. Polymer atomized powder is preferred over water atomized powder since the polymer atomized powder provides less surface oxide on the powder.

The prealloyed powder is sieved to a desired particle size range, blended with an organic binder, mixed with an optional solvent and blended together to form a blended powder. In the case of iron aluminide powder, the sieving step preferably provides a powder having a particle size within the range of −100 to +325 mesh which corresponds to a particle size of 43 to 150 $\mu$m. In order to improve the flow properties of the powder, less than 5%, preferably 3–5% of the powder has a particle size of less than 43 $\mu$m. The organic binder is preferably cellulose based powder (e.g., −100 mesh binder powder) and is blended with the prealloyed powder in an amount such as up to about 5 wt %. The cellulose based binder can be methylcellulose (MS), carboxymethylcellulose (CMS) or any other suitable organic binder such as polyvinylalcohol (PVA). The surface of the prealloyed powder is preferably contacted with enough binder to cause mechanical bonding of the powder (i.e., the powder particles stick to each other when pressed together). The solvent can be a liquid such as purified water in any suitable amount such as up to about 5 wt %. The mixture of the binder-adhered prealloyed powder and solvent provides a "dry" blend which is free flowing while providing mechanical interlocking of the powders when roll compacted together.

Green strips are prepared by roll compaction wherein the blended powder is fed from a hopper through a slot into a space between two compaction rolls. In a preferred embodiment, the roll compaction produces a green strip of iron aluminide having a thickness of about 0.026 inch and the green strip can be cut into strips having dimensions such as 36 inches by 4 inches. The green strips are subjected to a heat treatment step to remove volatile components such as the binder and any organic solvents. The binder burn out can be carried out in a furnace at atmospheric or reduced pressure in a continuous or batch manner. For instance, a batch of iron aluminide strips can be furnace set at a suitable temperature such as 700–900° F. (371–482°) for a suitable amount of time such as 6–8 hours at a higher temperature such as 950° F. (510° C.). During this step, the furnace can be at 1 atmosphere pressure with nitrogen gas flowing therethrough so as to remove most of the binder, e.g., at least 99% binder removal. This binder removal step results in very fragile green strips which are then subjected to primary sintering in a vacuum furnace.

In the primary sintering step, the porous brittle de-bindened strips are preferably heated under conditions suitable for effecting partial sintering with or without densification of the powder. This sintering step can be carried out in a furnace at reduced pressure in a continuous or batch manner. For instance, a batch of the de-bindened iron aluminide strips can be heated in a vacuum furnace at a suitable temperature such as 2300° F. (1260° C.) for a suitable time such as one hour. The vacuum furnace can be maintained at any suitable vacuum pressure such as $10^{-4}$ to $10^{-5}$ Torr. In order to prevent loss of aluminum from the strips during sintering, it is preferable to maintain the sintering temperature low enough to avoid vaporizing aluminum yet provide enough metallurgical bonding to allow subsequent rolling. Further, vacuum sintering is preferred to avoid oxidation of the non-densified strips. However, protective atmospheres such as hydrogen, argon and/or nitrogen with proper dew points such as −50° F. or less thereof could be used in place of the vacuum.

In the next step, the presintered strips are preferably subjected to cold rolling in air to a final or intermediate thickness. In this step, the porosity of the green strip can be substantially reduced, e.g., from around 50% to less than 10% porosity. Due to the hardness of the intermetallic alloy, it is advantageous to use a 4-high rolling mill wherein the rollers in contact with the intermetallic alloy strip preferably have carbide rolling surfaces. However, any suitable roller construction can be used such as stainless steel rolls. If steel rollers are used, the amount of reduction is preferably limited such that the rolled material does not deform the rollers as a result of work hardening of the intermetallic alloy. The cold rolling step is preferably carried out to reduce the strip thickness by at least 30%, preferably at least about 50%. For instance, the 0.026 inch thick presintered iron aluminide strips can be cold rolled to 0.013 inch thickness in a single cold rolling step with single or multiple passes.

After the cold rolling, the cold rolled strips are subjected to heat creating to anneal the strips. This primary annealing step can be carried out in a vacuum furnace in a batch manner or in a furnace with gases like $H_2$, $N_2$ and/or Ar in a continuous manner and at a suitable temperature to relieve stress and/or effect further densification of the powder. In the case of iron aluminide, the primary annealing can be carried at any suitable temperature such as 1652–2372° F. (900 to 1300° C.), preferably 1742–2102° F. (950 to 1150° C.) for one or more hours in a vacuum furnace. For example, the cold rolled iron aluminide strip can be annealed for one hour at 2012° F. (1100° C.) but surface quality of the sheet can be improved in the same or different heating step by annealing at higher temperatures such as 2300° F. (1260° C.) for one hour.

After the primary annealing step, the strips can be optionally trimmed to desirable sizes. For instance, the strip can be cut in half and subjected to further cold rolling and heat treating steps.

In the next step, the primary rolled strips are cold rolled to reduce the thickness thereof. For instance, the iron aluminide strips can be rolled in a 4-high rolling mill so as to reduce the thickness thereof from 0.013 inch to 0.010 inch. This step achieves a reduction of at least 15%, preferably about 25%. However, if desired, one or more annealing steps can be eliminated, e.g., a 0.024 inch strip can be primary cold rolled directly to 0.010 inch. Subsequently, the secondary cold rolled strips are subjected to secondary sintering and annealing. In the secondary sintering and annealing step, the strips can be heated in a vacuum furnace in a batch manner or in a furnace with gases like $H_2$, $N_2$ and/or Ar in a continuous manner to achieve full density. For example, a batch of the iron aluminide strips can be heated in a vacuum furnace to a temperature of 2300° F. (1260° C.) for one hour.

After the secondary sintering and annealing step, the strips can optionally be subjected to secondary trimming to shear off ends and edges as needed such as in the case of edge cracking. Then, the strips can be subjected to a third and final cold rolling step wherein the thickness of the strips is further reduced such as by 15% or more. Preferably, the strips are cold rolled to a final desired thickness such as from 0.010 inch to 0.008 inch. After the third or final cold rolling step, the strips can be subjected to a final annealing step in a continuous or batch manner at a temperature above the recrystallization temperature. For instance, in the final annealing step, a batch of the iron aluminide strips can be heated in a vacuum furnace to a suitable temperature such as 2012° F. (1100° C.) for about one hour. During the final annealing the cold rolled sheet is preferably recrystallized to a desired average grain size such as about 10 to 30 $\mu$m, preferably around 20 $\mu$m. Then, the strips can optionally be subjected to a final trimming step wherein the ends and edges are trimmed and the strip is slit into narrow strips having the desired dimensions for further processing into tubular heating elements. Finally, the trimmed strips can be subjected to a stress relieving heat treatment to remove thermal vacancies created during the previous processing steps. The stress relief treatment increases ductility of the strip material (e.g., the room temperature ductility can be raised from around 1% to around 3–4%). In the stress relief heat treatment, a batch of the strips can be heated in a furnace at atmospheric pressure or in a vacuum furnace. For instance, the iron aluminide strips can be heated to around 1292° F. (700° C.) for two hours and cooled by slow cooling in the furnace (e.g., at ≦2–5° F./min) to a suitable temperature such as around 662° F. (350° C.) followed by quenching. During stress relief annealing it is preferable to maintain the iron aluminide strip material in a temperature range wherein the iron aluminide is in the B2 ordered phase.

The stress relieved strips can be processed into tubular heating elements by any suitable technique. For instance, the strips can be laser cut, mechanically stamped or chemical photoetched to provide a desired pattern of individual heating blades. For instance, the cut pattern can provide a series of hairpin shaped blades extending from a rectangular base portion which when rolled into a tubular shape and joined provides a tubular heating element with a cylindrical base and a series of axially extending and circumferentially spaced apart heating blades. Alternatively, an uncut strip could be formed into a tubular shape and the desired pattern cut into the tubular shape to provide a heating element having the desired configuration.

Figure 18A:
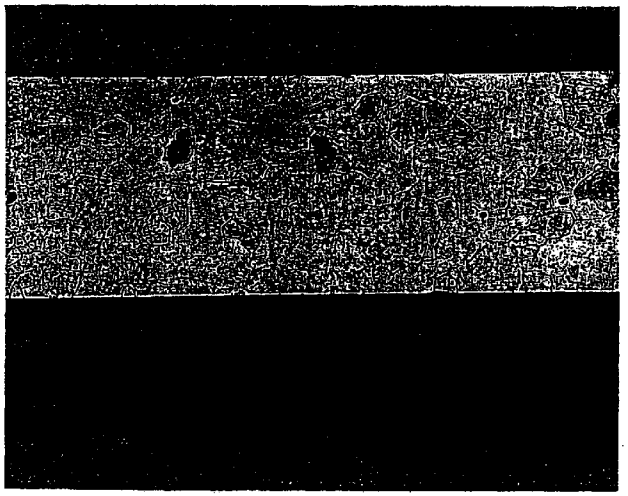
FIGS. 18*a–b* show optical micrographs of roll compacted, cold rolled and annealed sheet in accordance with the invention.
Figure 18B:
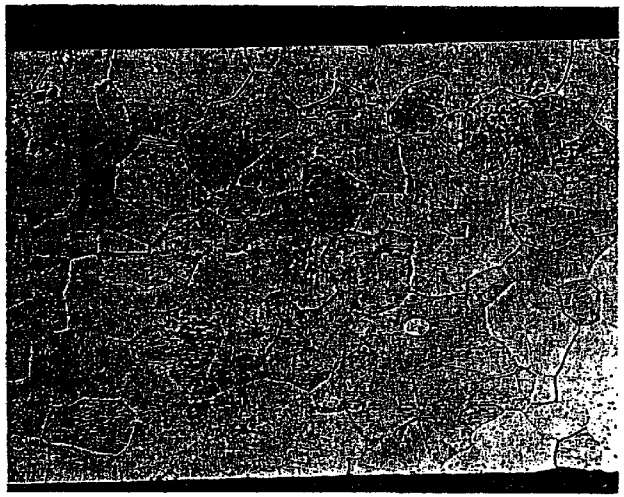

Optical micrographs of 8 mil thick iron aluminide sheet cold rolled from 24 to 12 mil, annealed at 2012° F. (1100° C.) for one hour, cold rolled to 10 mil, annealed at 2012° F. (1100° C.) for one hour, cold rolled to 8 mil and annealed at 2012° F. (1100° C.) for one hour are shown in FIGS. 18*a–b*, FIG. 18*a* showing a magnification at 200× and FIG. 18*b* showing a magnification at 400×. According to a preferred process route, a 24 mil roll compacted sheet is subjected to debinding, sintering at 1260° C. for 40 minutes in vacuum followed by slow cooling, edge trimming, rolling from 24 mil to 12 mil (50% reduction), sintering at 1260° C. for 1 hour, rolled from 12 to 8 mil (33⅓% reduction), and annealing at 1100° C. for 1 hour.

Figure 19A:
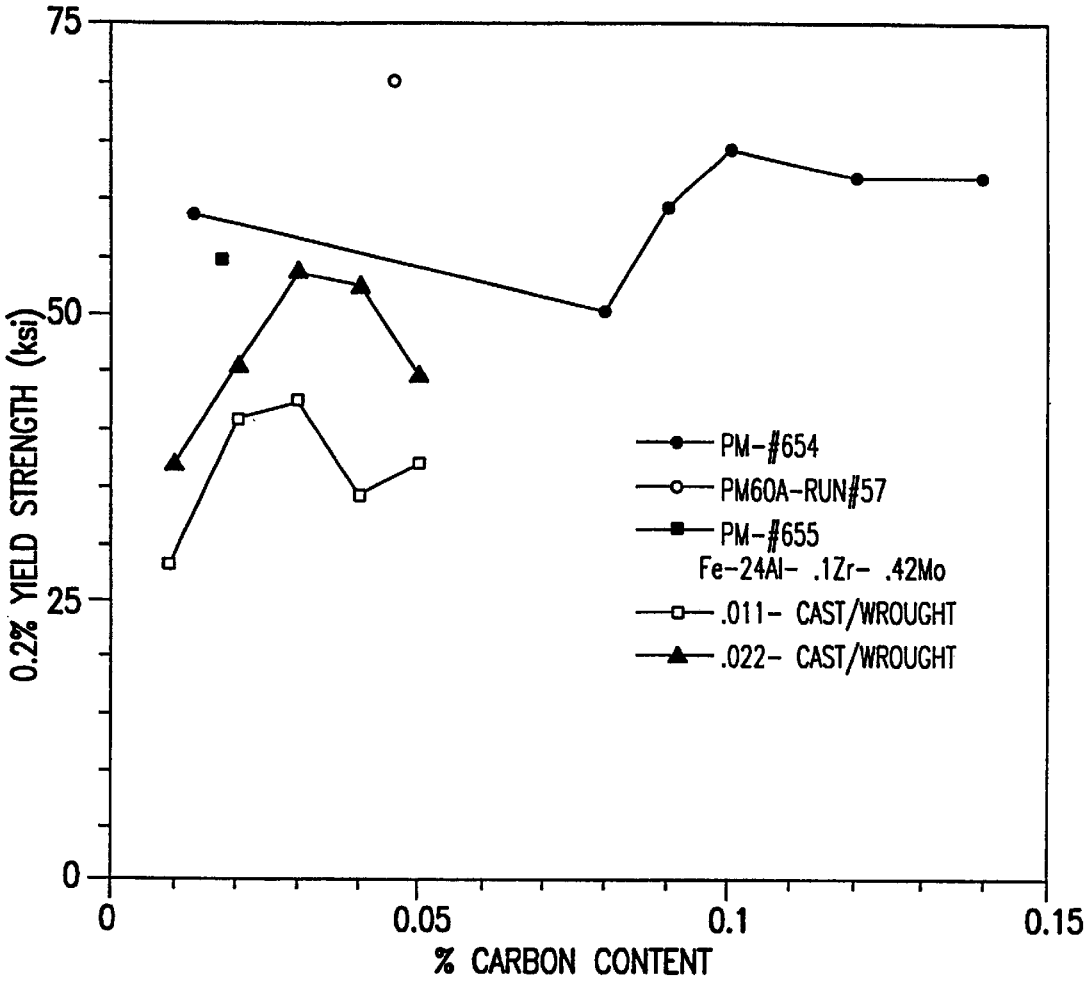
FIGS. 19*a–d* show tensile properties versus carbon content for iron aluminide alloys processed by various techniques.
Figure 19B:
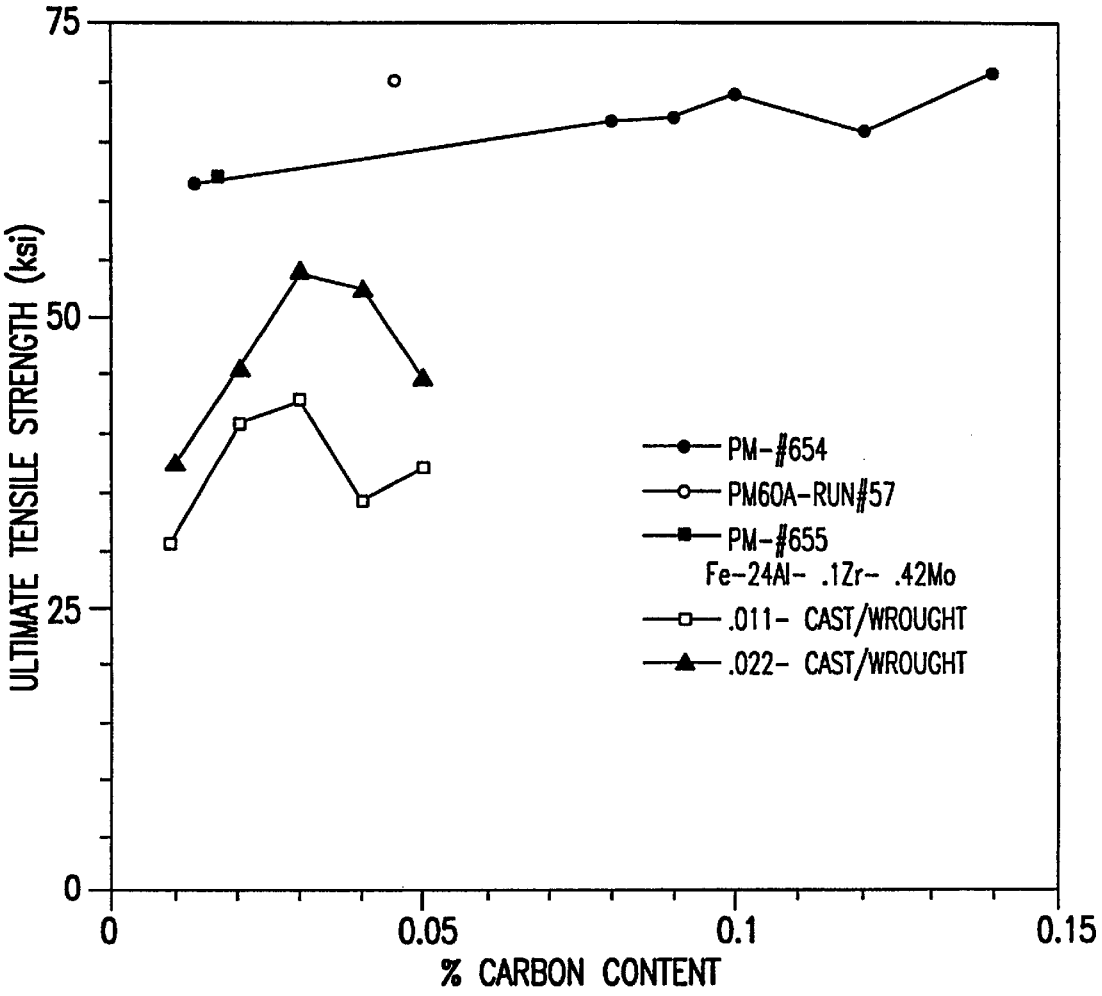
Figure 19C:
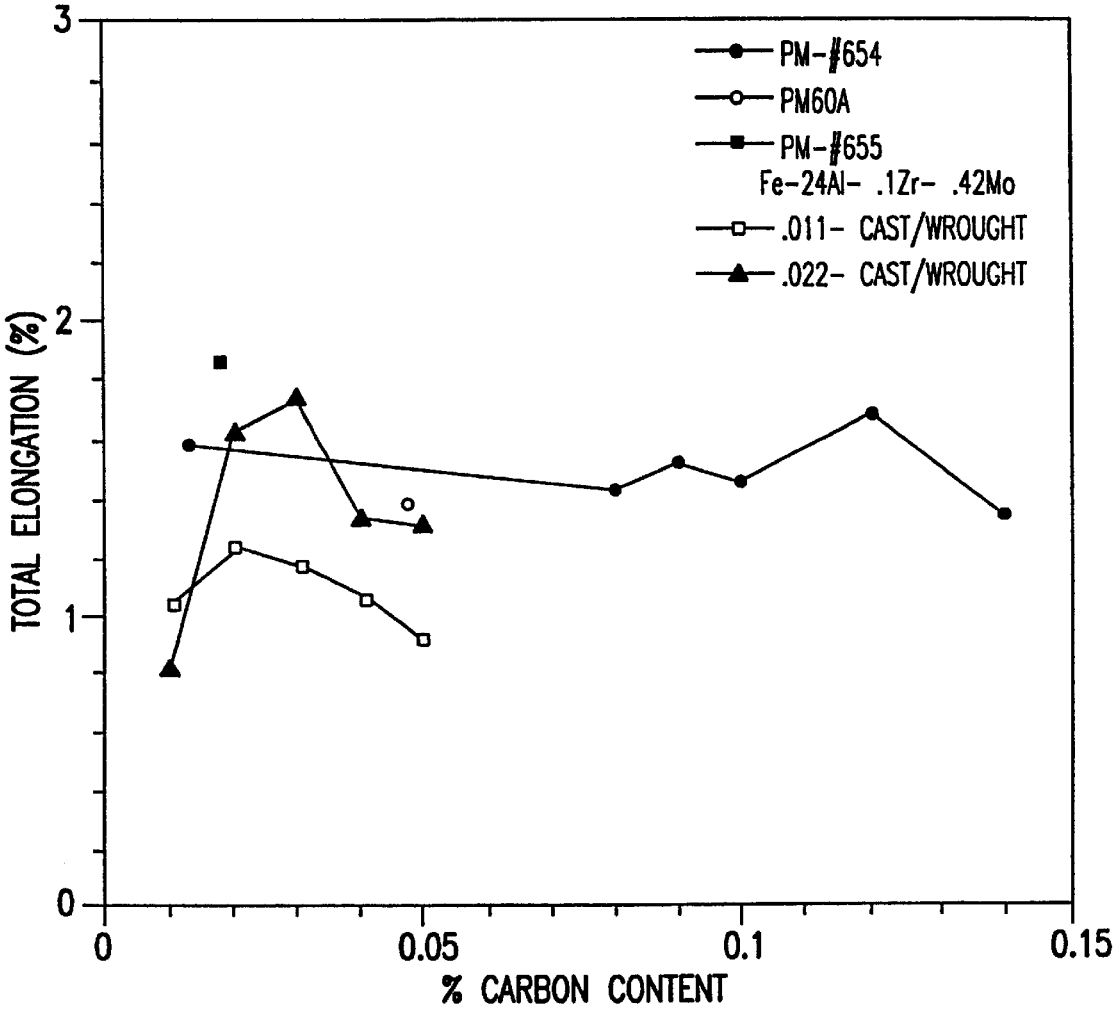
Figure 19D:
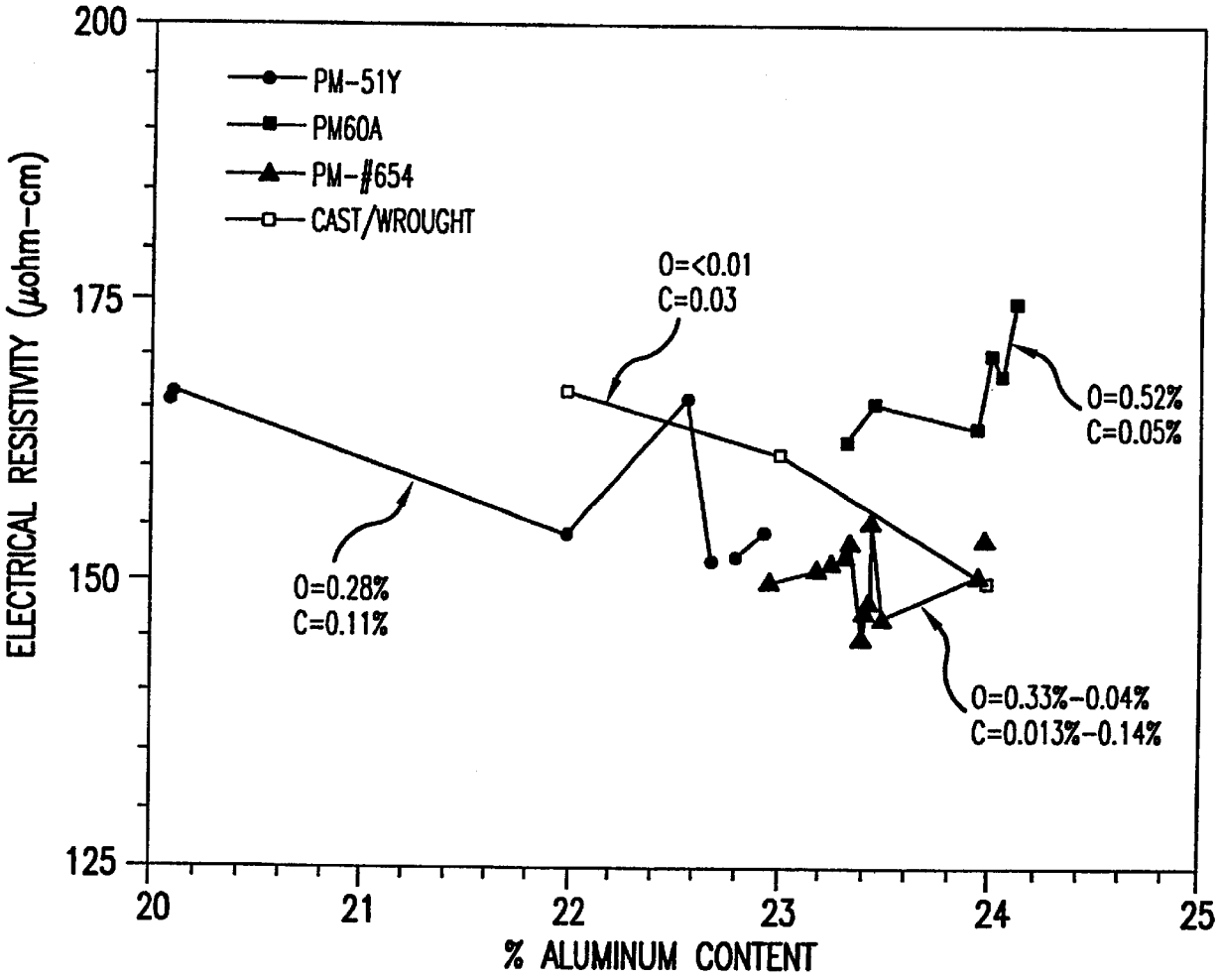

FIGS. 19*a–d* show yield strength, ultimate tensile strength and elongation, respectively as a function of carbon content in the cold rolled sheet material. The PM 60A material was prepared by cold rolling from 24 mil to 12 mil, annealing at 1100° C. for 1 hour, cold rolling from 12 mil to 10 mil, annealing at 1100° C. for 1 hour, cold rolling from 10 mil to 8 mil and annealing at 1100° C. for 1 hour. The 654 material was prepared by cold rolling from 24 mil to 12 mil, annealing at 1100° C. for 1 hour, cold rolling from 12 mil to 10 mil, annealing at 1260° C. for 1 hour, cold rolling from 10 mil to 8 mil and annealing at 1100° C. for 1 hour. As shown in FIG. 19*d*, the 654 material exhibited electrical resistivity 5 points lower than the PM 60A material due to loss of Al during the high temperature (1260° C.) anneal.

To avoid variation in properties of the cold rolled sheet, it is desirable to control porosity, distribution of oxide particles, grain size and flatness. The oxide particles result from oxide coatings on the water atomized powder which break up and are distributed in the sheet during cold rolling of the sheet. Nonuniform distribution of oxide content could cause property variations within a specimen or result in specimen-to-specimen variations. Flatness can be adjusted by tension control during rolling. In general, cold rolled material can exhibit room temperature yield strength of 55–70 ksi, ultimate tensile strength of 65–75 ksi, total elongation of 1–6%, reduction of area of 7–12% and electrical resistivity of about 150–160 $\mu\Omega\cdot$cm whereas the elevated temperature strength properties at 750° C. include yield strength of 36–43 ksi, ultimate tensile strength of 42–49 ksi, total elongation of 22–48% and reduction of area of 26–41%.

The following table sets forth mean and standard deviations of various properties of 8 mil thick sheets of Alloy PM-51Y which includes 23 wt % Al, 0.005% B, 0.42% Mo, 0.1% Zr, 0.2% Y, 0.03% C, balance Fe and impurities at room temperature and at 750° C. The samples were prepared by punching and laser cutting foil material, the laser cutting resulting in lower yield strength due to lower edge working of the samples but higher UTS and elongation values.

TABLE 8a

ROLL COMPACTED, COLD ROLLED AND ANNEALED PM-51Y ROOM TEMPERATURE AND TENSILE DATA

| | Punched Specimens | | Laser cut specimens |
|---|---|---|---|
| Property | Longitudinal | Transverse | Transverse |
| Density (g/cm$^3$) | 6.122 ± 0.025 | 6.122 ± 0.025 | 6.122 ± 0.025 |
| Electrical resistivity ($\mu\Omega$cm) | 156.16 ± 3[a] | 156.16 ± 3[b] | 150.11 ± 1.5 |
| Yield Strength (ksi) | 58.9 ± 3.5 | 61.8 ± 1.8 | 61.37 ± 3.0 |
| Ultimate (Tensile Strength (ksi) | 62.2 ± 1.1 | 63.1 ± 1.0 | 74.29 ± 2.25 |
| Total elongation (%) | 1.98 ± 0.2 | 1.74 ± 0.4 | 2.56 ± 0.40 |

[a]All sheets were produced from water-atomized powder and powder rolling process.
[b]Average of longitudinal and transverse.

TABLE 8b

ROLL COMPACTED, COLD ROLLED AND ANNEALED PM-51Y 750° C. TEST TEMPERATURE AND TENSILE DATA

| | Punched Specimens | | Laser cut specimens |
|---|---|---|---|
| Property | Longitudinal | Transverse | Transverse |
| Yield Strength (ksi) | — | — | 44.23 ± 0.70 |
| Ultimate Tensile Strength (ksi) | — | — | 46.41 ± 0.50 |
| Total elongation (%) | — | — | 28.29 ± 5.0 |
| Creep (%/h), (750° C./3 ksi) | — | — | 1.87 × 10 − 5 in./in. |

Tape Casting

Figure 20:
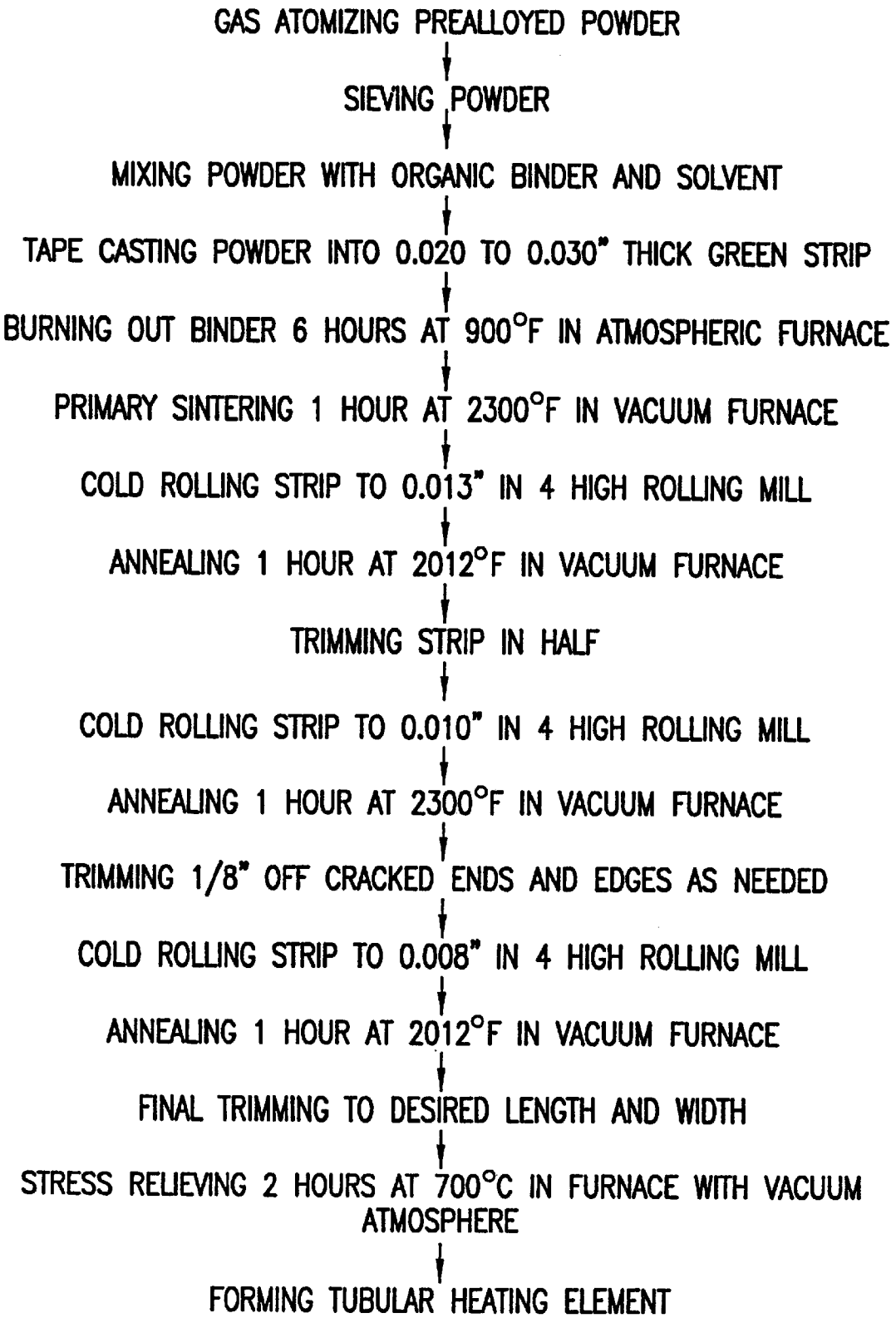
FIG. 20 shows a flow chart of processing steps incorporating a tape casting step in accordance with the invention.

In the tape casting process according to the invention, a prealloyed powder is processed according to the exemplary flow chart set forth in FIG. 20. Tape casting is a well known technology which has been used for many applications such as in the manufacture of ceramic products as disclosed in U.S. Pat. Nos. 2,582,993; 2,966,719; and 3,097,929. Details of the tape casting process can be found in an article by Richard E. Mistler, Vol. 4 of the *Engineered Materials Handbook* entitled "Ceramics and Glasses", 1991 and in an article by Richard E. Mistler entitled "Tape Casting: The Basic Process for Meeting the Needs of the Electronics Industry" in *Ceramic Bulletin*, Vol. 69, No. 6, 1990, the disclosures of which are hereby incorporated by reference. According to the invention, tape casting can be substituted for the roll compaction step in the foregoing roll compaction embodiment. However, whereas water or polymer atomized powder is preferred for the roll compaction process, gas atomized powder is preferred for tape casting due to its spherical shape and low oxide contents. The gas atomized powder is sieved as in the roll compaction process and the sieved powder is blended with organic binder and solvent so as to to produce a slip, the slip is tape cast into a thin sheet and the tape cast sheet is cold rolled and heat treated as set forth in the roll compaction embodiment.

The following nonlimiting examples illustrate various aspects of the tape casting process.

The binder-solvent selection can be based on various factors. For instance, it is desirable for the binder to form a tough, flexible film when present in low concentrations. Further, the binder should volatize and leave as little as possible residue. With respect to storage, it is desirable for the binder to not be adversely affected by ambient conditions. Moreover, for process economy it is desirable that the binder be relatively inexpensive and that the binder be soluble in an inexpensive, volatile, non-flammable solvent in the case of organic solvents. The choice of binder may also depend on the desired thickness of the tape, the casting surface on which the tape is deposited and the desired solvent. Typical binder-solvent-plasticizer systems for tape casting tapes having a thickness greater than 0.010 inch can include 3.0% polyvinyl butyl as the binder (e.g., Butvar Type B-76 manufactured by Monsanto Co., St. Louis, Mo.), 35.0% toluene as the solvent and 5.6% polyethyleneglycol as the plasticizer. For a tape having a thickness less than 0.010 inch, the system can include 15.0% vinyl chloride-acetate as the binder (e.g., VYNS, 90-10 vinyl chloride-vinyl acetate, copolymer supplied by Union Carbide Corporation), 85.0% MEK as the solvent and 1.0% butylphthalate as the plasticizer. In the foregoing compositions, the amounts are in parts by weight per 100 parts prealloyed powder.

Tape casting additives include the following non-aqueous and aqueous additives. For non-aqueous additives, solvents include acetone, ethyl alcohol, benzene, bromochloromethane, butanol, diacetone, isopropanol, methyl isobutyl ketone, toluene, trichloroethylene, xylene, tetrachloroethylene, methanol, cyclohexanone, and methyl ethyl ketone (MEK); binders include cellulose acetate-butyrate, nitrocellulose, petroleum resins, polyethylene, polyacrylate esters, poly methyl-methacrylate, polyvinyl alcohol, polyvinyl butyral, polyvinyl chloride, vinyl chloride-acetate, ethyl cellulose, polytetrafluoroethylene, and poly-α-methyl styrene; plasticizers include butyl benzyl phthalate, butyl stearate, dibutyl phthalate, dimethyl phthalate, methyl abietate, mixed phthalate esters, polyethylene glycol, polyalkylene glycol, triethylene glycol hexoate, tricresyl phosphate, dioctyl phthalate, and dipropylglycol dibenzoate; and deflocculants/wetting agents include fatty acids, glyceryl trioleate, fish oil, synthetic surfactants, benzene sulfonic acid, oil-soluble sulfonates, alkylaryl polyether alcohols, ethyl ether of polyethylene glycol, ethyl phenyl glycol, polyoxyethylene acetate, polyoxyethylene ester, alkyl ether of polyethylene glycol, oleic acid ethylene oxide adduct, sorbitan trioleate, phosphate ester, and steric acid amide ethylene oxide adduct. For aqueous additives wherein the solvent is water, binders include acrylic polymer, acrylic polymer emulsion, ethylene oxide polymer, hydroxy ethyl cellulose, methyl cellulose, polyvinyl alcohol, tris isocyaminate, wax emulsions, acrylic copolymer latex, polyurethane, polyvinyl acetate dispersion; deflocculants/wetting agents include complex glassy phosphate, condensed arylsulfonic acid, neutral sodium salt, polyelectrolyte of the ammonium salt type, non-ionic octyl phenoxyethanol, sodium salt of polycarboxylic acid, and polyoxyethylene onyl-phenol ether; plasticizers include butyl benzyl phthalate, di-butyl phthalate, ethyl toluene sulfonamides, glycerine, polyalkylene glycol, triethylene glycol, tri-N-butyl phosphate, and polypropylene glycol; and defoamers can be wax based and silicone based.

A series of experiments were performed to provide a variety of tape thicknesses with various metal powder/binder/plasticizer systems. The prealloyed metal powder was PM-51Y which included about 23 wt % Al, 0.005% B, 0.42% Mo, 0.1% Zr, 0.2% Y, 0.03% C, balance Fe and impurities.

Batch AFA-15:

2200 grams Fe—Al PM-51Y Powder, −325 mesh
103 grams Methyl Ethyl Ketone (MEK)
176.4 grams B72/MEK (50:50 weight ratio)
17.6 grams Dibutyl Phthalate Plasticizer Procedure:

1. Weigh and add all ingredients to a one liter high density polyethylene (HDPE) jar which is ¼ filled with zirconia grinding media.
2. Mix 24 hours by rolling on a ball mill roller.
3. Pour into a beaker and de-air in a vacuum desiccator for 8 minutes at 25 in. Hg.
4. Measure the viscosity using a Brookfield Viscometer, RV4 spindle at 20 RPM.
5. Tape cast:

Doctor Blade Gap=0.038 inch
Carrier=S1P 75, silicone coated Mylar
Carrier Speed=20 inches/min.
Air on low, no heat, 4.5 inch. wide blade Results:

The viscosity was 3150 cp at 25° C. and the 4.5 inch wide tape cast strip was produced without significant welling. After drying overnight, the tape was flexible and released from the carrier easily without signs of cracking. The average strip thickness was about 0.025 inch.

Batch AFA16:

2200 grams Fe—Al PM-51Y Powder, −325 mesh
103 grams Methyl Ethyl Ketone (MEK)
176.4 grams B72/MEK (50:50 weight ratio)
17.6 grams Dibutyl Phthalate Plasticizer Procedure:

1. Weigh and add all ingredients to 2000 ml HDPE jar which is ¼ filled with zirconia media.
2. Mix for 24 hours by rolling on a ball mill roller
3. Pour into a beaker and de-air in a vacuum desiccator for eight minutes at 25 inches of Hg.
4. Measure the viscosity using a Brookfield Viscometer, RV4 spindle at 20 RPM.
5. Tape cast as follows:

Doctor Blade Gap=0.041 inch
Carrier=S1P 75, silicone coated Mylar
Carrier Speed=20 inches/min.
Air on low, no heat, 4.5 inch wide blade Results:

The viscosity was 3300 cp at 26.3° C. and the 4.5 inch wide tape cast strip was produced without significant welling. After drying overnight, the tape was flexible and released from the carrier easily without signs of cracking. The average strip thickness was about 0.0277 inch.

Batch AFA-17:

2505.6 grams Fe—Al PM-51Y Powder, −325 mesh with carbon added.
117.3 grams Methyl Ethyl Ketone (MEK)
200.9 grams B72/MEK (50:50 weight ratio)
20.0 grams Dibutyl Phthalate Plasticizer Procedure:

1. Weigh and add all ingredients to a 2000 ml HDPE jar which is ¼ filled with zirconia media.
2. Mix for 24 hours by rolling on a ball mill roller.
3. Pour into a beaker and de-air in a vacuum desiccator for 8 minutes at 25 in. Hg.
4. Measure the viscosity using a Brookfield Viscometer, RV-4 Spindle, 20 RPM.
5. Tape cast as follows:

Doctor Blade Gap=0.041 inch
Carrier=S1P 75, silicone coated Mylar Carrier
Carrier Speed=20 inches/min.
Air on low, no heat, 4.5 inch wide blade Results:

The viscosity was 2850 cp at 31° C. and the 4.5 inch wide tape cast strip was produced very slight welling downstream of the doctor blade. After drying overnight, the tape was flexible and released from the carrier easily without signs of cracking. The average strip thickness was about 0.027 inch.

Batch AFA-18:

2200 grams Fe—Al PM-51Y Powder, −325 mesh
103 grams MEK
176.4 grams B72/MEK (50:50 weight ratio)
17.6 grams Dibutyl Phthalate Plasticizer Procedure:

1. Weigh and add all ingredients to a 2000 ml HDPE jar which is ¼ filled with zirconia media.
2. Mix for 24 hours by rolling on a ball mill roller.
3. Pour into a beaker and de-air in a vacuum desiccator for eight minutes at 25 inches of Hg.
4. Measure the viscosity using a Brookfield Viscometer, RVA4 Spindle, 20 RPM.
5. Tape cast as follows:

Doctor Blade Gap=0.041 inch

Carrier=S1P 75, silicone coated Mylar

Carrier Speed=20 inches/min.

Air on low, no heat, 4.5 inch wide blade

Results:

The viscosity was 5250 cp at 27.7° C. and the 4.5 inch wide tape cast strip was produced without significant welling. After drying overnight, the tape was flexible and released from the carrier easily without signs of cracking. The average strip thickness was about 0.0268 inch.

Figure 21A:
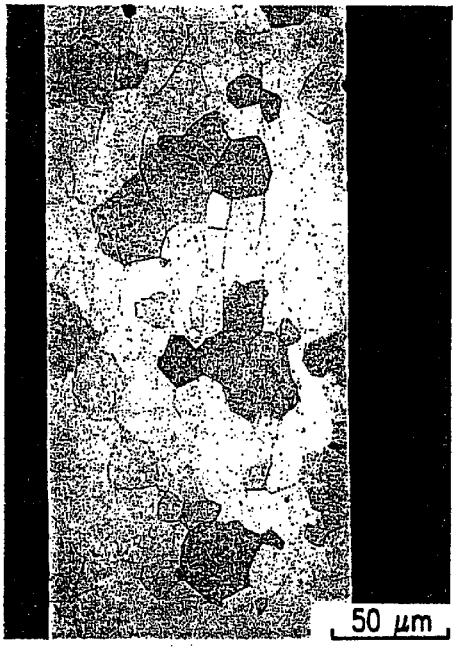
FIGS. 21*a–b* show optical micrographs of tape cast, cold rolled and annealed sheet in accordance with the invention.
Figure 21B:
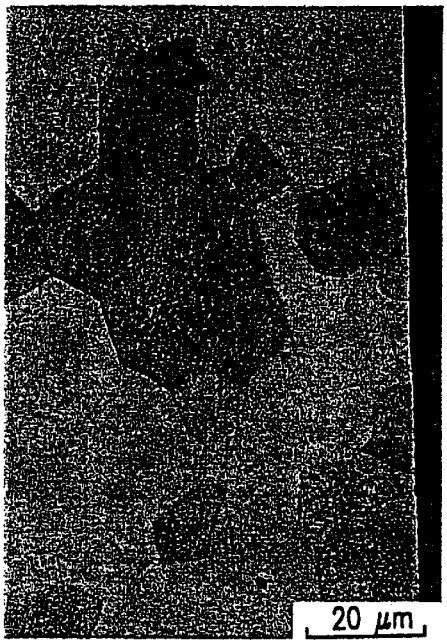
Figure 22:
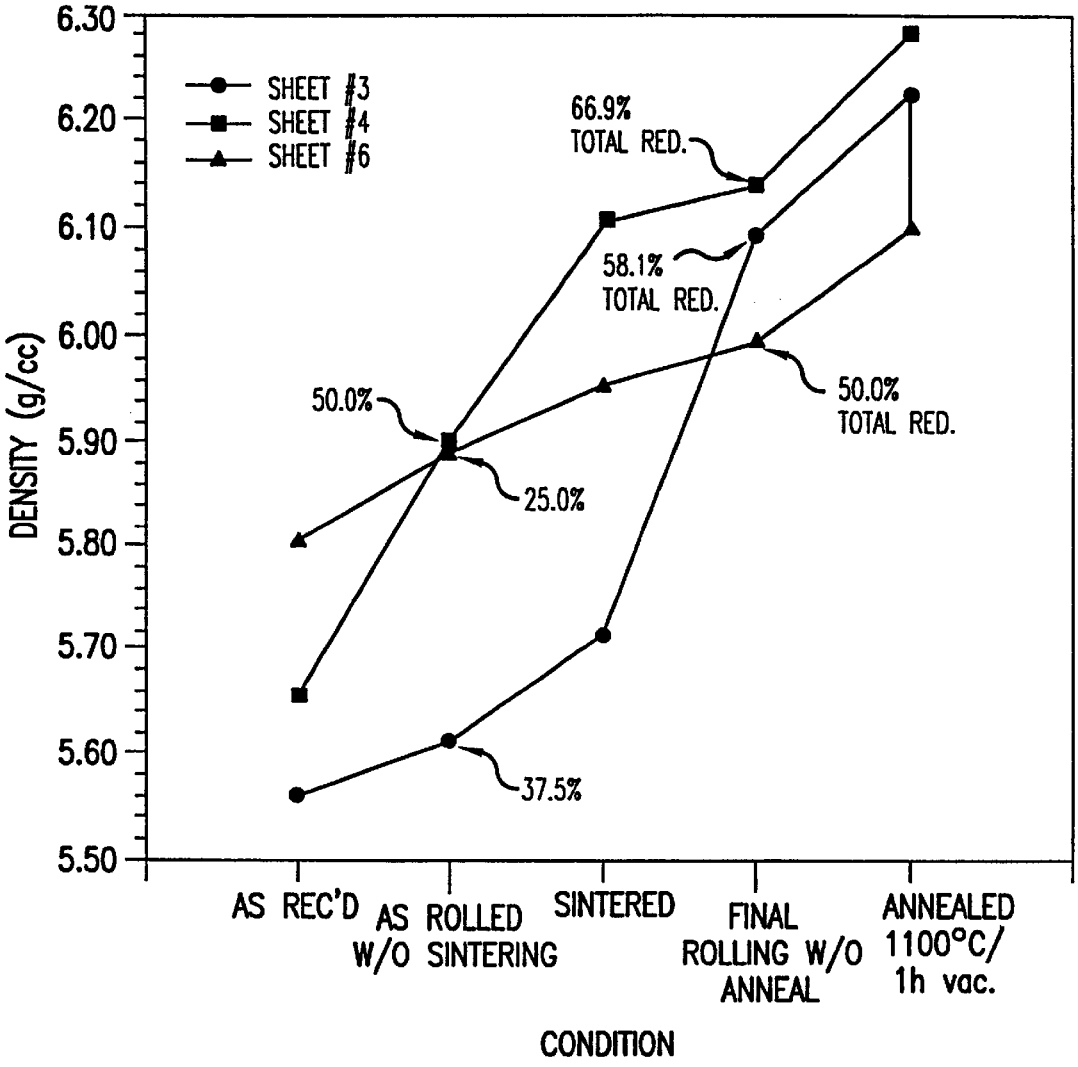
FIG. 22 shows variations in density of tape cast iron aluminide sheet as a function of various processing steps according to the invention.

Optical micrographs of 5.3 mil thick iron aluminide sheet cold rolled from 16 to 8 mil, annealed at 1260° C. for one hour, cold rolled to 5.3 mil and annealed at 1100° C. for one hour are shown in FIGS. 21*a–b*, FIG. 21*a* showing a magnification at 400× and FIG. 21*b* showing a magnification at 1000×. FIG. 22 shows variation in density of the tape cast material as a function of processing in the as-received, as-cold rolled without sintering, sintered, final cold rolled without annealing and final annealed condition.

The following tables include tensile and electrical resistivity data on examples AFA-15 through AFA-18. The testing was carried out at room temperature and at 750° C. for all of the sheets in the as-annealed condition at 1150° C. for 1 hour. The data shows that AFA-15 has the best high-temperature strength properties.

TABLE 9a

TAPE CAST AFA-15 THROUGH AFA-18 ROOM TEMPERATURE TENSILE DATA

| Material/ Heat Treatment | Yield Strength (ksi) | Tensile Strength (ksi) | Total Elongation (%) | Reduction of Area (%) | Electrical Resistivity ($\mu\Omega \cdot$ cm.) |
|---|---|---|---|---|---|
| AFA-15 Ann. 1150° C./1 h | 59–63 | 63.64 | 1–1.8 | 6.5–7.5 | 148–151 |
| AFA-16 Ann. 1150° C./1 h | 56–61 | 60–62 | 1.5–1.8 | 6–9 | 149–150 |
| AFA-17 Ann. 1150° C./1 h | 59–62 | 61–62 | 1.60–1.80 | 7.41 | 145.5–150 |
| AFA-18 Ann. 1150° C./1 h | 53–58 | 59–61 | 1.40–2.0 | 7.5–12.5 | 148.5–149.5 |

Strain Rate: 0.2"/min.
Tested in as rec'd condition

TABLE 9b

TAPE CAST AFA-15 THROUGH AFA-18 750° C. TENSILE DATA

| Material/ Heat Treatment | Yield Strength (ksi) | Tensile Strength (ksi) | Total Elongation (%) | Reduction of Area (%) | Electrical Resistivity ($\mu\Omega \cdot$ cm.) |
|---|---|---|---|---|---|
| AFA-15 Ann. 1150° C./1 h | 47–49 | 49–50 | 30–32 | 24–27 | — |
| AFA-16 Ann. 1150° C./1 h | 42–44 | 44–45 | 17–40 | 26–33 | — |
| AFA-17 Ann. 1150° C./1 h | 41–43 | 44–45 | 42–51 | 34–39 | — |
| AFA-18 Ann. 1150° C./1 h | 43–45 | 44–46 | 31–48 | 33–38 | — |

Strain Rate: 0.2"/min.
Tested in as rec'd condition

Plasma Spraying

Figure 23:
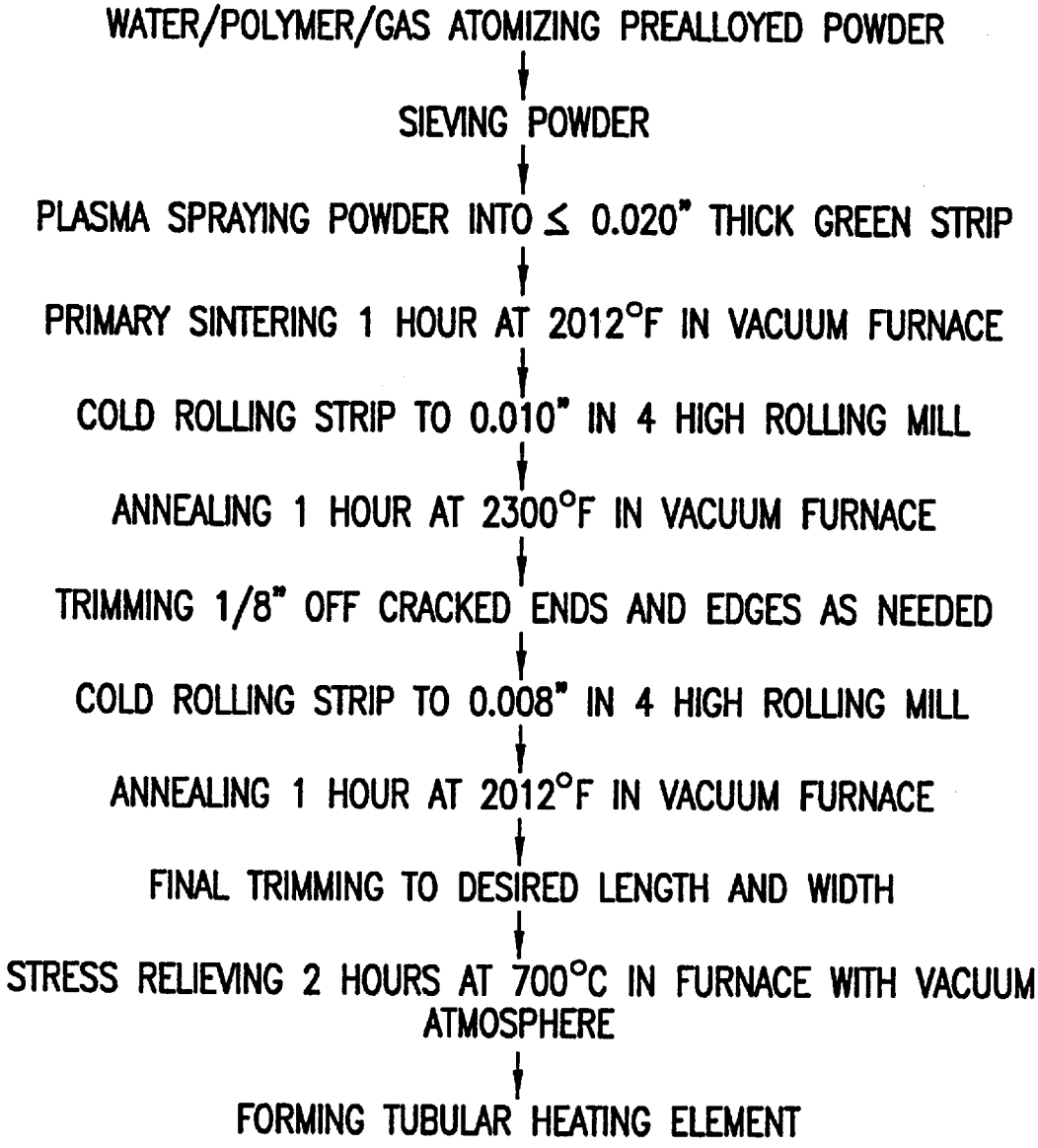
FIG. 23 shows a flow chart of processing steps incorporating a plasma spraying step in accordance with the invention.

In the plasma spraying process according to the invention, a prealloyed powder is processed according to the exemplary flow chart set forth in FIG. 23. According to this embodiment, non-densified metallic sheets are prepared by a plasma spraying technique. According to the invention, powders of an intermetallic alloy like are sprayed into sheet form using a known plasma spray deposition technique. The sprayed droplets are collected and solidified on a substrate in the form of a flat sheet which is cooled by a coolant on the opposite thereof. The spraying can be carried out in vacuum, an inert atmosphere or in air. The sprayed sheets can be provided in various thicknesses and because the thicknesses can be closer to the final desired thickness of the sheet, the thermal spraying technique offers advantages over the roll compaction and tape casting techniques in that the final sheet can be produced with fewer cold rolling and annealing steps.

Details of conventional thermal spraying processes can be found in an article by K. Murakami et al., entitled "Thermal Spraying as a Method of Producing Rapidly Solidified Materials", pages 351–355, *Thermal Spray Research and Applications*, proceedings of the Third National Spray Conference, Long Beach, Calif., May 20–25, 1990 and in an article by A. G. Leatham et al., entitled "The Osprey Process: Principles and Applications", the *International Journal of Powder Metallurgy*, Vol. 29, No. 4, pages 321–351, 1993, the disclosures of which are hereby incorporated by reference. Thermal spraying is a known process for depositing metallic and nonmetallic coatings by processes which include the plasma-arc spray, electric arc spray and flame spray processes. The coatings can be sprayed from rod or wire stock or from powdered material. In the basic plasma-arc spray system, variables such as power level, pressure and flow of the arc gases, the rate of flow of powder and carrier gas can be controlled. The spray-gun position and gun-to-work distance can be preset and the movement of the workpiece controlled by automated or semi-automated tooling. In the electric-arc spray process, two electrically opposed charged wires are fed together to provide a controlled arc and molten metal is atomized and propelled onto a substrate by a stream of compressed air or gas. In the flame spray process, a combustible gas is used as a heat source to melt the coating material and the sprayed material can be provided in rod, wire or powder form.

The Murakami article discloses that rapidly solidified materials of iron base alloys can be produced by low pressure plasma spraying deposited layers on water-cooled substrates or on uncooled substrates, the deposited layers having a thickness of 0.7 to 2.5 mm. The Leatham article discloses spray forming techniques for preparing tubular and round billets from specialty steels, superalloys, aluminum alloys and copper alloys. The Leatham article also mentions that cylindrical disks or billets up to 300 mm in diameter by 1 meter height can be made by scanning the spray across a rotating disk collector, sheet up to 1 mm in width and greater than 5 mm in thickness can be produced in a semi-continuous fashion by scanning the spray across the width of a horizontal belt, and tubular products can be fabricated by deposition onto a rotating preheated mandrel which is traversed across the spray. According to the invention, the thermal spray process is used to produce a strip of an intermetallic alloy composition which can then be cold rolled and heat treated to produce a strip having a desired final thickness.

In a preferred plasma spraying technique according to the invention, a strip having a width such as 4 or 8 inches is prepared by depositing gas, water or polymer atomized prealloyed powder on a substrate by moving a plasma torch back and forth across a substrate as the substrate moves in a given direction. The strip can be provided in any desired thickness such as up to 0.1 inch. In plasma spraying, the powder is atomized such that the particles are molten when they hit the substrate. The result is a highly dense (e.g., over 95% dense) film having a smooth surface. In order to minimize oxidation of the molten particles, a shroud can be used to contain a protective atmosphere such as argon or nitrogen surrounding the plasma jet. However, if the plasma spray process is carried out in air, oxide films can form on the molten droplets and thus lead to incorporation of oxides in the deposited film. The substrate is preferably a stainless steel grit blasted surface which provides enough mechanical bonding to hold the strip while it is deposited but allows the strip to be removed for further processing. According to a preferred embodiment, an iron aluminide strip is sprayed to a thickness of 0.020 inch, a thickness which can be cold rolled to 0.010 inch, heat treated, cold rolled to 0.008 inch and subjected to final annealing and stress relief heat treating.

In general, the thermal spraying technique provides a denser sheet than is obtained by tape casting or roll compaction. Of the thermal spray techniques, the plasma spraying technique allows use of water, gas or polymer atomized powder whereas the spherical powder obtained by gas atomization does not compact as well as the water atomized powder in the roll compaction process. Compared to tape casting, the thermal spraying process provides less residual carbon since it is not necessary to use a binder or solvent in the thermal spraying process. On the other hand, the thermal spray process is susceptible to contamination by oxides. Likewise, the roll compaction process is susceptible to oxide contamination when using water atomized powder, i.e., the surface of the water quenched powder may have surface oxides whereas the gas atomized powder can be produced with little or no surface oxides.

The following examples illustrate various aspects of the thermal spray process.

A series of tests were carried out using powder of various particle sizes. The powder was a gas atomized prealloyed powder of alloy PM-60 which includes 26 wt % Al, 0.42 wt % Mo, 0.1 wt % Zr, 0.005 wt % B, 0.03 wt % C, balance Fe and unavoidable impurities.

| | Powder | Notes |
|---|---|---|
| Series A | −200/+400 Mesh | |
| Series B | −140/+400 Mesh | |
| Series C | −100/+400 Mesh | |
| Series D | −100/+400 Mesh | Higher Enthalpy Parameter |
| Series E | −100/+400 Mesh | No-Shroud, D Parameter |

Three sizes of the PM-60 gas atomized powder were used. The first cut −200 mesh/+400 mesh produced an approximate yield of 30%. The second cut −140 mesh/+400 mesh produced an approximate yield of 50%. The third cut −100 mesh/+400 mesh produced an approximate yield of 80%.

Sheets were produced by coating the face of steel plates that were roughened by grit blasting and the coating was removed after the proper thickness had been deposited. The degree of roughening needed was found to be dependent on the coating parameters and the thickness of the sheet desired. If the surface was roughened excessively, the coating could not be removed from the substrate at the desired thickness. If the surface was not roughened sufficiently, the sheet would delaminate from the substrate before the desired thickness was achieved. Preparation of the surface was a difficult parameter to control.

The coating was deposited by rastering the plasma torch in an X-Y pattern until the desired thickness was obtained. The estimated target efficiency of the various series was 30% for Series A, 22% for Series B, 15% for Series C, 25% for Series D, and 25% for Series E. These values are low since the shrouded plasma system used in the tests had previously been developed for use with finer particle powder and the X-Y rastering pattern was rather inefficient with respect to target efficiencies. Target efficiency is defined as the amount of powder deposited divided by the total amount sprayed. For the total efficiency, the effective yield of the powder used must also be taken into account. For sheet production, rotating mandrels could be used to increase the target efficiency of the deposition and the shrouding device could be modified to be able to process the coarser powders more efficiently. In general, the coatings are 90 to 95% dense and low in apparent oxide content.

The following table sets forth dimensions and density of the plasma sprayed strip material.

TABLE 10

| | Width inch | Length inch | Thick mil | Weight grams | Linear Density g/inch |
|---|---|---|---|---|---|
| A-1 | 3 | 11.5 | 14 | 36.9 | 29.0 |
| A-2 | 3 | 10.5 | 9 | 19 | 31.7 |
| A-3 | 3 | 6 | 15 | 20.5 | 55.6 |
| A-4 | 2 | 11.5 | 14 | 33.7 | 43.5 |
| A-5 | 2 | 11.5 | 15 | 23.3 | 43.5 |
| A-6 | 2 | 11.5 | 14 | 24.1 | 43.5 |
| A-7 | 2 | 11.5 | 14 | 22.4 | 43.5 |
| A-8 | 2 | 11.25 | 22 | 37.4 | 44.4 |
| B-1 | 3 | 11.5 | 14 | 34.6 | 29.0 |
| B-2 | 2 | 11.5 | 13 | 21.8 | 43.5 |
| B-3 | 2 | 6.5 | 13 | 12.7 | 76.9 |
| B-4 | 2 | 8 | 16 | 18.7 | 82.5 |
| B-5 | 2 | 11.5 | 15 | 26.5 | 43.5 |
| C-1 | 3 | 7.5 | 8 | 11.9 | 44.4 |
| C-2 | 3 | 11.5 | 13 | 30.7 | 29.0 |
| C-3 | 2 | 11.5 | 16 | 26.1 | 43.5 |
| C-4 | 2 | 11.5 | 16 | 26 | 43.5 |
| D | 2 | 11.25 | 14 | 20.8 | 44.4 |
| E | 3 | 11.5 | 15 | 37 | 29.0 |

The microstructures of the A series sheets show finer structure than the other sheets. This can be attributed to the finer particle size of the starting powder, i.e., −200/+400 mesh. Sheet A-8 which was the thickest of the sheets has the most laminar structure, possibly due to the degree of rolling. Sheets of the B and C series contain a considerable amount of unmelted or partially melted particles and generally have a lower apparent oxide content than the A series sheets. This can be attributed to the larger particle size powder. Sheet E, which was sprayed without the shrouding device, has the highest amount of apparent oxides. In sheet E, the oxides are present in form of clustered spheres not seen in the other sheets. Sheets 7, 8 and 10 appear similar to sheets B and C. Sheet 14 had a rough surface finish and is not as dense as the other sheets. Sheet 14 apparently, had either not been rolled or had been of insufficient thickness to "clean up" the surface during rolling.

Figure 24:
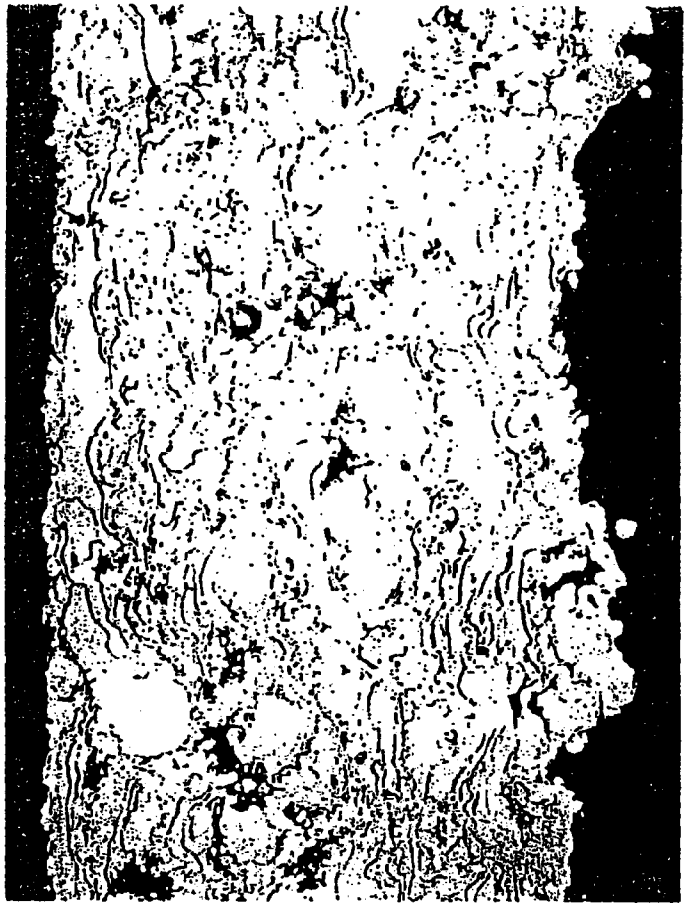
FIG. 24 shows an optical micrograph of a plasma sprayed sheet of iron aluminide in accordance with the invention.
Figure 25A:
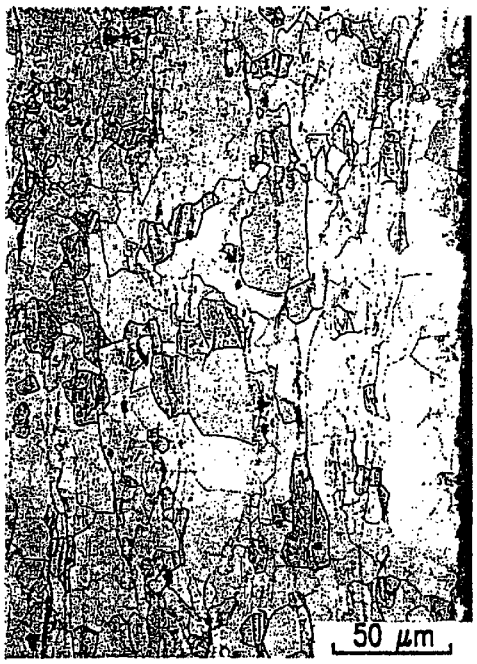
FIGS. 25*a–b* show optical micrographs of plasma sprayed, cold rolled and annealed sheet in accordance with the invention.
Figure 25B:
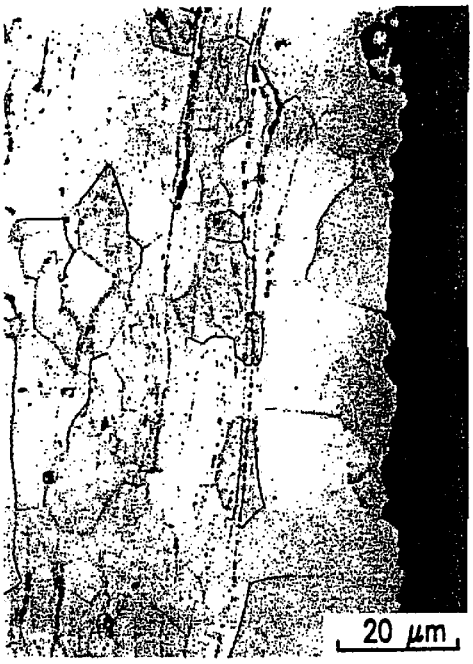
Figure 26:
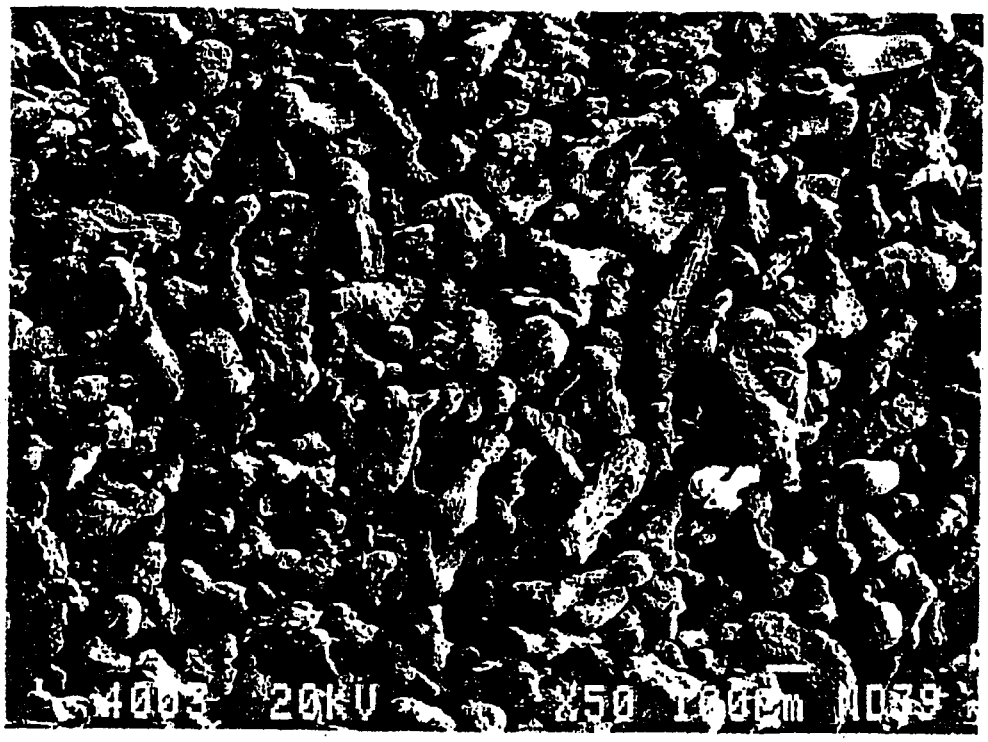
FIG. 26 shows a photomicrograph of polymer atomized powder.

FIG. 24 shows an optical micrograph of an as-sprayed sheet of iron aluminide at 200×. Optical micrographs of 8 mil thick iron aluminide (PM 60) plasma processed sheet annealed at 1100° C. for one hour, cold rolled from 18.9 to 12 mil, annealed at 1260° C. for one hour, cold rolled from 12 to 8 mil and annealed at 1100° C. for one hour are shown in FIGS. 25*a–b*, FIG. 25*a* showing a magnification at 400× and FIG. 25*b* showing a magnification at 1000×.

The following tables provide data such as thickness, finish and strip size of plasma sprayed strip. The strips are divided into 4 groups based on as-sprayed thickness. The thickness measurements listed in the tables are the as-finished thicknesses.

TABLE 11

| ID | Thickness | Finish | Pieces Sprayed |
|---|---|---|---|
| | Group 1) Thickness > 21 mils | | |
| SA-2 | 19 mil | Finish-2 | 2 pcs. 21" × 3" |
| SA-4 | 18 mil | Finish-1 | 2 pcs. 20" × 3" |
| | Group 2) Thickness > 20.5 mils | | |
| SA-1 | 18 mil | Finish-1 | 2 pcs. 20" × 3" |
| SA-5 | 17.5 mil | Finish-2 | 2 pcs. 20" × 3" |
| SA-6 | 18 mil | Finish-2 | 2 pcs. 21" × 3" |
| SA-12 | 17.5 mil | Finish-2 | 2 pcs. 21" × 3" |
| | Group 3) 20 mills > Thickness > 18 mils | | |
| SA-3 | 16 mil | Finish-2 | 2 pcs. 19.5" × 3" |
| SA-8 | 16.5 mil | Finish-1 | 2 pcs. 17" × 3" |
| | | | 1 pc. 5.5" × 3 |
| SA-10 | 14.5 mil | Finish-2 | 1 pc. 14" × 3" |
| SA-11 | 16 mil | Finish-2 | 2 pcs. 21" × 3" |
| | Group 4) Thickness < 18 mils | | |
| SA-7 | — | Finish-1 | 2 pcs. 19" × 3" |
| SA-9 | — | Finish-1 | 1 pc. 24" × 3" |
| | | | 1 pc. 18" × 3" |
| SA-13 | — | Finish-2 | 2 pcs. 16.5" × 3" |
| | | | 1 pc. 8" × 3" |
| SA-14 | 11 mil | Finish-1 | 2 pcs. 16" × 3" |

TABLE 12

As Sprayed Data

| Sample | Thick BM mils | Thick FM mils | Weight g | Length In. | Width In. | Linear Density g/cm |
|---|---|---|---|---|---|---|
| SA-1 | 18.5 | 20.5 | 175.4 | 43.375 | 3 | 4.45 |
| SA-2 | 20 | 22 | 195.3 | 43.375 | 3 | 4.58 |
| SA-3 | 17 | 19 | 161 | 43.375 | 3 | 4.44 |
| SA-4 | 19 | 21 | 181.8 | 43.375 | 3 | 4.49 |
| SA-5 | 18.5 | 20.5 | 179 | 43.5 | 3 | 4.52 |
| SA-6 | 18.5 | 20.5 | 184.9 | 43.25 | 3 | 4.70 |
| SA-7 | 13 | 15 | 121.8 | 43.375 | 3 | 4.39 |
| SA-8 | 17 | 19 | 163.1 | 43.5 | 3 | 4.49 |
| SA-9 | 13 | 15 | 128.8 | 43. | 3 | 4.69 |
| SA-10 | 16 | 18 | 51.9 | 14.75 | 3 | 4.47 |
| SA-11 | 17 | 19 | 162.5 | 43.125 | 3 | 4.51 |
| SA-12 | 18.5 | 20.5 | 179.6 | 43.125 | 3 | 4.58 |
| SA-13 | 14 | 16 | 139.8 | 43 | 3 | 4.72 |
| SA-14 | 11.5 | 13.5 | 110.3 | 43.125 | 3 | 4.52 |

Key
BM = Bell Micrometer, .250 Diameter
FM - Flat Micrometer
Density = Weight/(BM Thick "length" Width in cm)
Finish 1 = "non-dimensional" technique
Finish 2 - "dimensional" technique The following table sets forth properties of plasma sprayed cold rolled and annealed 0.008 inch foil of PM-60.

TABLE 13

COLD ROLLED AND ANNEALED PM60 ROOM TEMPERATURE TENSILE DATA

| Specimen Type | Yield Strength (ksi) | Tensile Strength (ksi) | Total Elongation (%) | Reduction of Area (%) |
|---|---|---|---|---|
| A-1 | 55.85 | 68.59 | 1.20 | 9.15 |
| A-5 | 35.47 | 61.92 | 0.70 | 4.32 |

TABLE 13-continued

COLD ROLLED AND ANNEALED PM60 ROOM TEMPERATURE TENSILE DATA

| Specimen Type | Yield Strength (ksi) | Tensile Strength (ksi) | Total Elongation (%) | Reduction of Area (%) |
|---|---|---|---|---|
| A-8 | 56.61 | 56.80 | 1.10 | 9.10 |
| B-5 | 71.43 | 72.01 | 1.24 | 7.83 |
| B-1 | 67.94 | 73.27 | 1.34 | 6.95 |
| B-1 | 63.99 | 70.54 | 1.44 | 6.47 |
| C-4 | 68.04 | 71.62 | 1.96 | 8.61 |
| C-4 | 70.85 | 71.43 | 1.40 | 6.92 |
| E | 65.64 | 66.67 | 1.00 | 7.87 |
| E | 65.60 | 68.40 | 1.40 | 7.52 |

A: −200/+400 Mesh −0.5 in Specimens
B: −140/+400 Mesh Strain Rate: 0.2"/min.
C: −100/+400 Mesh Final Anneal: 1100° C./1 h Vac.
E: −100/+400 No shroud

Polymer Atomized Powder

Prealloyed polymer atomized powder can be prepared by a liquid atomizing technique using a silica/alumina crucible having a hole in its base for bottom tapping and an alumina corerod as a stopper. The surfaces of the melt hardware wetted by the melt can be coated with a boron nitride paint to avoid contamination of the melt. The periphery of the crucible can be insulated and located on a graphite spacer on top of a melt guide tube which leads into the atomization zone and vessel. The graphite spacer can prevent heat loss at the base of the crucible rather than to provide thermal energy to melt the feedstock. A graphite top can be used on the crucible to reduce heat loss and act as an oxygen getter.

A hydrogen cover gas can be used in the crucible and argon can be used as a shielding gas in the melt guide tube beneath the crucible. As an example, four pre-alloyed bars with a combined weight of approximately 820 grams were used as the total crucible load. The power settings were initially set at 70% (on a 50 kW power supply) and raised to 80% to achieve an indicated temperature of 1550° C. in approximately 20 minutes. The heating rate decreased between 1310° C. and 1400° C. which corresponds well with the solidus and liquidus of this alloy. At 1550° C. the corerod was raised to allow the material to flow from the crucible. The crucible emptied completely with the exception of about 30 grams which was essentially dross.

Four water atomization runs were performed to test the effect of 1) number of atomization nozzles, 2) nozzle angle, and 3) water to metal mass flow ratio. Satisfactory melting was achieved with: 1) silica/alumina crucible; 2) graphite susceptor base; 3) hydrogen cover gas; 4) pre-alloyed bulk feedstock; and 5) alumina core rod/TC sheath. The optimum conditions were based on the maximum of −100 mesh powder yield. It was found that the best yield was achieved with 4 nozzles at 65° at a water to metal mass flow ratio of 20:1. Very similar powder yields and distributions were achieved with water-based polymer quenchant and mineral oil-based quenchant. However, the mineral oil-based quenchant produced the lowest oxygen content in the powder, the increased viscosity of the mineral oil quenchant resulted in lower flow rates for the same pressures. Approximately 5400 grams of −100 powder was produced for testing. The quenchant was decanted from the powder and the powder washed 4 times with kerosene followed by washing 4 times with acetone. The powder was dried under light vacuum at about 50° C. The dried powder was sieved to +/−100 mesh.

In order to disperse a sample in water for the microtrac some emulsifier (soap) was necessary. This indicates that some oil may still remain on the powder despite the numerous solvent washings.

The run information is summarized below.

| | |
|---|---|
| Wt of Alloy in Run, grams | 8656 grams (all from air melt batch) |
| # nozzles | 4 (2 × 0.026", 2 × 0.031") |
| impingement angle | 65° |
| Quenchant flow rate, gpm | 3.5 gpm |
| Quenchant pressure, psi | 2300 |
| time for atomization, sec | ≈630 seconds (cumulative) |
| Quenchant to metal mass ratio | ≈15:1 |
| % −100 mesh | ≈84% (of powder produced) |
| Mean particle size, microns | 74 |
| D90 | 139 |
| D50 | 67 |
| D10 | 25 |

A sample of Fe-26 wt % Al powder was produced using a synthetic quenchant (PAG, polyalkylene glycol).

The melting went well with only a small amount of oxide "skull" remaining in the crucible. Approximately 803 grams of powder were recovered. This was washed twice in water, twice in acetone, dried in a vacuum oven at low heat (less than 50° C.), and sieved to +6 and +/−100 mesh. The −100 mesh fraction was 76% of the total powder collected and a sample of this was subjected to microtrac analysis. The powder characteristics were similar to earlier runs. The +6 mesh powder resulted from allowing the molten metal to run freely into the collection tank for a few seconds prior to turning on the high pressure quenchant. These coarse granules can be used to indicate the composition of the melt prior to the atomization.

The run information is summarized below.

| | |
|---|---|
| Wt of Alloy in run, grams | 871.2 grams (2 bars, several tops) |
| # nozzles | 4 (2 × 0.026", 2 × 0.031") |
| impingement angle | 65° |
| Quenchant flow rate, gpm | 3.2 gpm |
| Quenchant pressure, psi | 2600 |
| time for atomization, sec | ≈60 seconds |
| Quenchant to metal mass ratio | ≈15:1 |
| % −100 mesh | ≈82% (of powder produced) |
| Mean particle size, microns | 75 |
| D90 | 145 |
| D50 | 66 |
| D10 | 19 |

A sample of the Fe-26 wt % Al powder was made with the oil quench. The atomization temperature was approximately 1600° C. The material was melted under hydrogen and the atomization vessel was purged with argon. Some dross remained in the crucible (less than 30 grams).

A 100 gram sample was washed with acetone, dried, sieved to +/−100 mesh, and the −100 mesh fraction subjected to microtrac analysis.

The run information is summarized below.

| | |
|---|---|
| Wt of Alloy in Run, grams | 825.5 grams (2 bars, several tops) |
| # nozzles | 4 (2 × 0.026", 2 × 0.031") |
| impingement angle | 65° |
| Water flow rate, gpm | 4.1 gpm |
| Water pressure, psi | 2500 |

-continued

| | |
|---|---|
| time for atomization, sec | ≈70 seconds |
| oil to metal mass ratio | ≈20:1 |
| % −100 mesh | ≈80% |
| Mean particle size, microns | 78 |
| D90 | 134 |
| D50 | 76 |
| D10 | 23 |

Poperties of FeAl Powder

Figure 27:
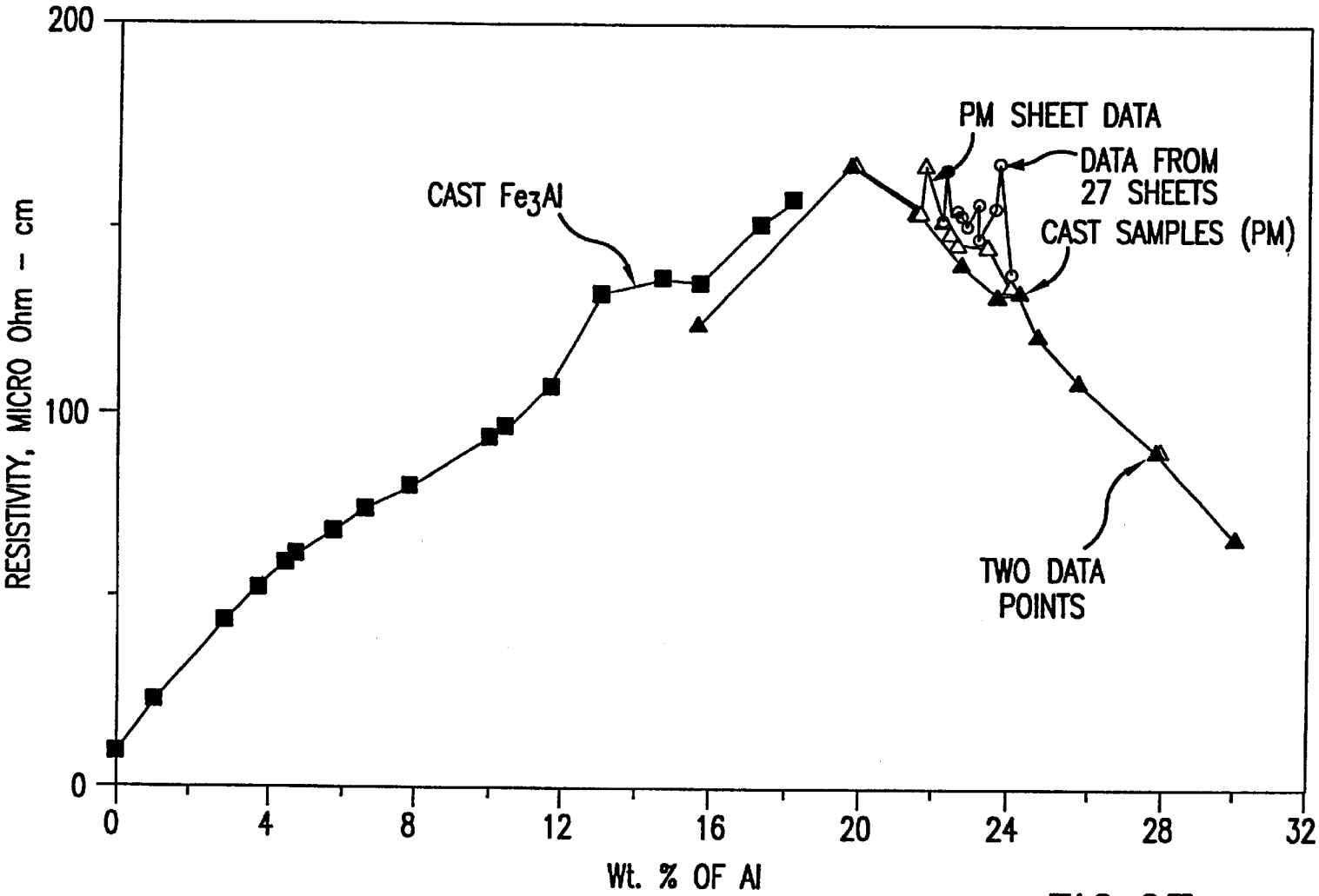
FIG. 27 is a graph of electrical resistivity versus aluminum content in Fe—Al alloys wherein a peak in resistivity occurs at about 20 wt % Al.

Various properties of FeAl powder were compared to cast samples as follows. Samples evaluated include cast samples of $Fe_3Al$ which were cold rolled and fully annealed at 1260° C. and FeAl samples prepared by a powder metallurgical technique wherein 0.022 inch thick sheet was subjected to binder burnout, cold rolled and annealed to 0.008 inch and fully annealed. FIG. 27 is a graph of resistivity versus aluminum content in wt % wherein the solid boxes correspond to the $Fe_3Al$ samples, the open triangles correspond to FeAl samples prepared by a powder metallurgical technique and the solid triangles correspond to cast samples of FeAl. As shown in the graph, the resistivity increases as aluminum content increases up to about 20 wt % after which the resistivity decreases. As shown by the solid boxes in FIG. 27, the data on $Fe_3Al$ suggests that increases in aluminum content correspond to an increase in resistivity. Surprisingly, alloys containing over about 20 wt % Al exhibited a drop in resistivity.

Figure 28:
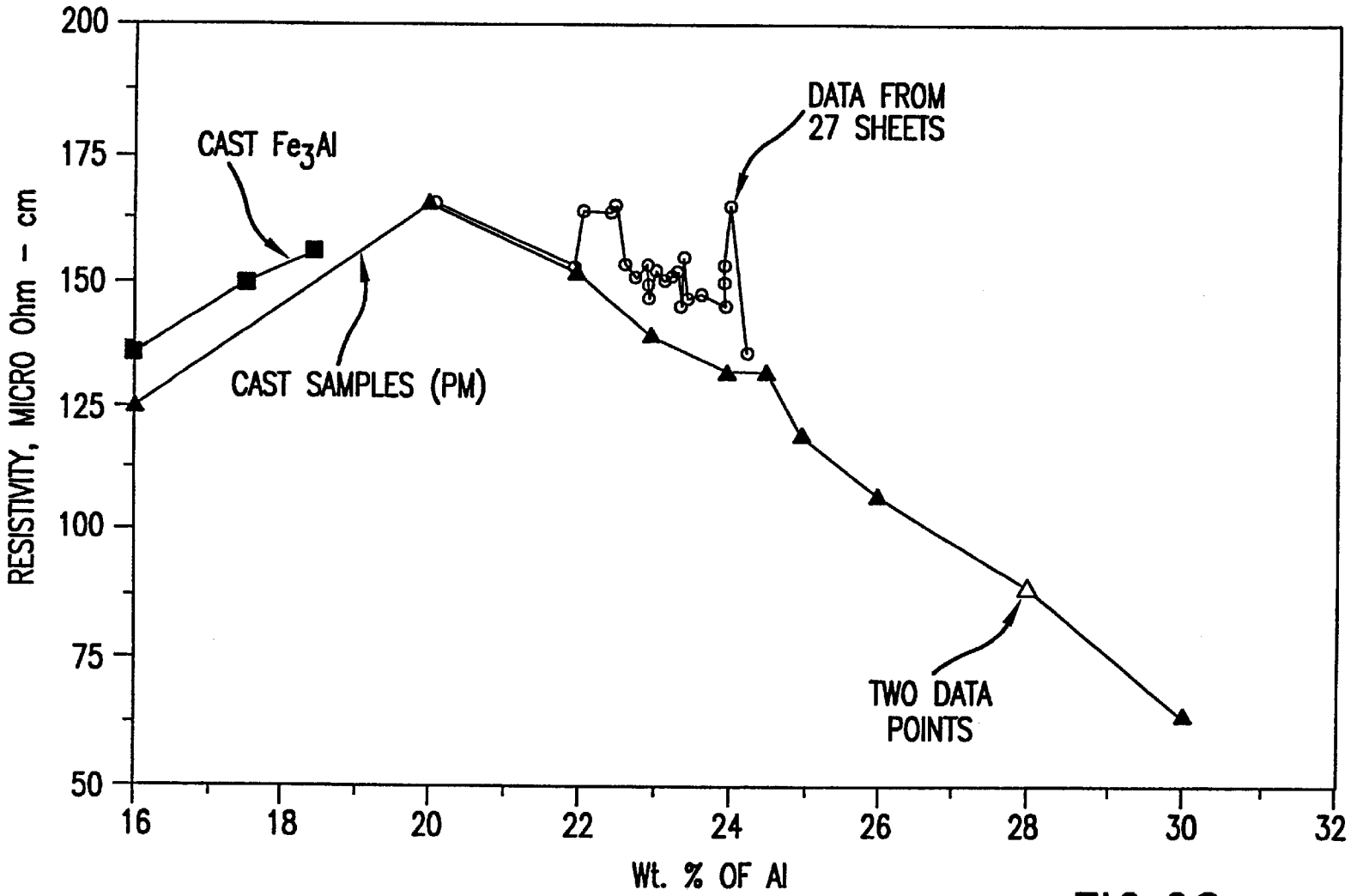
FIG. 28 shows a portion of the graph of FIG. 27 in more detail.

FIG. 28 shows a portion of the graph of FIG. 27. As shown in FIG. 28, data from 27 sheets of FeAl powder having aluminum contents of about 22 to over 24 wt % Al exhibited scatter in resistivity. It was found that the resistivity varied depending on the annealing treatment. The cast samples indicated in the graph by solid triangles had a large grain size on the order of 200 $\mu$m whereas the 27 sheets indicated by the open triangles had a grain size on the order of 22 to 30 $\mu$m with some of the samples having an oxygen content on the order of 0.5 wt % in the case of water atomized powder. Thus, compared to the larger grain size cast samples, the samples prepared from powder exhibited higher resistivity values.

Figure 29:
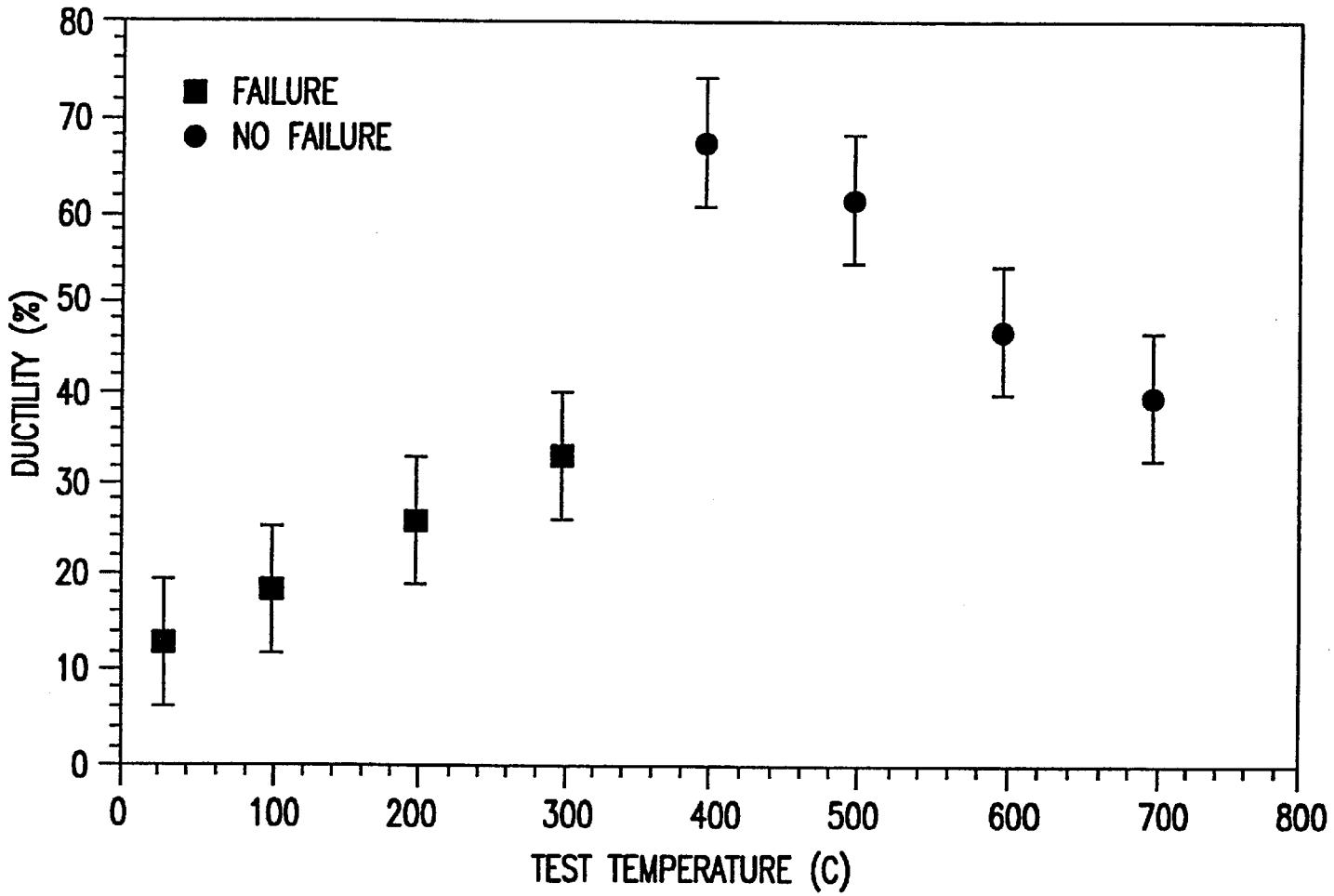
FIG. 29 is a graph of ductility versus temperature for an Fe-23.5 wt % Al alloy prepared by a powder metallurgical technique.
Figure 30:
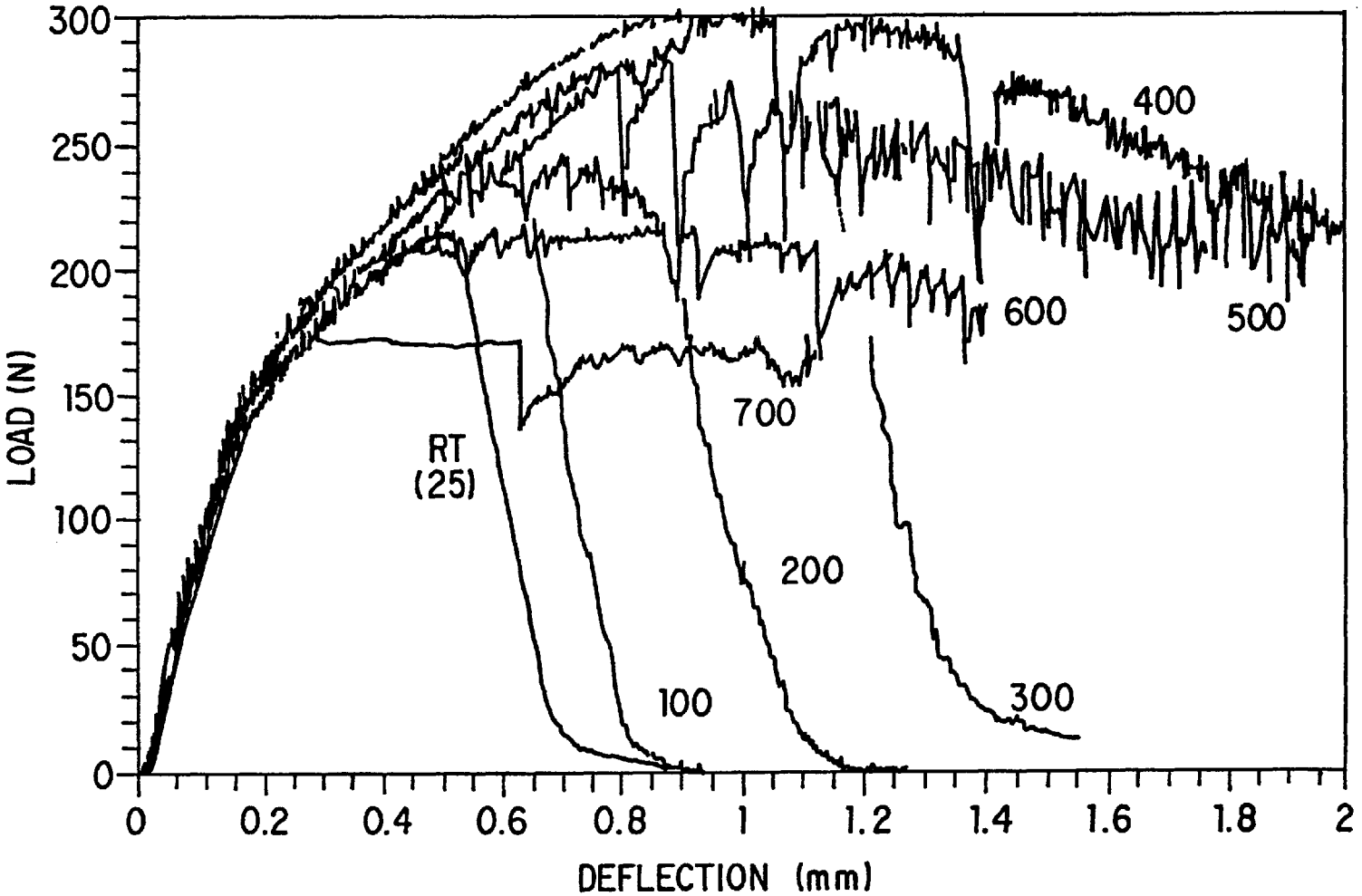
FIG. 30 is a graph of load versus deflection in a 3-point bending test at various temperatures for an Fe-23.5 wt % Al alloy.

FIGS. 29–34 show properties of samples prepared from PM-60 powder. FIG. 29 is a graph of ductility versus test temperature. The ductility was measured in a bending test and as indicated the ductility was around 14% at room temperature. In a tensile test, however, the samples would be expected to exhibit an elongation on the order of 2–3% at room temperature. In the ductility test, failure did not occur easily at temperatures above 300° C. This indicates that parts can be formed at elevated temperatures such as at 400° C. and higher. FIG. 30 is a graph of load versus deflection in a 3-point bending test at various temperatures. The load corresponds to the stress applied to the sample and the deflection corresponds to the strain exhibited by the sample. As shown, at test temperatures at room temperature, 100° C., 200° C. and 300° C., the samples were broken whereas at temperatures of 400° C., 500° C., 600° C. and 700° C. the samples did not break during the bending test.

Figure 31:
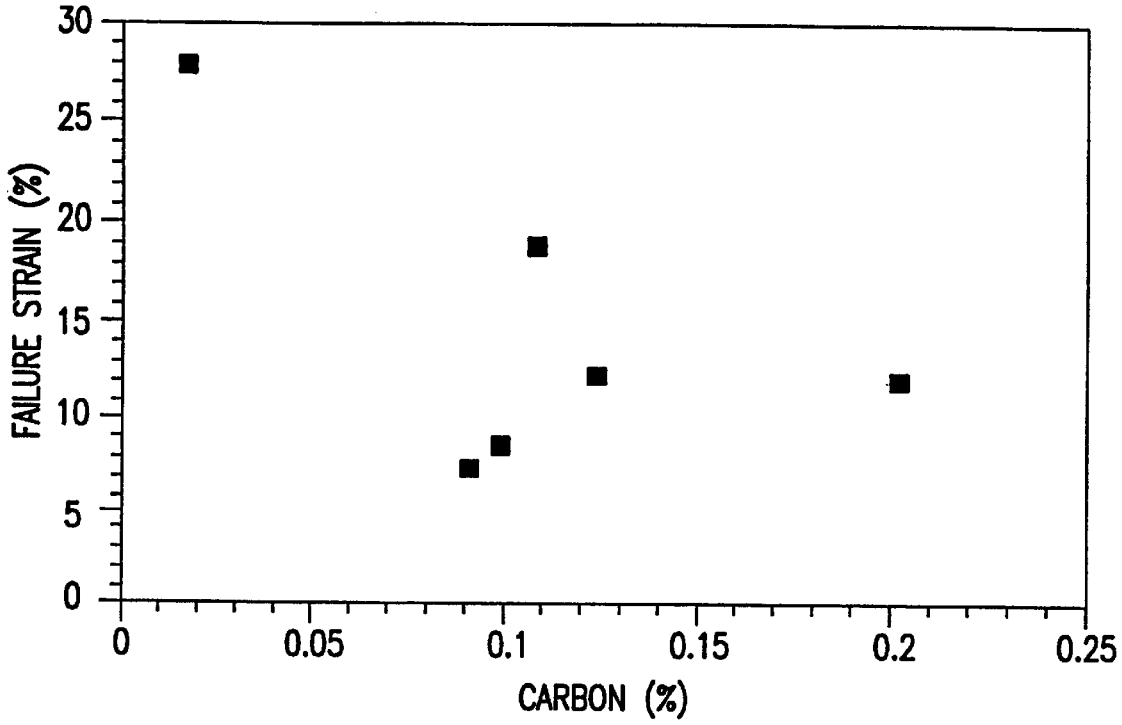
FIG. 31 is a graph of failure strain versus carbon content (wt %) of FeAl in a low strain rate tensile test.
Figure 32:
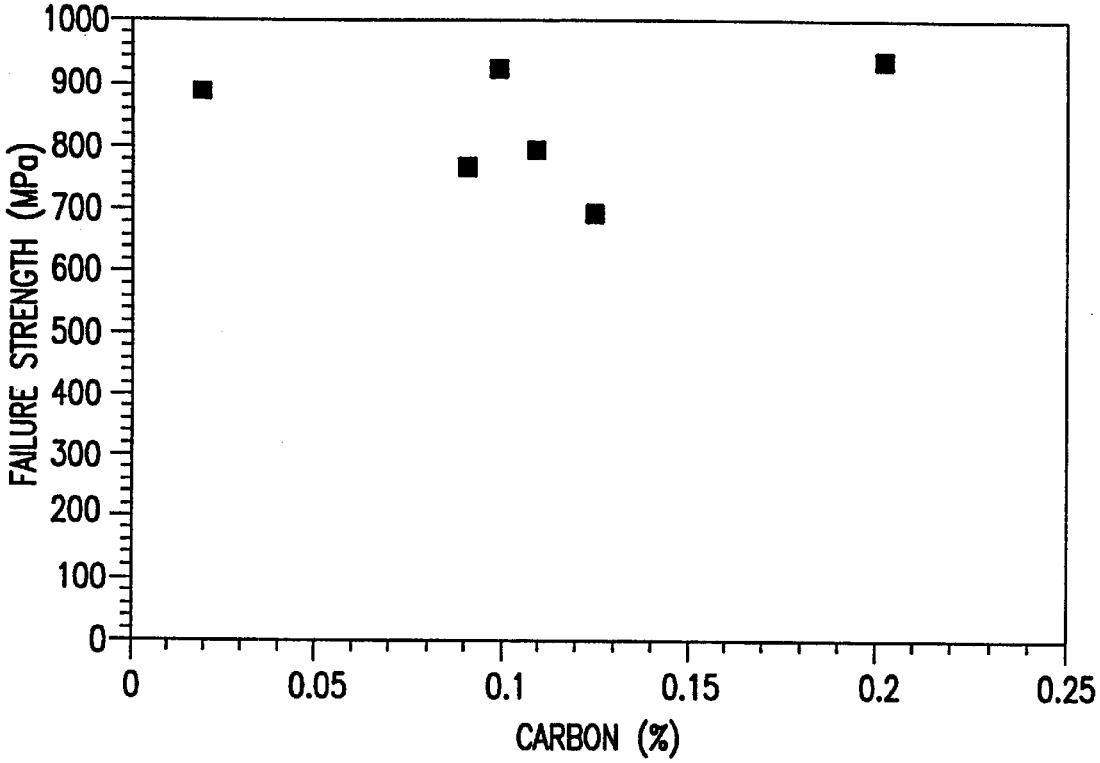
FIG. 32 is a graph of failure strain versus carbon content (wt %) of FeAl in a low strain rate tensile test.
Figure 33:
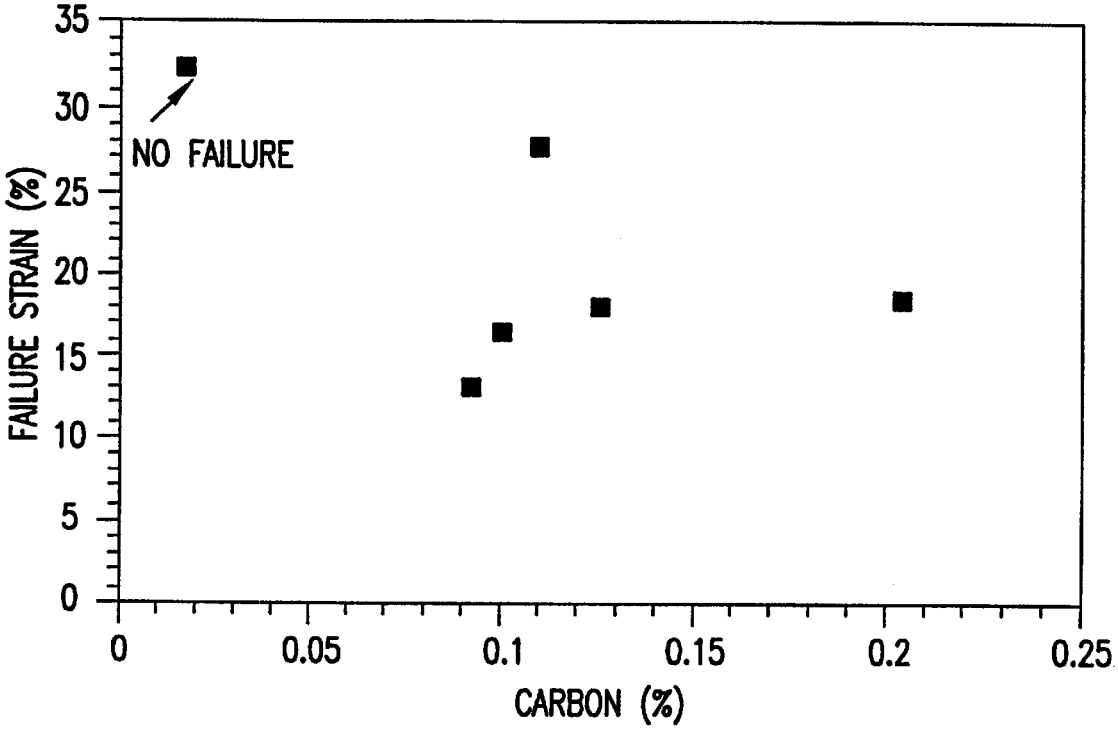
FIG. 33 is a graph of failure strain versus carbon content (wt %) of FeAl in a high strain rate tensile test.
Figure 34:
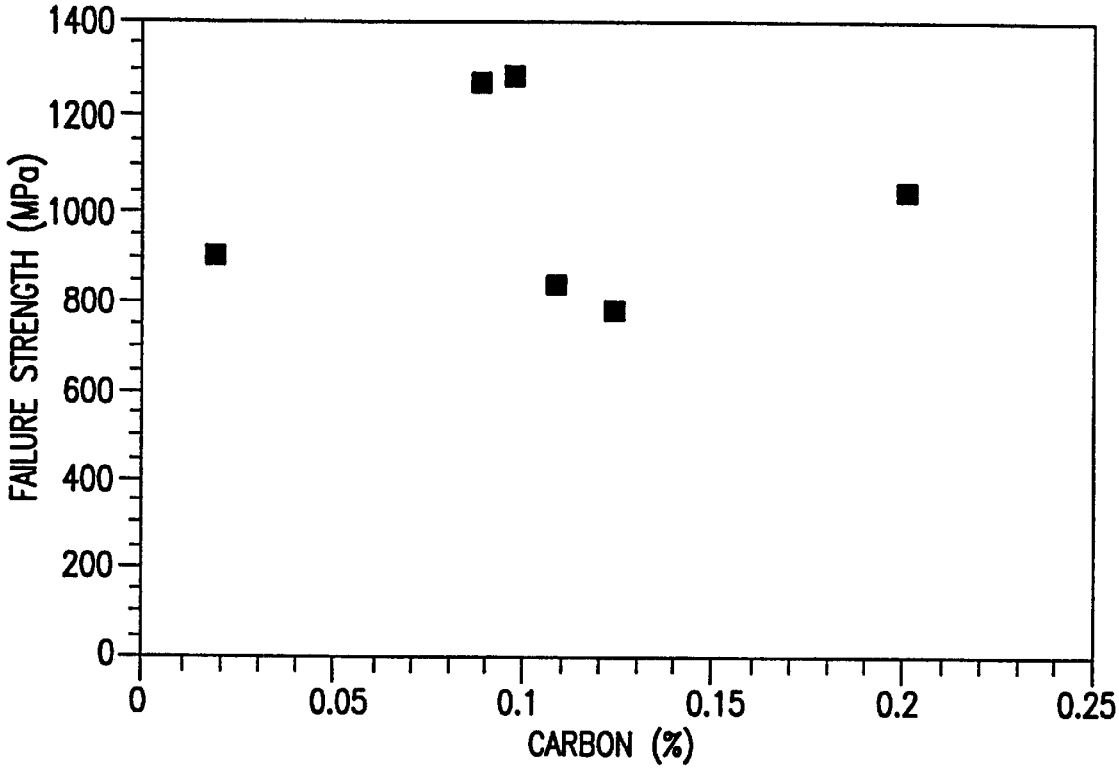
FIG. 34 is a graph of failure strain versus carbon content (wt %) of FeAl in a high strain rate tensile test.

FIGS. 31–32 show the results of low-rate strain tests at 0.003/sec and FIGS. 33–34 show the results of high-rate strain tests at 0.3/sec. In particular, FIG. 31 shows a graph of failure strain versus carbon content in wt %. As shown in FIG. 31, the failure strain is over 25% for carbon contents below 0.05 wt % and the failure strain is above 5% for alloys containing about 0.1 wt % C and above. FIG. 32 is a graph of failure strain (Mpa) versus carbon content (wt %). As indicated in FIG. 32, the failure strain was above 600 MPa for all of the samples tested. In FIG. 33, the failure strain was above 30% for the sample having less than 0.05% C and the failure strain was above 10% for the samples having 0.1% C and above. As shown in FIG. 34, the failure strain was above 600 MPa for all of the samples tested. The high-rate strain tests indicate that sheets of FeAl prepared by a powder metallurgical technique can be subjected to stamping at a high rate and will exhibit reasonably good strength. For parts which must be excessively deformed, the graphs indicate that it would be advantageous to maintain the carbon content below 0.05%.

In order to examine the effects of carbon content on the short-time strength and ductility of a cold compacted foil of an FeAl intermetallic alloy having ,in weight %, 24% Al, 0.42% Mo, 0.1% Zr, 40–60 ppm B and balance Fe, specimens from six heats were tested wherein the carbon contents ranged from 1000 to 2070 ppm. The tensile strength and ductility exhibited no significant change over most of the compositional range. The creep strength was best for the foil containing 1000 ppm C. A minimum in strength was observed with increasing carbon and the foil with 2070 ppm C was found to have good strength. The variation in creep strength was judged to be very small for the samples tested.

Foil specimens were laser machined from annealed 0.2 mm foil and had a gage length of 25 mm long by 3.17 mm wide and 0.2 mm thick. Pin holes were machined in the shoulders for attachment to grips. For creep and relaxation testing, pads were spot welded on the shoulders to reduce deformation at the pin holes. The tensile test was carried out on a 44KN Instron testing machine. For most tensile tests, a Satec averaging extensometer was attached with set screws bearing on the pin holes of the grips. The first 5% strain was recorded on a load versus extension chart. The cross head rate was near 0.004 mm/min (0.1-in/min). Creep tests on foil specimens were performed in the dead load frames. Extension was detected by an averaging extensometer attached to the pin holes in the pull rods. Pin hole deformation, included in the measurements, was estimated to comprise less than 10% of the measured strain. Extension was sensed by linear variable displacement transformers, and readings were taken from continuous chart readings. Relaxation testing was performed in the Instron machine using a ramp rate to the controlled relaxation strain of 0.004 mm/s. The Instron crosshead movement was stopped when the yield stress was reached, and the total extension in the pull rod system was converted into creep strain for the specimen. Load versus time was continuously monitored during the relaxation test and after the first run, the tests were repeated to examine hardening and recovery effects.

Figure 35:
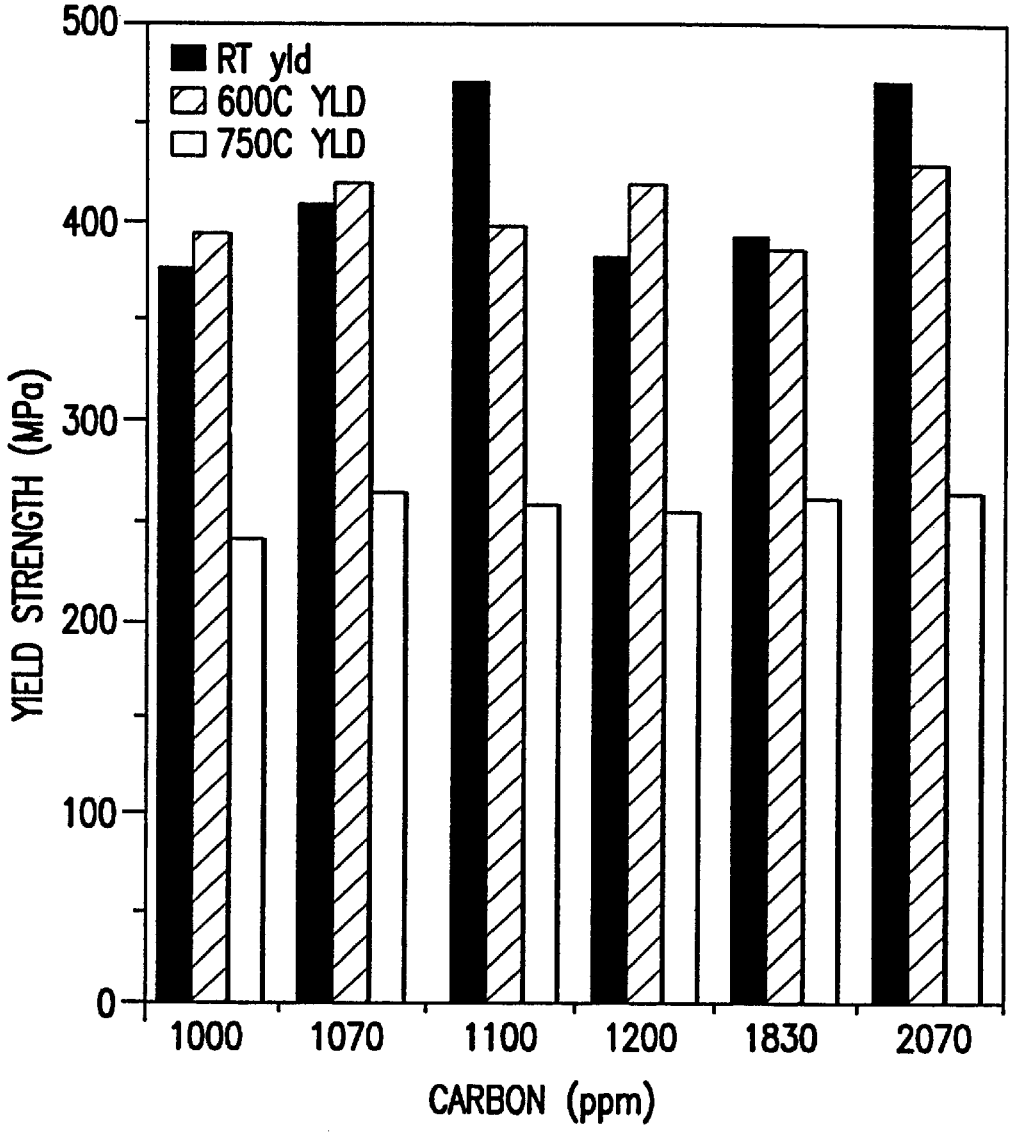
FIG. 35 is a graph showing yield strength versus carbon for FeAl foil specimens at room temperature, 600 and 700° C.
Figure 36:
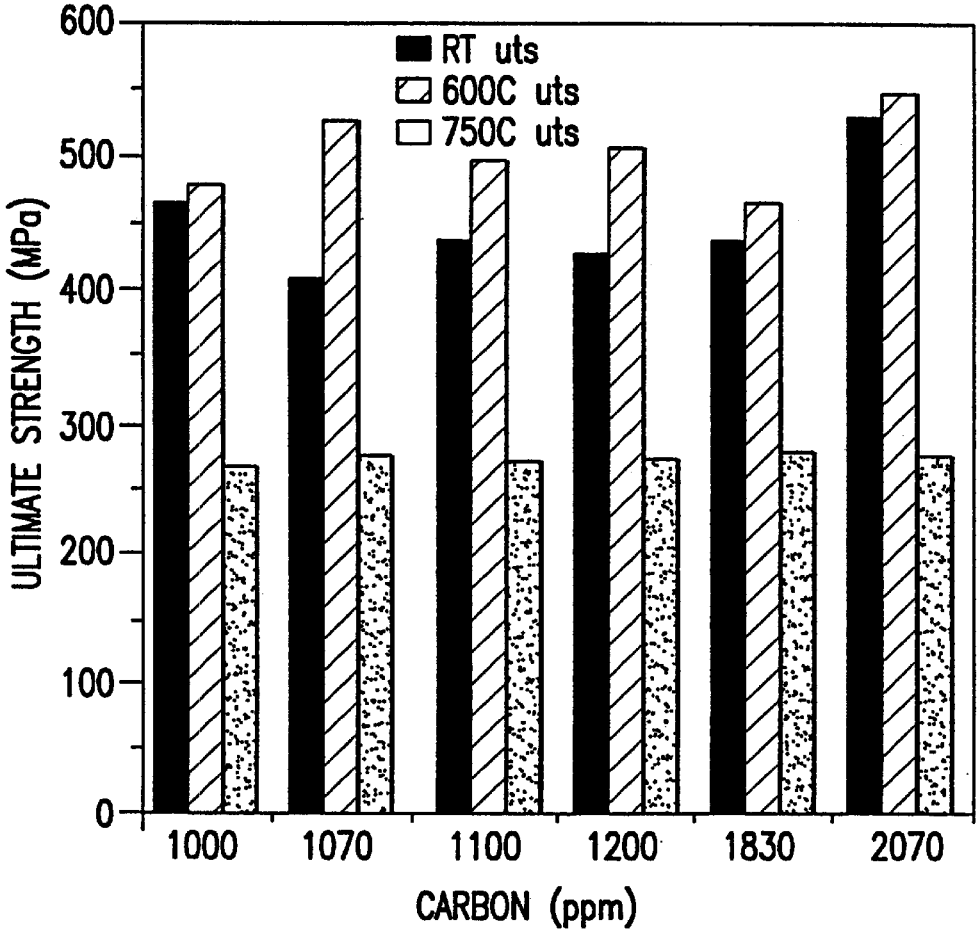
FIG. 36 is a graph showing tensile strength versus carbon for FeAl foil specimens at room temperature, 600 and 700° C.
Figure 37:
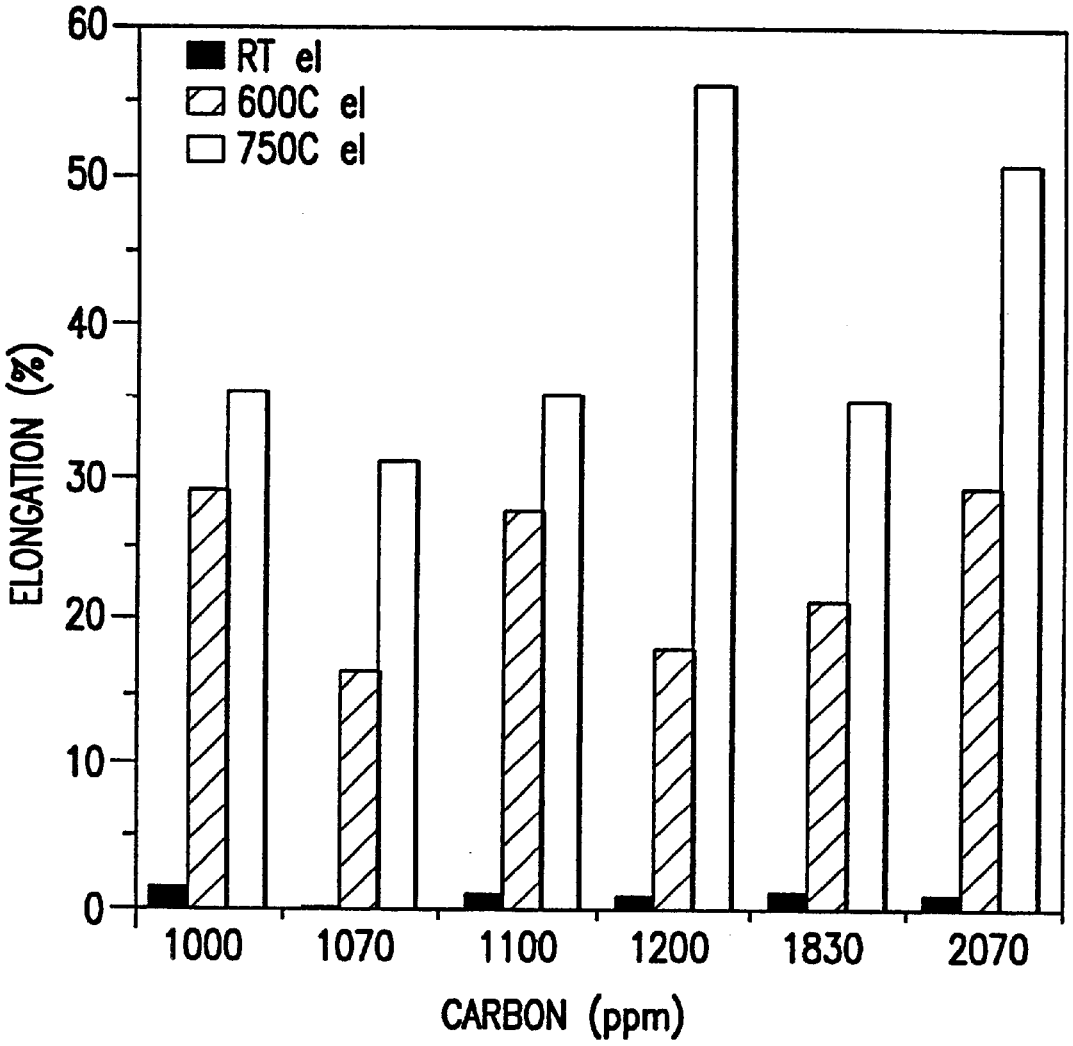
FIG. 37 is a graph showing elongation versus carbon for FeAl foil specimens at room temperature, 600 and 700° C.

Tensile tests were performed at 23, 600 and 750° C. with duplicate tests performed at 23° C. The results of the tensile tests are summarized in Table 14 and plotted in FIGS. 35–37. The yield strengths compared in FIG. 35 show no well-defined trend with increasing carbon except for the highest carbon level (2070 ppm C) at which the yield strength at 750° C. was significantly lower. The ultimate tensile strengths compared in FIG. 36 were highest for the material with 2070 ppm C. The elongations compared in FIG. 37 exhibited no significant trend with increasing carbon content.

TABLE 14

| Foil No. | C ppm | Test Temp. (° C.) | Yield Strength (MPa) | Tensile Strength (MPa) | Elongation (%) |
|---|---|---|---|---|---|
| M11 | 1000 | 23 | 378 | 465 | 1.5 |
| | | 23 | 404 | 496 | 2.1 |
| | | 600 | 395 | 478 | 285 |
| | | 750 | 241 | 268 | 35.2 |
| M10 | 1070 | 23 | 407 | 407 | 0.2 |
| | | 23 | 457 | 464 | 0.7 |
| | | 600 | 418 | 526 | 15.9 |
| | | 750 | 262 | 276 | 30.7 |
| M13 | 1100 | 23 | 370 | 437 | 1.0 |
| | | 23 | 409 | 454 | 0.1 |
| | | 600 | 398 | 497 | 27.0 |
| | | 750 | 256 | 272 | 35.0 |
| M7 | 1200 | 23 | 384 | 426 | 0.8 |
| | | 23 | 404 | 489 | 1.4 |
| | | 600 | 418 | 507 | 17.6 |
| | | 750 | 254 | 274 | 56.3 |
| M6 | 1830 | 23 | 391 | 436 | 1.0 |
| | | 23 | 392 | 418 | 0.9 |
| | | 600 | 385 | 466 | 20.7 |
| | | 750 | 261 | 279 | 34.9 |
| M8 | 2070 | 23 | 470 | 531 | 0.9 |
| | | 23 | 464 | 544 | 1.1 |
| | | 600 | 429 | 547 | 28.6 |
| | | 750 | 265 | 277 | 51.0 |

Figure 38:
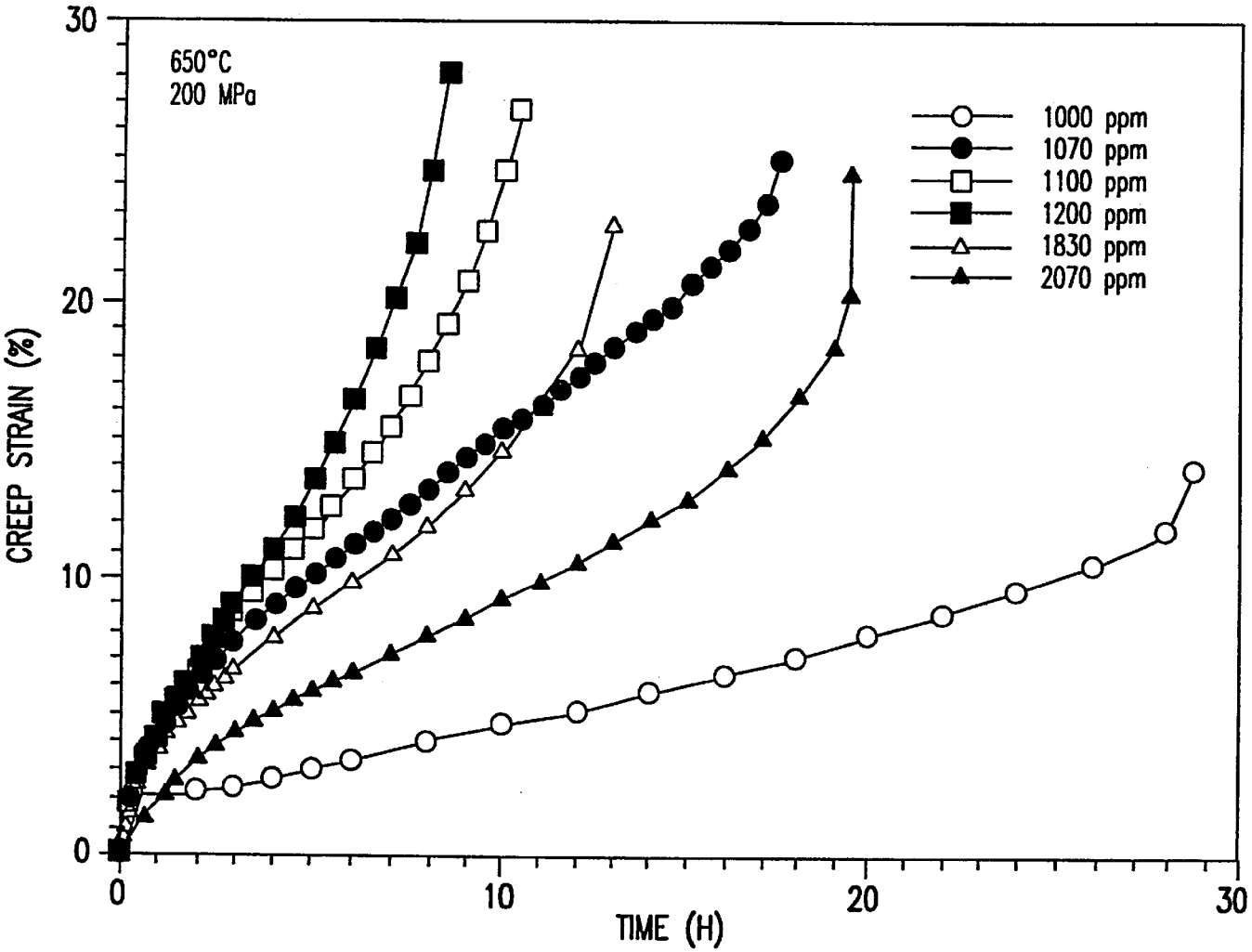
FIG. 38 is a graph of creep curves for 650° C. and 200 MPa for FeAl foil specimens.
Figure 39:
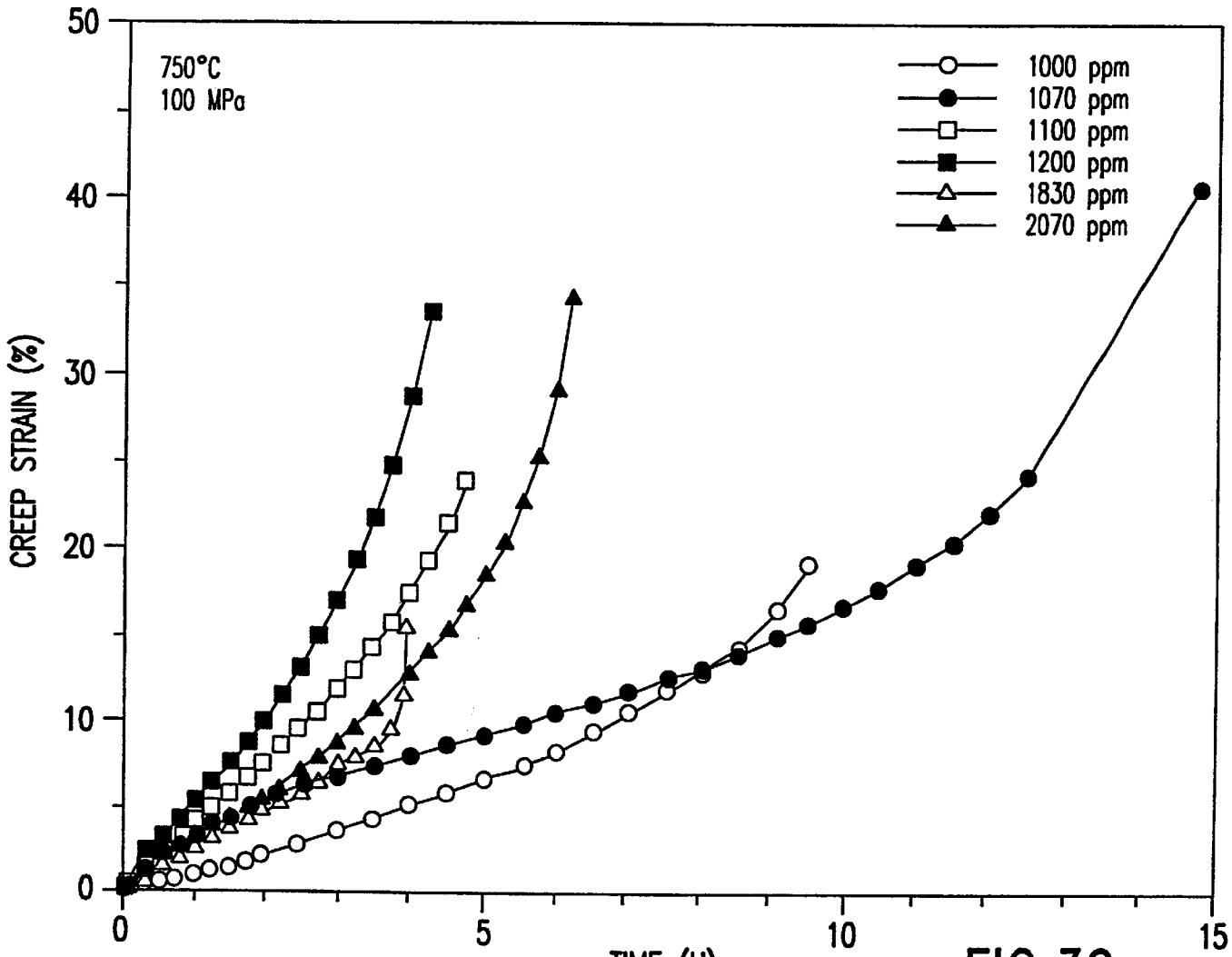
FIG. 39 is a graph of creep curves for 750° C. and 100 MPa for FeAl foil specimens.
Figure 40:
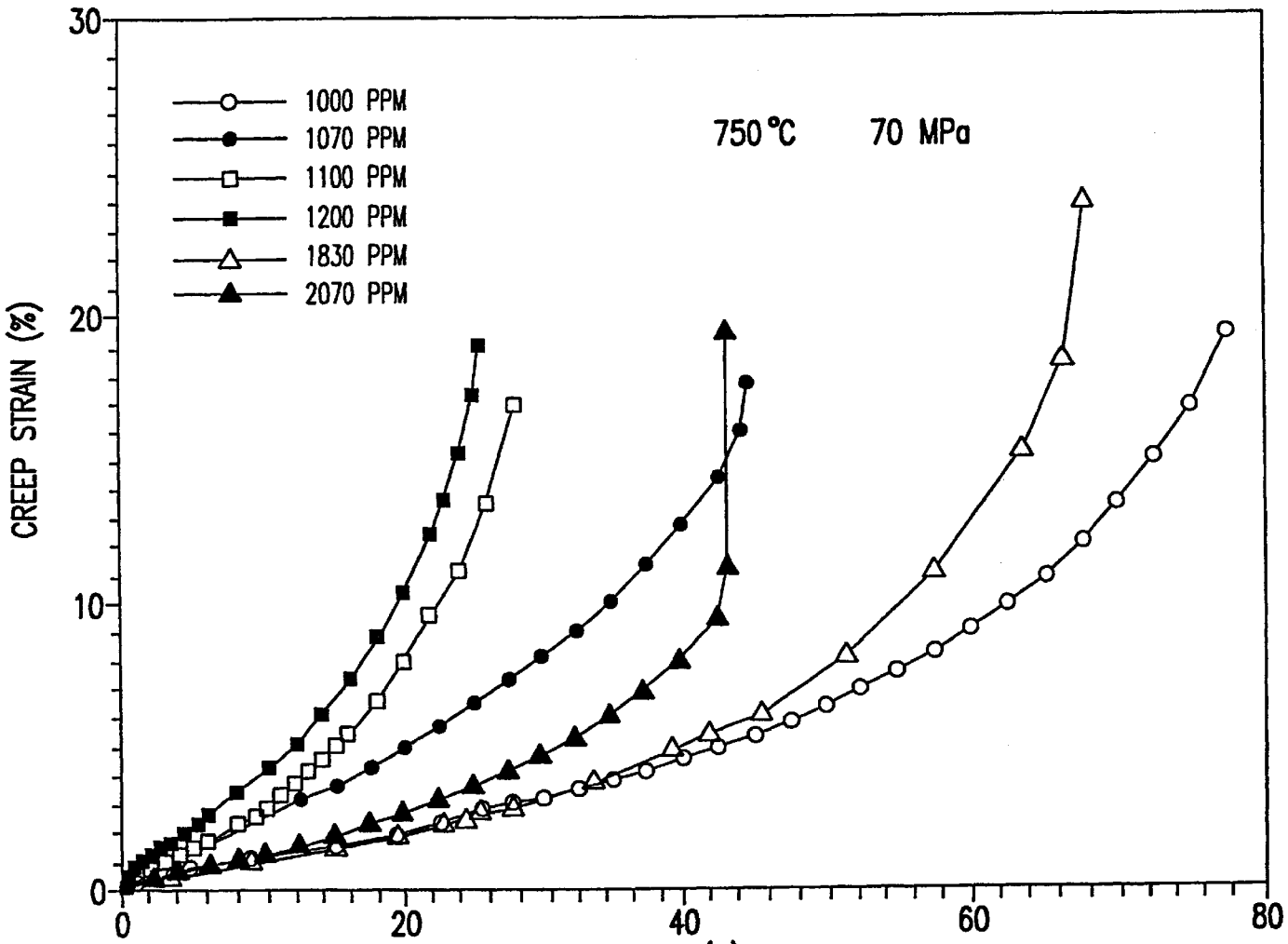
FIG. 40 is a graph of creep curves for 750° C. and 70 MPa for FeAl foil specimens.
Figure 41:
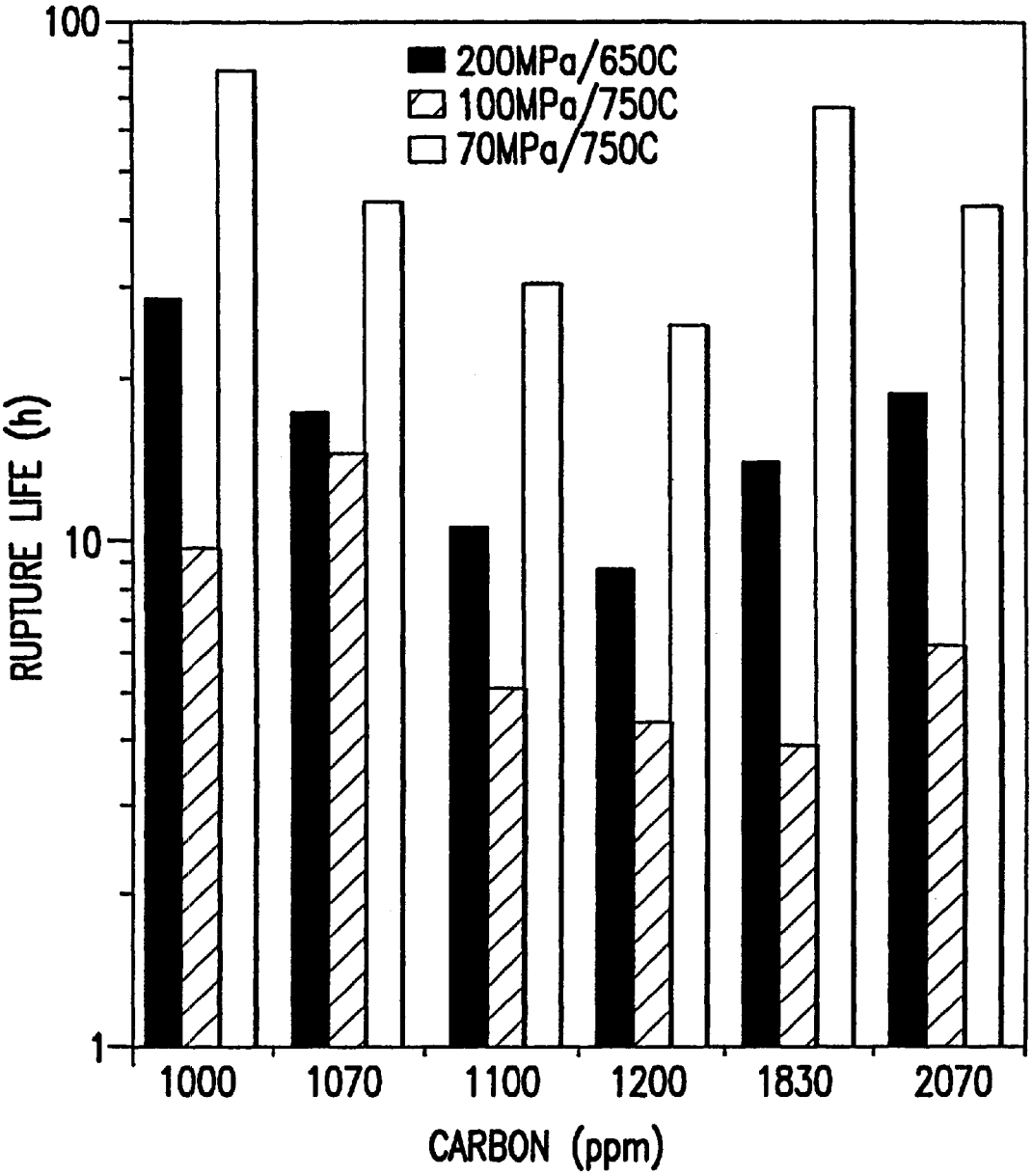
FIG. 41 is a graph of rupture life versus carbon content for FeAl foils at 650 to and 750° C.
Figure 42:
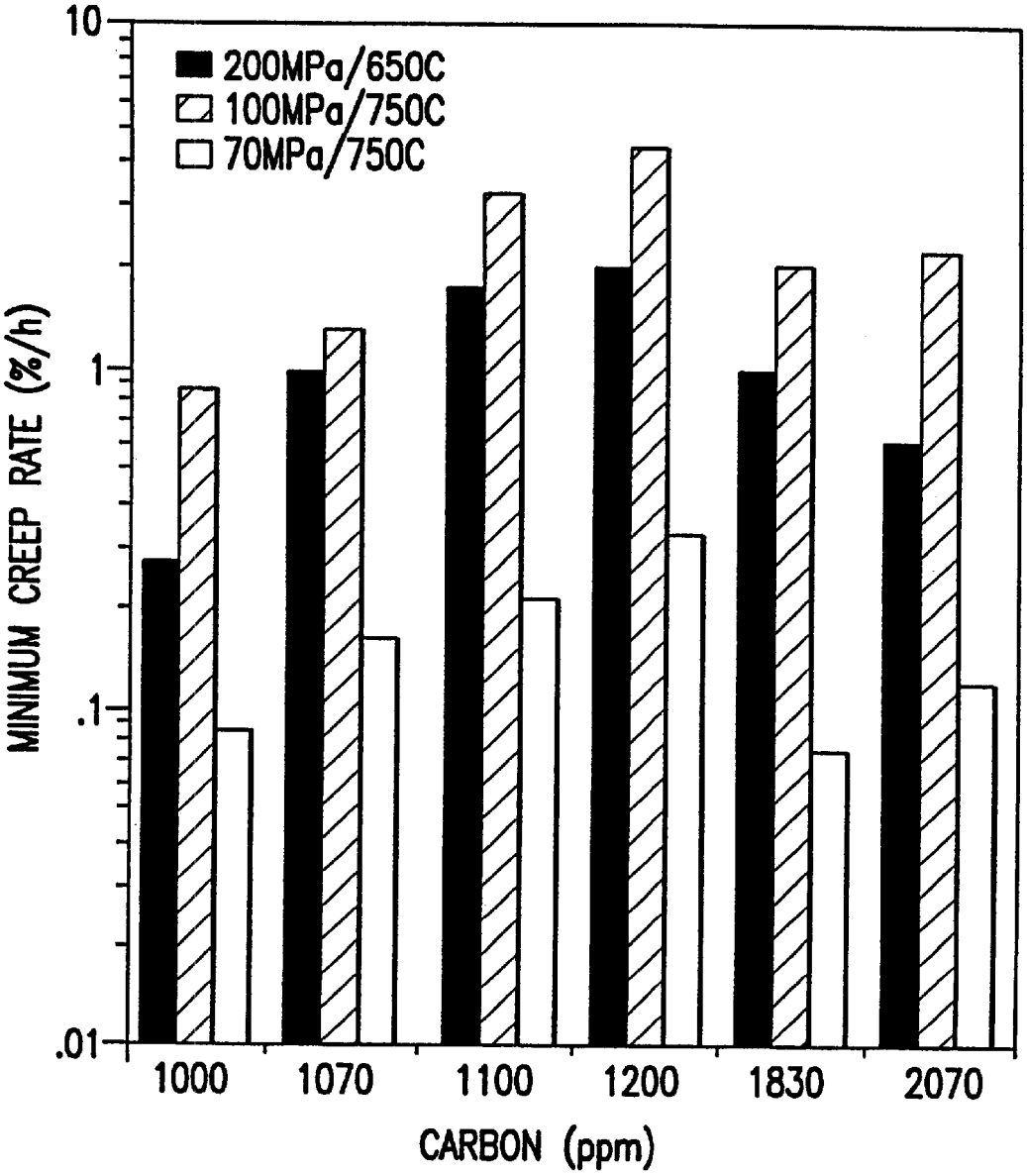
FIG. 42 is a graph of minimum creep rate versus carbon content for FeAl foils at 650 and 750° C.

Creep tests were performed at 650 and 750° C. and results are summarized in Table 15. Curves for 650° C. and 200 MPa are compared in FIG. 38. All specimens exhibited classical creep behavior with significant primary, secondary and tertiary creep stages. The creep strenght was greatest for 1000 ppm carbon and went through a minimum at 1200 ppm carbon. Creep ductility tended to decrease with increasing life. Creep curves for 750° C. and 100 MPa are shown in FIG. 39. Here, primary creep was less and most curves were dominated by the tertiary creep component. The specimin with 1070 ppm carbon was an exception and went through a long period of secondary creep. Overall, the trend with increasing carbon content was similar to that seen at 650° C. The foil with 1000 ppm carbon was the strongest and the foil with 1200 ppm carbon was the weakest. Longer-time creep curves corresponding to 750° C. and 70 Mpa are shown in FIG. 40. Again, tertiary creep dominated the curves. The foil with 1000 ppm carbon was the strongest and the foil with 1200 ppm carbon was the weakest. At 750° C. the ductilty did not appear to be decreased with increasing life. The rupture and minimum creep rate versus carbon content are shown as bar graphs in FIGS. 41–42. Here, it may be seen that foil containing 1000 ppm carbon was consistently better than foils with higher carbon.

TABLE 15

| Foil No. | C ppm | Test Temp. (° C.) | Stress (MPa) | Minimum Creep Rate (%/h) | Life (h) |
|---|---|---|---|---|---|
| M1 | 1000 | 650 | 200 | 2.7E − 1 | 28.9 |
| | | 750 | 100 | 9.0E − 1 | 9.7 |
| | | 750 | 70 | 8.7E − 2 | 80.5 |
| M10 | 1070 | 650 | 200 | 1.0E + 0 | 17.5 |
| | | 750 | 100 | 1.3E + 0 | 14.7 |
| | | 750 | 70 | 1.6E − 1 | 44.4 |
| M13 | 1100 | 650 | 200 | 1.7E + 0 | 10.4 |
| | | 750 | 100 | 3.2E + 0 | 5.1 |
| | | 750 | 70 | 2.1E − 1 | 31.4 |

TABLE 15-continued

| Foil No. | C ppm | Test Temp. (° C.) | Stress (MPa) | Minimum Creep Rate (%/h) | Life (h) |
|---|---|---|---|---|---|
| M7 | 1200 | 650 | 200 | 2.0E + 0 | 8.6 |
| | | 750 | 100 | 4.4E + 0 | 4.4 |
| | | 750 | 70 | 3.3E − 1 | 25.5 |
| M6 | 1830 | 650 | 200 | 1.1E + 0 | 14.0 |
| | | 750 | 100 | 2.0E + 0 | 3.9 |
| | | 750 | 70 | 7.5E − 2 | 68.0 |
| M8 | 2070 | 650 | 200 | 6.3E − 1 | 19.3 |
| | | 750 | 100 | 2.2E + 0 | 6.2 |
| | | 750 | 70 | 1.2E − 1 | 43.2 |

Figure 43:
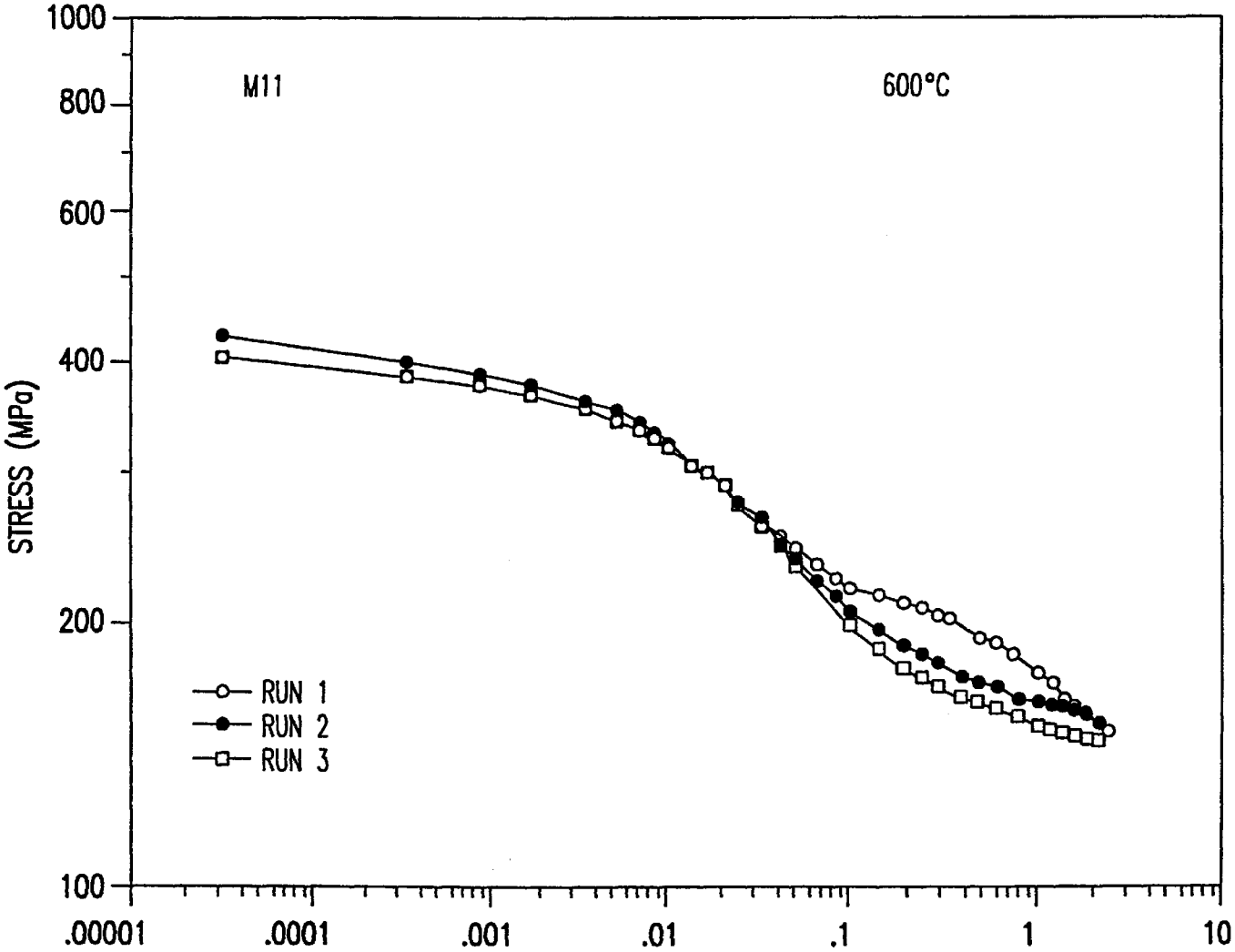
FIG. 43 is a graph of relaxation tests for FeAl foils at 600° C.

Relaxation tests were performed at 600, 700, and 750° C. Relaxation was rapid, so hold times were short. Results at 600° C. are shown in FIG. 43. For the same starting stress, the short-time relaxation was the same for all three runs. Some differences in relaxation stresses were observed between the runs for times between 0.1 and 1 hours. These differences were not judged to be significant. The reproducibility of relaxation from one run to the next is an indication of a stable microstructure.

Figure 44:
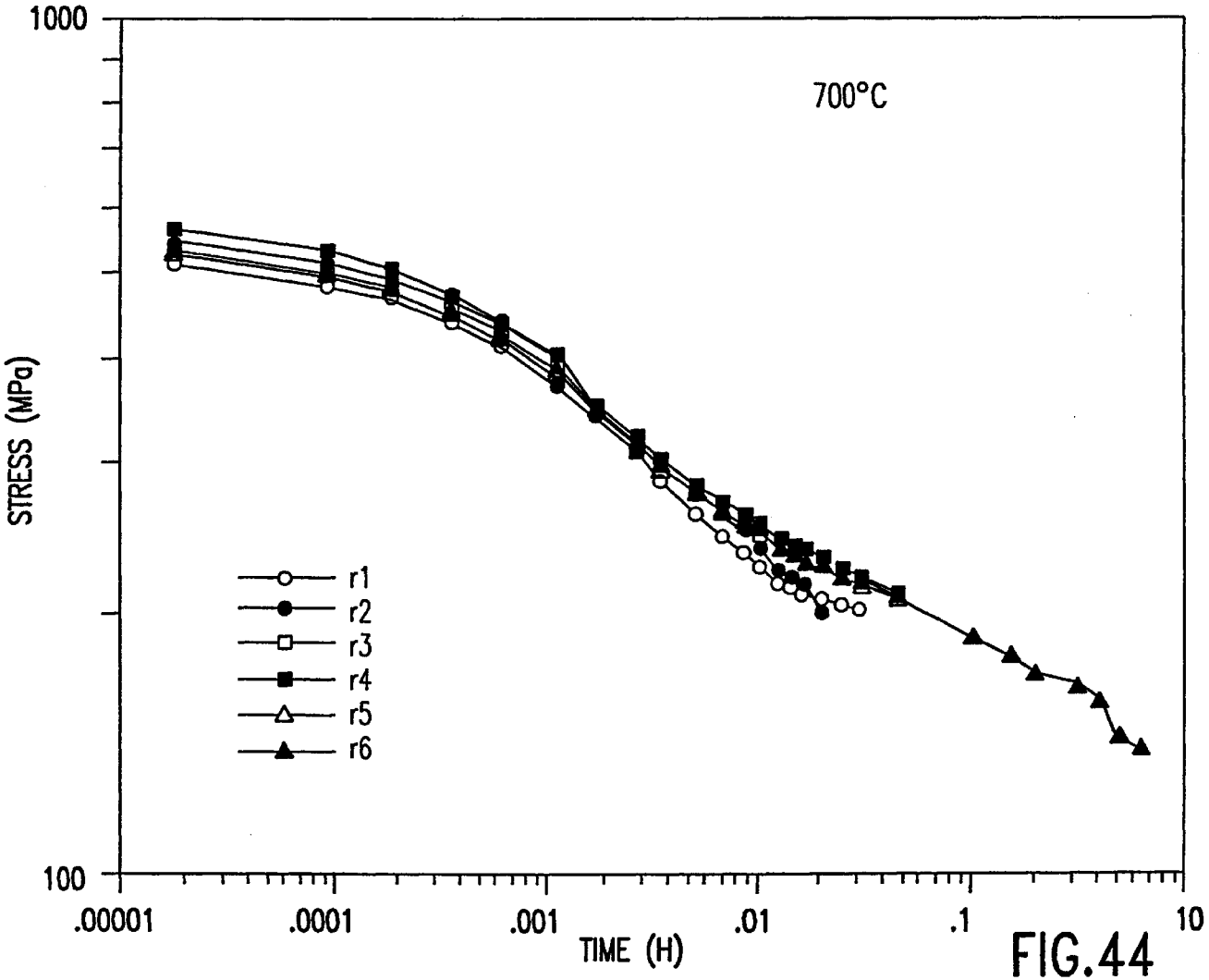
FIG. 44 is a graph of relaxation tests for FeAl foils at 700° C.
Figure 45:
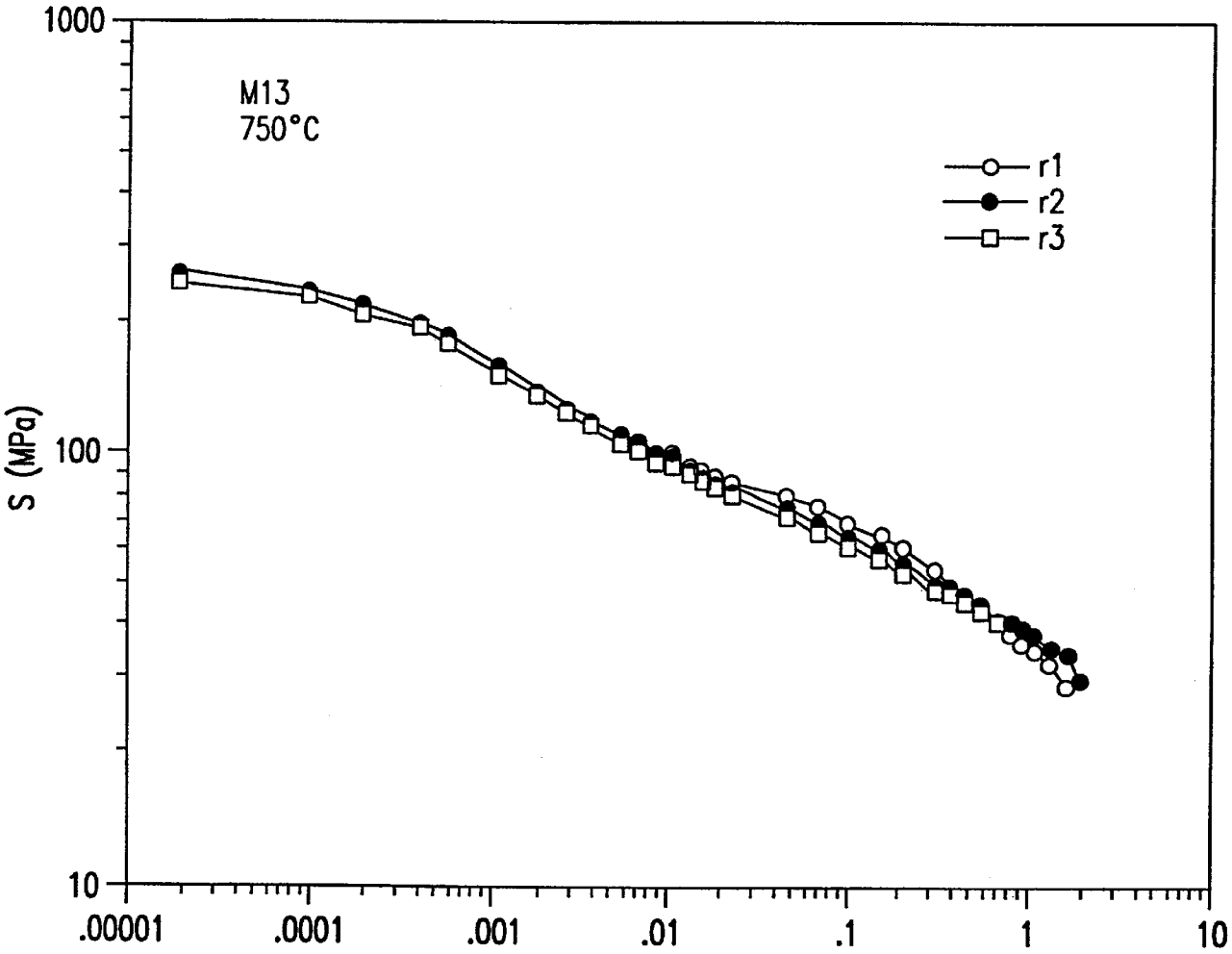
FIG. 45 is a graph of relaxation tests for FeAl foils at 750° C.

Relaxation data for 700° C. and 750° C. are shown in FIGS. 44–45. Again, there was no significant difference in the relaxation strength from one run to the next at both temperatures.

Figure 46:
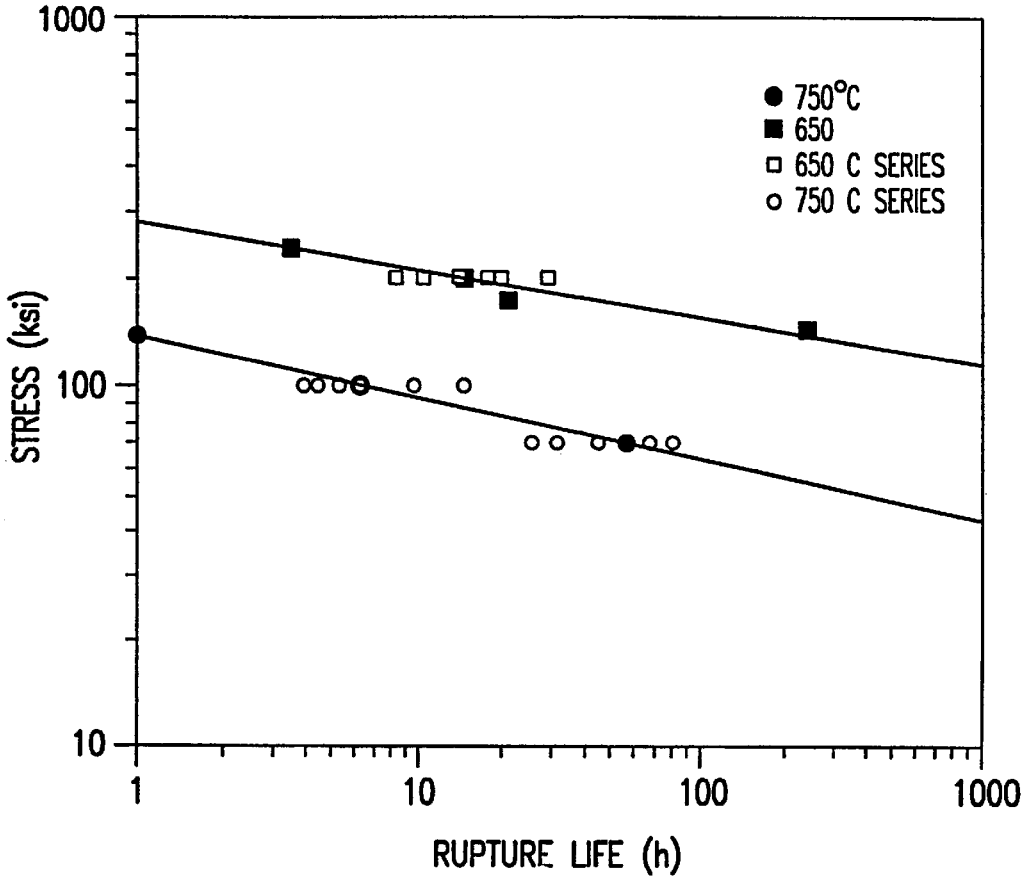
FIG. 46 is a graph of stress versus rupture life for FeAl foils at 650 and 750° C.

Creep-rupture tests were performed on a single heat of annealed FeAl foil. In FIG. 46, stress rupture data at 650 and 750° C. for this heat are compared to data from the study on carbon effects. As may be seen in the figure, the rupture lives for the six heats with varying carbon content scatter about the stress-rupture curve. The variation in strength about the curve is about +10% while the variation in life is about ½ log cycle. Such variations are small for heat-to-heat differences.

Figure 47A:
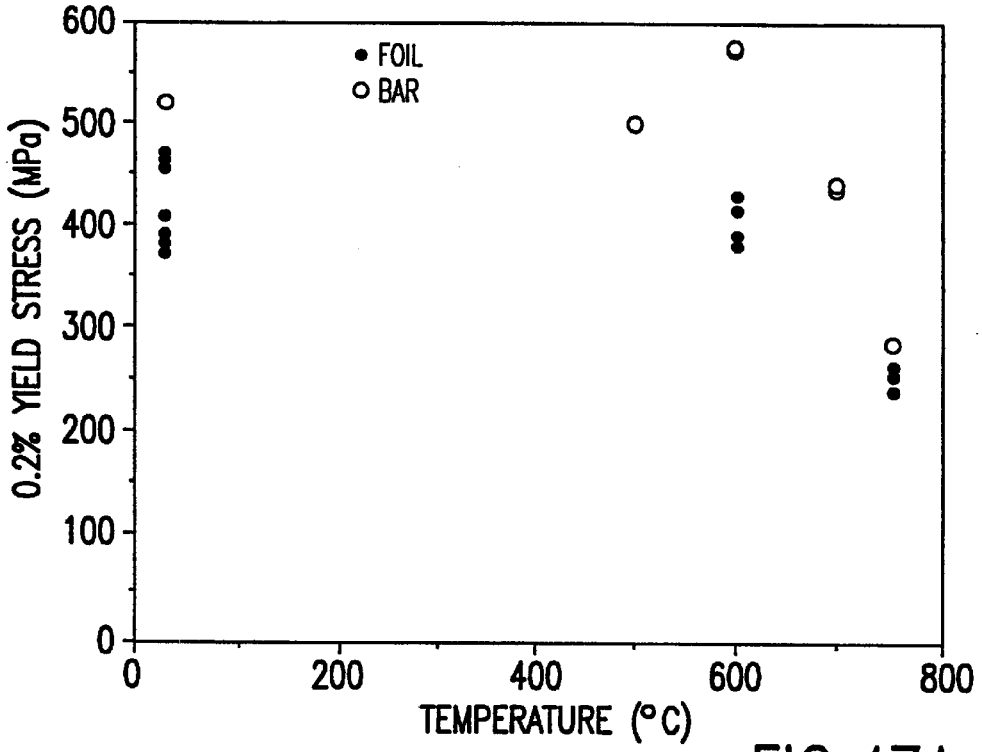
FIGS. 47*a–b* are graphs of yield strength and tensile strength of extruded FeAl bar compared to that of annealed FeAl foil.
Figure 47B:
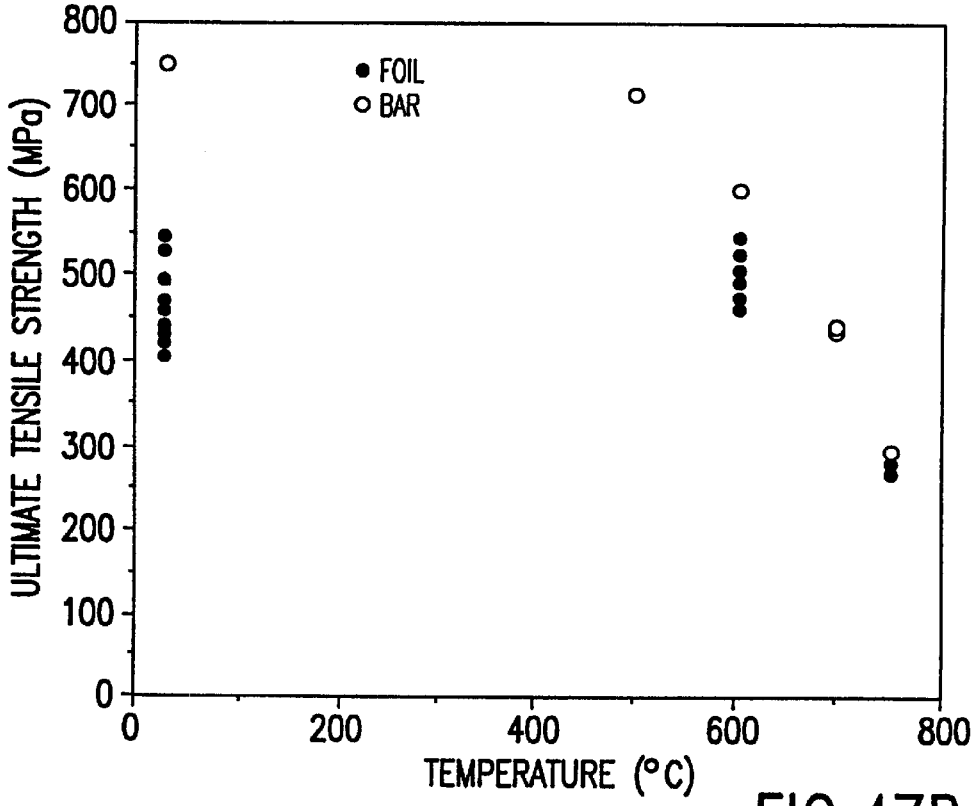
Figure 48:
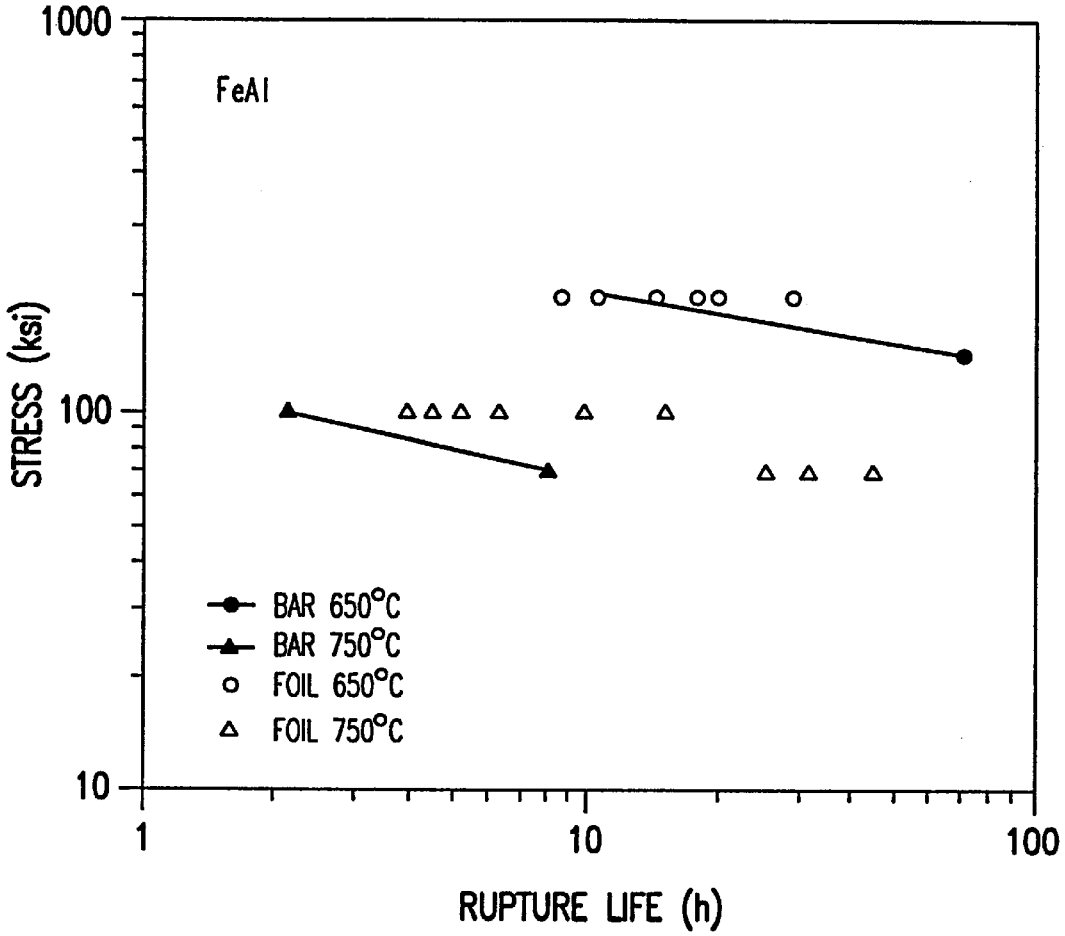
FIG. 48 is a graph of rupture life of extruded FeAl bar compared to that of annealed FeAl foil.
Figure 49:
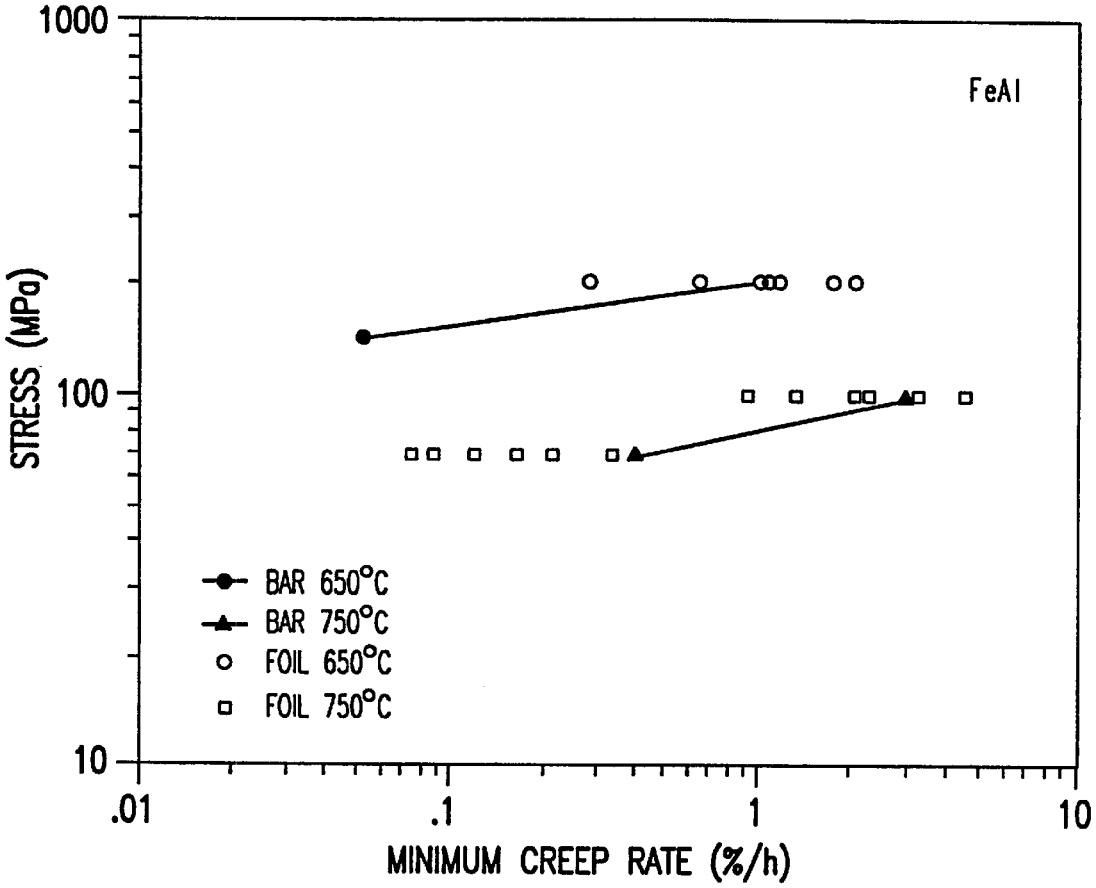
FIG. 49 is a graph of minimum creep rate of extruded FeAl bar compared to that of annealed FeAl foil.

Tensile, creep, relaxation and fatigue tests were performed on a single heat of FeAl bar in the as-extruded condition, rather than annealed. Tensile data for the bar product are compared to data for the FeAl foil in FIG. 47. The bar had higher yield and ultimate strengths than the foil. The short-time creep and stress rupture properties of the bar product were obtained at 650, 700 and 750° C. The minimum creep rate for the bar was higher than the foil and rupture life was less. Comparisons are shown in FIGS. 48–49.

Figure 50:
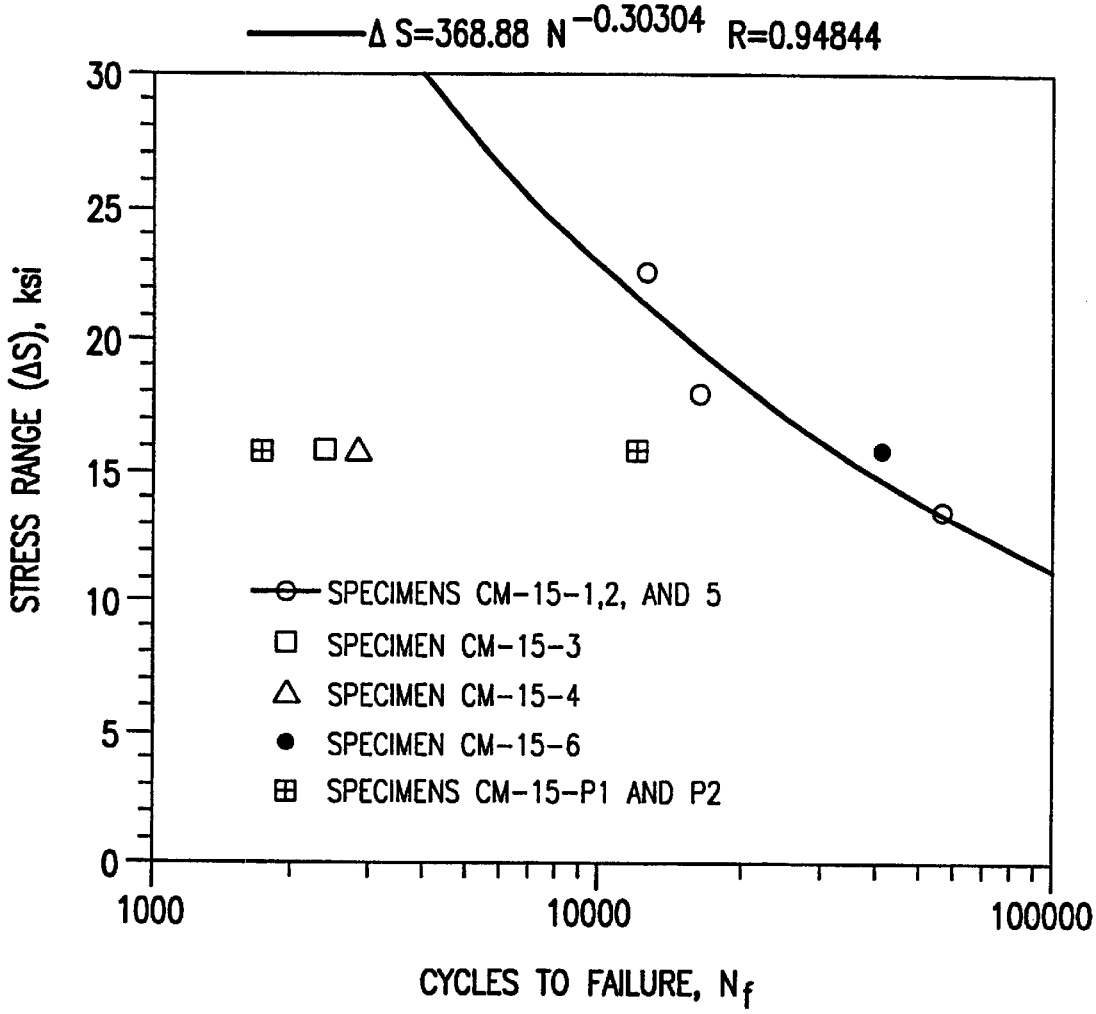
FIG. 50 is a graph of fatigue data of Type 1 FeAl foil specimens tested in air at 750° C.
Figure 51:
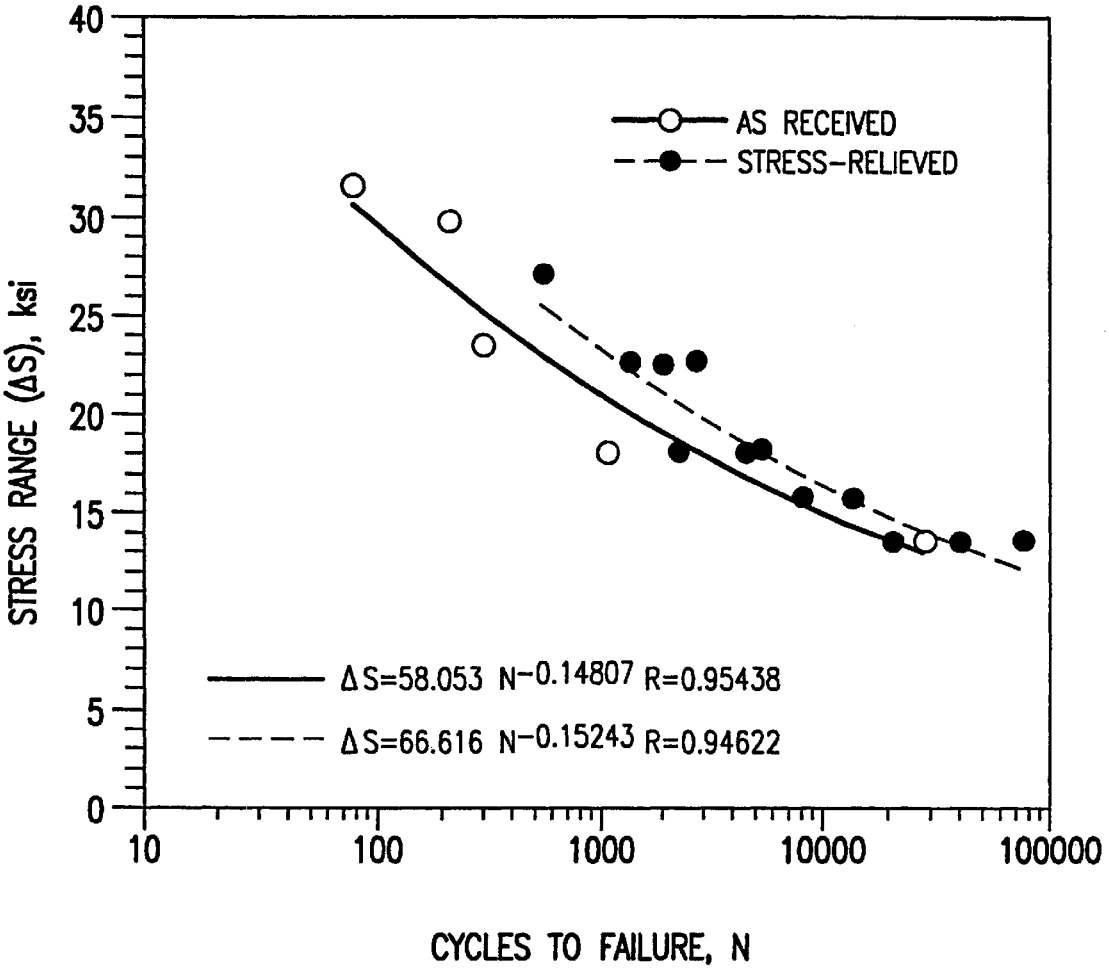
FIG. 51 is a graph of fatigue data of Type 2 FeAl foil specimens tested in air at 750° C.
Figure 52:
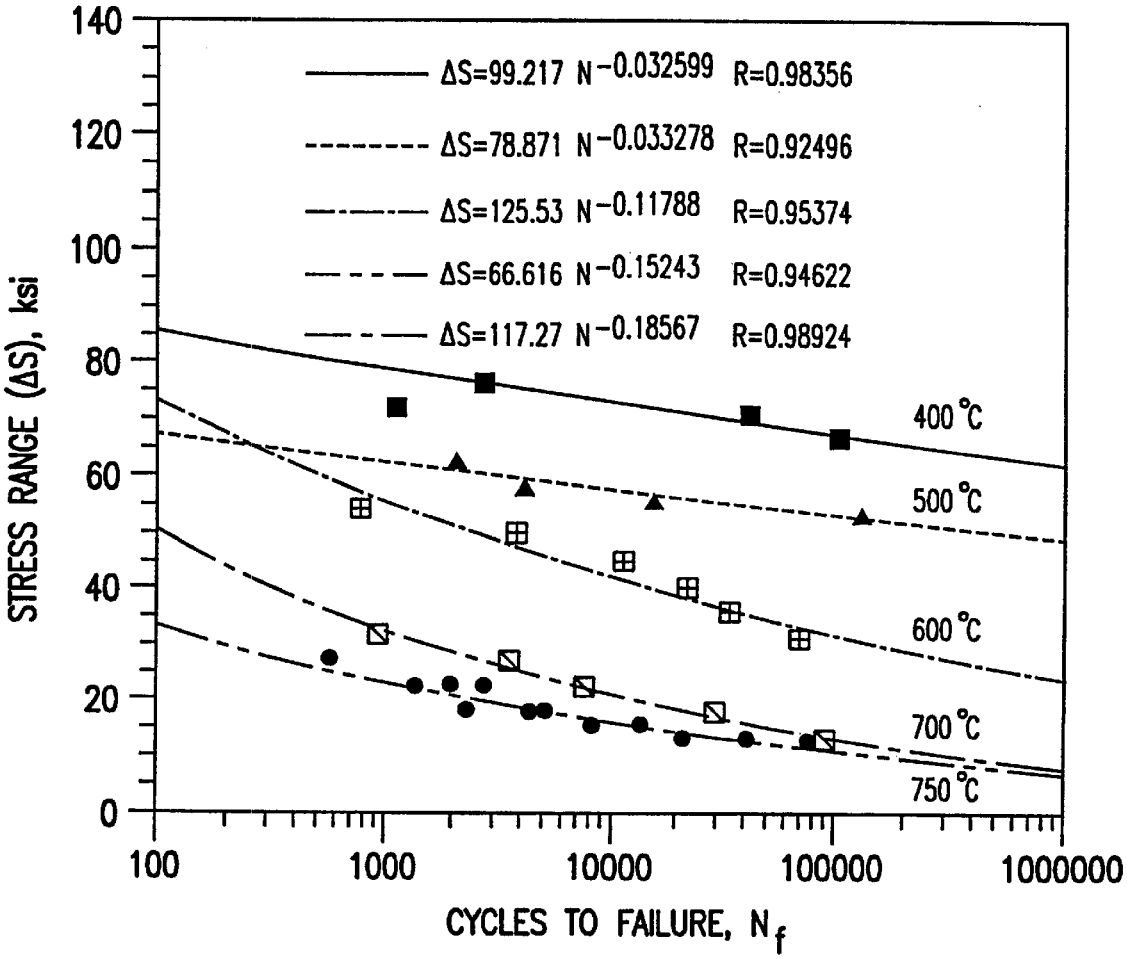
FIG. 52 is a graph of fatigue data of Type 2 FeAl foil specimens tested in air at 400, 500, 600, 700 and 750° C.

Fatigue data for FeAl 30 mil flat specimens prepared from extruded bar (Type 1) and 8 mil foils prepared by the roll compaction technique (Type 2) is set forth in the following tables wherein the specimens were tested in air and at a stress ratio of 0.1. Results of the fatigue tests are set forth in FIGS. 50–52 wherein the Type 1 and Type 2 specimens were of the same basic composition but prepared from different batches of powder having, in weight %, 24% Al, 0.42% Mo, 0.1% Zr, 40–60 ppm B, 0.1% C and balance Fe. FIG. 50 shows cycles to failure for Type 1 specimens tested in air at 750° C., FIG. 51 shows cycles to failure for Type 2 specimens tested in air at 750° C., and FIG. 52 shows cycles to failure for Type 2 specimens tested in air at 400, 500, 600, 700 and 750° C.

TABLE 16

Fatigue Data For Type 1 Specimens of Iron-Aluminide Tested in Air at 750° C. and At A Stress Ratio of 0.1.

| Specimen | Maximum Stress, ksi | Number of Cycles to Failure | Average Strain Per Cycle |
|---|---|---|---|
| CM-15-1* | 25 | 12,605 | 2.367E − 06 |
| CM-15-2* | 20 | 16,460 | 1.955E − 06 |
| CM-15-3* | 17.5 | 2,364 | 4.922E − 06 |
| CM-15-4* | 17.5 | 2,793 | 4.049E − 06 |
| CM-15-6* | 17.5 | 41,591 | 1.755E − 06 |
| CM-15-5* | 15 | 57,561 | 7.813E − 07 |
| CM-15-P1** | 17.5 | 1,716 | 6.073E − 06 |
| CM-15-P2 | 17.5 | 11,972 | 1.154E − 06 |

*Heat treated for two hours at 750° C. before testing.
**Polished Type 1 specimens heat treated for two hours at 750° C. before testing.

TABLE 17

Fatigue Data For Type 2 Specimens of Iron-Aluminide Tested in Air at 400° C., 500° C., 600° C., 700° C., 750° C. and A Stress Ratio of 0.1.

| Specimen | Maximum Stress, ksi | Test Temp (° C.) | Number of Cycles to Failure | Average Strain Per Cycle |
|---|---|---|---|---|
| M3-15* | 20 | 750 | 5,107 | 1.808E − 05 |
| M3-16* | 20 | 750 | 4,468 | 2.175E − 05 |
| M3-17* | 17.5 | 750 | 8,134 | 9.637E − 06 |
| M3-18* | 70 | 500 | 1,332 | ** |
| M3-19* | 70 | 500 | 2,004 | 3.998E − 05 |
| M3-20* | 65 | 500 | 3,935 | 1.113E − 05 |
| M3-21* | 60 | 500 | 128,092 | 4.350E − 07 |
| M3-22* | 62.5 | 500 | 14,974 | 2.499E − 06 |
| M3-23* | 60 | 600 | 756 | 6.040E − 05 |
| M3-24* | 55 | 600 | 3,763 | 1.244E − 05 |
| M3-25* | 50 | 600 | 11,004 | 6.436E − 06 |
| M3-26* | 45 | 600 | 21,045 | 3.620E − 06 |
| M3-27* | 40 | 600 | 33,005 | 9.849E − 07 |
| M3-28* | 35 | 600 | 69,235 | 3.234E − 07 |
| M3-29* | 35 | 700 | 917 | 9.281E − 05 |
| M3-30* | 30 | 700 | 3,564 | 2.104E − 05 |
| M3-31* | 25 | 700 | 7,662 | 1.235E − 05 |
| M3-32* | 20 | 700 | 28,509 | 1.973E − 06 |
| M3-33* | 15 | 700 | 90,872 | 6.715E − 07 |

*Heat treated for two hours at 750° C. before testing.
**Data acquisition system malfunctioned.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A method of manufacturing a metal sheet having an iron aluminide or nickel aluminide intermetallic alloy composition by a powder metallurgical technique, comprising steps of:

forming a non-densified metal sheet by plasma spraying a powder having an iron aluminide or nickel aluminide intermetallic alloy composition, the powder being plasma sprayed onto a substrate so as to form the non-densified metal sheet with a porosity of less than 10%;

forming a cold rolled sheet by cold rolling the non-densified metal sheet so as to increase the density and reduce the thickness thereof; and annealing the cold rolled sheet by heat treating the cold rolled sheet.

2. The method of claim 1, wherein the intermetallic alloy is an iron aluminide alloy.

3. The method of claim 1, wherein the sheet is plasma sprayed to a thickness no greater than 0.020 inch followed by sintering the plasma sprayed sheet.

4. The method of claim 1, wherein the intermetallic alloy comprises an iron aluminide having, in weight %, 4.0 to 32.0% Al and ≦1% Cr.

5. The method of claim 4, wherein the iron aluminide has a ferritic microstructure which is austenite-free.

6. The method of claim 1, further comprising steps of cold rolling and annealing the cold rolled sheet after the annealing step.

7. The method of claim 1, further comprising a step of forming the cold rolled sheet into an electrical resistance heating element subsequent to the annealing step, the electrical resistance heating element being capable of heating to 900° C. in less than 1 second when a voltage up to 10 volts and up to 6 amps is passed through the heating element.

8. The method of claim 1, further comprising a step of at least partial sintering the non-densified metal sheet prior to the cold rolling step.

9. The method of claim 1, wherein the intermetallic alloy comprises $Fe_3Al$, $Fe_2Al_5$, $FeAl_3$, FeAl, FeAlC, $Fe_3AlC$ or mixtures thereof.

10. A method of manufacturing a metal sheet having an intermetallic alloy composition by a powder metallurgical technique, comprising steps of:

forming a non-densified metal sheet by plasma spraying a powder having an intermetallic alloy composition, the powder being plasma sprayed onto a substrate so as to form the non-densified metal sheet with a porosity of less than 10%;

forming a cold rolled sheet by cold rolling the non-densified metal sheet so as to increase the density and reduce the thickness thereof;

annealing the cold rolled sheet by heat treating the cold rolled sheet, the annealing step comprises heating the cold rolled sheet in a vacuum furnace to a temperature of at least 1200° C. for a time sufficient to achieve a fully dense cold rolled sheet.

11. A method of manufacturing a metal sheet having an intermetallic alloy composition by a powder metallurgical technique, comprising steps of:

forming a non-densified metal sheet by plasma spraying a powder having an intermetallic alloy composition, the powder being plasma sprayed onto a substrate so as to form the non-densified metal sheet with a porosity of less than 10%;

forming a cold rolled sheet by cold rolling the non-densified metal sheet so as to increase the density and reduce the thickness thereof; and annealing the cold rolled sheet by heat treating the cold rolled sheet, further comprising a final cold rolling step followed by a recrystallizing annealing heat treatment step and a stress relieving heat treatment step.

12. A method of manufacturing a metal sheet having an intermetallic alloy composition by a powder metallurgical technique, comprising steps of:

forming a non-densified metal sheet by plasma spraying a powder having an intermetallic alloy composition, the powder being plasma sprayed onto a substrate so as to form the non-densified metal sheet with a porosity of less than 10%;

forming a cold rolled sheet by cold rolling the non-densified metal sheet so as to increase the density and reduce the thickness thereof; and annealing the cold rolled sheet by heat treating the cold rolled sheet, wherein the annealing step is carried out at a temperature of 1100 to 1200° C. in a vacuum or inert atmosphere.

13. A method of manufacturing a metal sheet having an intermetallic alloy composition by a powder metallurgical technique, comprising steps of:

forming a non-densified metal sheet by plasma spraying a powder having an intermetallic alloy composition, the powder being plasma sprayed onto a substrate so as to form the non-densified metal sheet with a porosity of less than 10%;

forming a cold rolled sheet by cold rolling the non-densified metal sheet so as to increase the density and reduce the thickness thereof; and annealing the cold rolled sheet by heat treating the cold rolled sheet, further comprising a final cold rolling step followed by a recrystallization annealing heat treatment and a stress relief annealing heat treatment, the recrystallizing annealing and the stress relief annealing being performed at temperatures wherein the intermetallic alloy is in a B2 ordered phase.

14. The method of claim 1, wherein the powder has an average particle size of 10 to 200 $\mu$m.

15. The method of claim 1, wherein the intermetallic alloy comprises an iron aluminide having, in weight %, ≦32% Al, ≦2% Mo, ≦1% Zr, ≦2% Si, ≦30% Ni, ≦10% Cr, ≦0.3% C, ≦0.5% Y, ≦0.1% B, ≦1% Nb and ≦1% Ta.

16. The method of claim 1, wherein the intermetallic alloy comprises an iron aluminide consisting essentially of, in weight %, 20–32% Al, 0.3–0.5% Mo, 0.05–0.3% Zr, 0.01–0.5% C, ≦0.1% B, ≦1% oxide particles, balance Fe.

17. The method of claim 1, wherein the intermetallic alloy comprises an iron aluminide and the annealing step provides an average grain size of about 10 to 30 $\mu$m.

18. The method of claim 1, wherein the cold rolling is carried out with rollers having carbide rolling surfaces in direct contact with the sheet.

19. The method of claim 1, wherein the sheet is produced without hot working the intermetallic alloy.

20. The method of claim 1, wherein the powder consists essentially of gas, water or polymer atomized powder.

21. The method of claim 1, wherein the cold rolled sheet is subjected to only one cold rolling step.

22. The method of claim 7, wherein the electrical resistance heating element has an electrical resistivity of 140 to 170 $\mu\Omega\cdot$cm.

* * * * *